US006699649B2

(12) United States Patent
Nishijima et al.

(10) Patent No.: US 6,699,649 B2
(45) Date of Patent: Mar. 2, 2004

(54) SILVER SALT PHOTOTHERMOGRAPHIC IMAGING MATERIAL, AND IMAGE RECORDING METHOD AND IMAGE FORMING METHOD BY THE USE THEREOF

(75) Inventors: Ayumu Nishijima, Tokyo (JP); Kiyokazu Morita, Tokyo (JP); Norio Miura, Tokyo (JP); Kazuaki Nakamura, Tokyo (JP); Ryohei Iwamoto, Tokyo (JP); Kiyoshi Fukusaka, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/193,367

(22) Filed: Jul. 11, 2002

(65) Prior Publication Data

US 2003/0194658 A1 Oct. 16, 2003

(30) Foreign Application Priority Data

| | | |
|---|---|---|
| Jul. 17, 2001 | (JP) | 2001-216659 |
| Aug. 31, 2001 | (JP) | 2001-263350 |
| Feb. 8, 2002 | (JP) | 2002-032225 |
| May 22, 2002 | (JP) | 2002-147562 |

(51) Int. Cl.[7] ..... G03C 1/498; G03C 5/16; G03C 1/30

(52) U.S. Cl. ..... 430/351; 430/21; 430/531; 430/619; 430/621; 430/600; 430/613; 430/945

(58) Field of Search ..... 430/619, 351, 430/621, 264, 531, 598, 350, 600, 21, 613, 631, 445

(56) References Cited

U.S. PATENT DOCUMENTS 4,102,312 A * 7/1978 Sashihara et al.
5,766,835 A * 6/1998 Matsunaga ..... 430/523
6,287,755 B1 * 9/2001 Shima et al. ..... 430/619
6,376,166 B1 * 4/2002 Oya et al. ..... 430/619

FOREIGN PATENT DOCUMENTS

EP 1136877 * 9/2001 ..... G03C/1/498

* cited by examiner

*Primary Examiner*—Thorl Chea
(74) *Attorney, Agent, or Firm*—Frishauf, Holtz, Goodman & Chick, P.C.

(57) ABSTRACT

A photothermographic imaging material comprising a support having thereon a photosensitive layer comprising a photosensitive silver halide, a light-insensitive organic silver salt, a binder, and a reducing agent for silver ions, wherein the reducing agent is represented by the following Formula (S):

Formula (S)

wherein Z is a group of atoms necessary to form a non aromatic ring of 3 to 10 members; Rx is a hydrogen or an alkyl group; each Ro' and Ro" is independently a hydrogen, an alkyl group, an aryl group, or a heterocyclic group; Qo is a substituent; and each n and m is independently an integer of 0 to 2; and plural Qos may be the same or different.

25 Claims, No Drawings

SILVER SALT PHOTOTHERMOGRAPHIC IMAGING MATERIAL, AND IMAGE RECORDING METHOD AND IMAGE FORMING METHOD BY THE USE THEREOF

The present invention relates to a silver salt photothermographic dry imaging material, and an image recording method as well as an image forming method using the same.

FIELD OF THE INVENTION

Heretofore, in the medical and graphic arts fields, effluent resulting from wet processing for image forming materials has caused problems with workability. In recent years, from the viewpoint of environmental protection as well as space saving, a decrease in said processing effluent has bee increasingly demanded.

As a result, there have been demanded techniques relating to photothermographic materials which allow to be effectively exposed employing laser imagers and laser image setters, and can form clear black-and-white images exhibiting high resolution.

Such techniques are described in, for example, U.S. Pat. Nos. 3,152,904 and 3,487,075 of D. Morgan and B. Shely, and D. H. Klosterboer et al., "Dry Silver Photographic Materials", (Handbook of Imaging Materials, Marcel Dekker, Inc. page 48, 1991). Also known are silver salt photothermographic dry imaging materials (hereinafter occasionally referred to as light-sensitive materials) comprising a support having thereon organic silver salts, light-sensitive silver halide and reducing agents. Since solution-based processing chemicals are not completely employed for said silver salt photothermographic dry imaging materials, it is possible to provide customers with a system which is simpler and has less adverse impact on environment.

These silver salt photothermographic dry imaging materials are characterized in that light-sensitive silver halide grains, which are incorporated in a light-sensitive layer, are utilized as a photo-sensor and images are formed in such a manner that silver halide grains are thermally developed, commonly at 80 to 140° C., utilizing said incorporated reducing agents while using organic silver salts as a supply source of silver ions, and fixing need not be carried out.

However, said silver salt photothermographic dry imaging materials tend to result in fogging during storage prior to thermal development, due to incorporation of organic silver salts, light-sensitive silver halide grains and reducing agents. Further, after exposure, thermal development is carried out commonly at 80 to 250° C. followed by no fixing. Therefore, since all or some of the silver halide, organic silver salts, and reducing agents remain after thermal development, problems occur in which, during extended storage, image quality such as silver image tone tends to vary due to the fact that metallic silver is created by heat as well as light.

Techniques, which overcome these problems, are disclosed in Japanese Patent Publication Open to Public Inspection Nos. 6-208192 and 8-267934, U.S. Pat. No. 5,714,311, European Patent No. 1096310, and references cited therein. These techniques disclosed therein exhibit some effects, but are not sufficient to meet the market's requirements.

On the other hand, demanded as so-called "everlasting objectives" is further improvement of image quality. Specifically, in the medical image field, demanded is improvement of image quality which makes more accurate diagnosis possible. In particular, wide dynamic range materials have been demanded which can meet various diagnostic needs.

In addition, in order to decrease material cost, as well as to enhance productivity, a decrease in silver coverage is demanded. However, it is not preferable to simply decrease the silver coverage since the resultant image density decreases. In order to minimize the decrease in density at a relatively low silver amount, it is effective to increase the number of developable points per unit area so as to enhance covering power. Heretofore, in light-sensitive materials for graphic arts, techniques have been perfected which make it possible to achieve high image density at a relatively low silver amount and increasing covering power, utilizing "infectious development" employing nucleating agents (described in Japanese Patent Publication Open to Public Inspection (PCT Application) Nos. 10-512061 and 11-511571). However, light-sensitive materials, which are comprised of conventional nucleating agents known in the art, as well as conventional silver ion reducing agents known in the art, have caused problems in which storage stability is degraded and diagnostic properties are deteriorated due to yellow tinting.

SUMMARY OF THE INVENTION

From the viewpoint of the foregoing, the present invention was achieved. An object of the present invention is to provide a silver salt photothermographic dry imaging material which exhibits excellent pre-exposure storage stability, irrespective of high sensitivity as well as low fogging, and further exhibits excellent stability of silver images after thermal development, a wide dynamic range, high maximum density, irrespective of a low silver amount, and desired silver image tone, and an image recording method, as well as an image forming method of the same.

The aforesaid object of the present invention was achieved employing the means described below.

1. A photothermographic imaging material comprising a support having thereon a photosensitive layer comprising a photosensitive silver halide, a light-insensitive organic silver salt, a binder, and a reducing agent for silver ions, wherein the reducing agent is represented by the following Formula (S):

Formula (S)

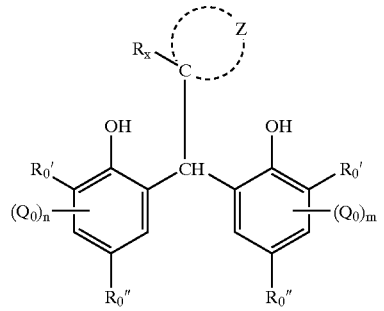

wherein Z is a group of atoms necessary to form a non aromatic ring of 3 to 10 members; Rx is a hydrogen or an alkyl group; each Ro' and Ro" is independently a hydrogen, an alkyl group, an aryl group, or a heterocyclic group; Qo is a substituent; and each n and m is independently an integer of 0 to 2; and plural Qos may be the same or different.

2. The photothermographic imaging material of item 1, wherein the reducing agent is represented by the following Formula (T):

Formula (T)

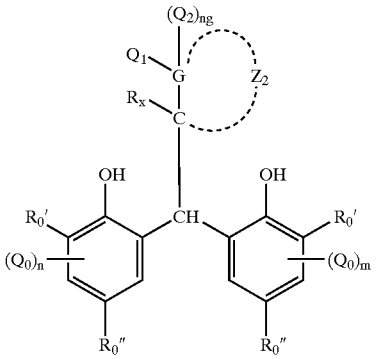

wherein $Q_1$ is a halogen, an alkyl group, an aryl group or a heterocyclic group; $Q_2$ is a hydrogen, a halogen, an alkyl group, an aryl group or a heterocyclic group; G is a nitrogen or a carbon; ng is 0 when G is a nitrogen and ng is 0 or 1 when G is a carbon; $Z_2$ is a carbon or a group of atoms necessary to form a non aromatic ring of 3 to 10 members with G; and each Ro', Ro", Rx, Qo, n and m is the same as used in Formula (S).

3. The photothermographic imaging material of item 1, wherein the reducing agent has a 6 membered non aromatic ring.

4. The photothermographic imaging material of item 1, wherein the photosensitive layer has a silver coverage of from 0.5 to 1.5 g/m$^2$.

5. A photothermographic imaging material, comprising a support having thereon a photosensitive layer comprising a photosensitive silver halide, a light-insensitive organic silver salt, a binder, and a reducing agent for silver ions, wherein the reducing agent is represented by the following Formula (A).

Formula (A)

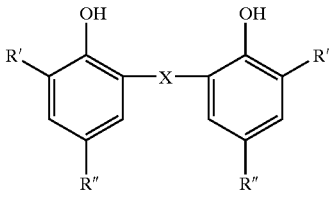

wherein X is a chalcogen or CHR, in which R is a hydrogen, a halogen, or an aliphatic group having at most 7 carbon atoms; and each R' and R" is an alkyl group, and wherein the silver coverage of the photosensitive layer on the support is from 0.5 to 1.5 g/m$^2$.

6. The photothermographic imaging material of item 1, wherein the photosensitive layer has a thermal transition temperature of from 46 to 200° C. measured after the photothermographic imaging material being processed at over 100° C.

7. The photothermographic imaging material of item 1, wherein the binder has a glass transition temperature of from 70 to 105° C.

8. The photothermographic imaging material of item 1, wherein the light-insensitive organic silver salt is produced in the presence of a compound selected from a crystallizing retarding agent and a dispersing agent.

9. The photothermographic imaging material of item 8, wherein the compound is an organic compound having a hydroxyl group or a carboxyl group.

10. The photothermographic imaging material of item 1, wherein the photosensitive layer further comprises a silver-saving compound.

11. The photothermographic imaging material of item 1, wherein the photosensitive image material further comprises a light insensitive layer, and a silver-saving compound is contained in the photosensitive layer or in the light insensitive layer.

12. The photothermographic imaging material of item 10, wherein the silver-saving compound is represented by the following Formula (X):

Formula (X)

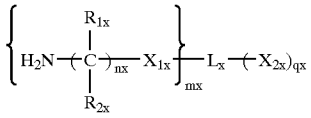

wherein each $R_{1X}$ and $R_{2X}$ is independently a hydrogen or a substituent; $X_{1X}$ is —S—, —O—, or —N($R_{3X}$)—, in which $R_{3X}$ being a hydrogen or a substituent; nx is an integer of 2 or 3; mx is an integer of 1 to 3; $X_{2X}$ is a ballast group, an adsorbing group to a silver halide or a silyl group; qx is an integer of 1 to 3; and $L_X$ is a linking group having 2 to 6 valences.

13. The photothermographic imaging material of item 1, wherein the photothermographic imaging material further comprises a second photosensitive layer on the support.

14. An image recording method, comprising the steps of:

(a) providing the photothermographic imaging material of item 1 in a laser scanning exposure apparatus; and (b) exposing the photothermographic imaging material with a laser beam, wherein the laser beam is applied to the photothermographic imaging material using a longitudinal multiple scanning method.

15. An image forming method, comprising the steps of:

(a) providing the photothermographic imaging material of item 1 in a laser scanning exposure apparatus;

(b) exposing the photothermographic imaging material with a laser beam; and, (c) developing the photothermographic imaging material by applying heat to the photothermographic imaging material after being exposed, wherein after the step (c) being carried out, the photothermographic imaging material exhibits a hue angle hab which satisfies the following relationship:

$$180° < h_{ab} < 270°$$

16. The photothermographic imaging material of item 1, wherein the photosensitive layer further comprises a hardener selected from aromatic compounds having a plurality of isocyanate groups, and wherein the photosensitive layer has a silver coverage of from 0.5 to 1.5 g/m2.

17. The photothermographic imaging material of item 16, wherein the photosensitive layer has a thermal transition temperature of from 46 to 200° C. measured after the photothermographic imaging material being processed at over 100° C.

18. The photothermographic imaging material of item 16, wherein the reducing agent is represented by the following Formula (A).

Formula (A)

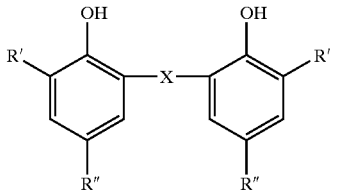

wherein X is a chalcogen or CHR, in which R is a hydrogen, a halogen, an aliphatic group having at most 7 carbon atoms; and each R' and R" is an alkyl group 19. The photothermographic imaging material of item 16, wherein the binder has a glass transition temperature of from 70 to 105° C.

20. The photothermographic imaging material of item 16, wherein the light-insensitive organic silver salt is produced in the presence of a compound selected from a crystallizing retarding agent and a dispersing agent.

21. The photothermographic imaging material of item 20, wherein the compound is an organic compound having a hydroxyl group or a carboxyl group.

22. The photothermographic imaging material of item 16, wherein the aromatic compounds are represented by the following Formula (IH):

$$X_2{=}C{=}N{-}J_1{-}(L)_n{-}(J_2{-}N{=}C{=}X_2)_v \qquad \text{Formula (IH)}$$

wherein each $J_1$ and $J_2$ is independently an arylene group or an alkylene group; L is a saturated or unsaturated aliphatic group, an aryl group or heterocyclic group, which may combine each other or with a divalent linking group, provided that L has a valence of (v+1); $X_2$ is an oxygen or a sulfur; v is an integer of more than 1; n is 0 or 1; and at least one of $J_1$, $J_2$ and L is a group derived from an aryl group.

23. The photothermographic imaging material of item 16, wherein the photosensitive layer further comprises a silver-saving compound.

24. The photothermographic imaging material of item 16, wherein the photosensitive image material further comprises a light insensitive layer, and a silver-saving compound is contained in the photosensitive layer or in the light insensitive layer.

25. The photothermographic imaging material of item 16, wherein the photothermographic imaging material further comprises a second photosensitive layer on the support.

26. An image recording method, comprising the steps of:

(a) providing the photothermographic imaging material of item 16 in a laser scanning exposure apparatus; and (b) exposing the photothermographic imaging material with a laser beam, wherein the laser beam is applied to the photothermographic imaging material using a longitudinal multiple scanning method.

27. An image forming method, comprising the steps of:

(a) providing the photothermographic imaging material of item 16 in a laser scanning exposure apparatus;

(b) exposing the photothermographic imaging material with a laser beam; and, (c) developing the photothermographic imaging material by applying heat to the photothermographic imaging material after being exposed, wherein after the step (c) being carried out, the photothermographic imaging material exhibits a hue angle $h_{ab}$ which satisfies the following relationship:

$$180° < h_{ab} < 270°$$

DETAILED DESCRIPTION OF THE INVENTION

The present invention will now be detailed.

Light-sensitive silver halide grains (hereinafter simply referred to as silver halide grains) will be described which are employed in the silver salt photothermographic dry imaging material of the present invention (hereinafter simply may be referred to as the light-sensitive material of the present invention). Incidentally, the light-sensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of said silver halide crystal and/or on the crystal surface, when said crystals absorb any radiation in the wavelength ranging from ultraviolet to infrared radiation.

Silver halide grains employed in the present invention can be prepared in the form of silver halide grain emulsions, employing methods described in P. Glafkides, "Chimie et Physique Photographique" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, a so-called controlled double-jet precipitation method is preferably employed in which silver halide grains are prepared while controlling formation conditions. Halogen compositions are not particularly limited. Any of silver chloride, silver chlorobromide, silver chloroiodobromide, silver bromide, silver iodobromide, or silver iodide may be employed.

Grain formation is commonly divided into two stages, that is, the formation of silver halide seed grains (being nuclei) and the growth of grains. Either method may be employed in which two stages are continually carried out, or in which the formation of nuclei (seed grains) and the growth of gains are carried out separately. Said controlled double-jet precipitation method, in which grains are formed while controlling the pAg and pH which are grain forming conditions, is preferred, since it is possible to control grain shape as well as grain size. For example, when said method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows said grains while supplying water-soluble silver salts as well as water-soluble halides. After grain formation, in a desalting process, unnecessary salts are removed, employing desalting methods known in the photographic art, such as a noodle method, a flocculating method, a ultrafiltration method, and an electrophoresis method, whereby it is possible to prepare the desired silver halide emulsion.

In order to decrease white turbidity as well as coloration (yellowing) after image formation and to obtain excellent image quality, the average grain diameter of the silver halide grains, employed in the present invention, is preferably rather small. The average grain diameter, when grains having a grain diameter of less than 0.02 $\mu$m is out of the limit of the measurement, is preferably from 0.035 to 0.055 $\mu$m. Incidentally, the grain diameter, as described herein, refers to the edge length of silver halide grains which are so-called regular crystals such as a cube and an octahedron. Further, when silver halide gains are planar, said grain diameter refers to the diameter of the circle which has the same area as the projection area of the main surface.

In the present invention, silver halide grains are preferably monodispersed. Said monodispersion, as described herein, means that the variation coefficient, obtained by the Formula described below, is less than 30 percent. Said variation coefficient is preferably less than 20 percent, and is more preferably less than 15 percent.

Variation coefficient of grain diameter in percent=standard deviation of said grain diameter/average of said grain diameter×100

Cited as shapes of silver halide grains may be cubic, octahedral and tetradecahedral grains, planar grains, spherical grains, rod-shaped grains, and rough elliptical-shaped grains. Of these, cubic, octahedral, tetradecahedral, and planar silver halide grains are particularly preferred.

When said planar silver halide grains are employed, their average aspect ratio is preferably from 1.5 to 100, and is more preferably from 2 to 50. These are described in U.S. Pat. Nos. 5,264,337, 5,314,798, and 5,320,958, and it is possible to easily prepare said target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of [100], it is preferable that the ratio of the [100] plane on the external surface of silver halide grains is high. Said ratio is preferably at least 50 percent, is more preferably at least 70 percent, and is most preferably at least 80 percent. Incidentally, it is possible to obtain the ratio of the plane having a Miller index of [100], based on T. Tani, J. Imaging Sci., 29, 165 (1985), utilizing adsorption dependence of sensitizing dye in [111] plane as well as [100] plane.

The silver halide grains, employed in the present invention, are preferably prepared employing low molecular weight gelatin, having an average molecular weight of less than or equal to 50,000 during formation of said grains. Said low molecular weight gelatin refers to gelatin having an average molecular weight of less than or equal to 50,000. Said molecular weight is preferably from 20,000 to 40,000, and is more preferably from 5,000 to 25,000. It is possible to measure the molecular weight of gelatin employing gel filtration chromatography. It is possible to prepare said low molecular weight gelatin in such a manner that gelatin decomposition enzymes are added to an aqueous solution of gelatin having an average molecular weight of approximately 1000,000 so as to decompose said gelatin; said gelatin solution undergoes hydrolysis by the addition of acid or alkali; gelatin undergoes thermal decomposition while heated under normal atmospheric pressure or increased pressure; gelatin undergoes decomposition through ultrasonic application, or any of these methods may be employed in combination.

The concentration of dispersion media during the formation of nuclei is preferably less than or equal to 5 percent by weight. It is more effective to carry out said formation at a low concentration of 0.05 to 3.00 percent by weight.

During formation of the silver halide grains employed in the present invention, it is preferable to use polyethylene oxides represented by the Formula described below.

$$YO(CH_2CH_2O)_m(CH(CH_3)CH_2O)_p(CH_2CH_2O)_nY \qquad \text{Formula}$$

wherein Y represents a hydrogen atom, —$SO_3M$, or —CO—B—COOM; M represents a hydrogen atom, an alkali metal atom, an ammonium group, or an ammonium group substituted with an alkyl group having less than or equal to 5 carbon atoms; B represents a chained or cyclic group which forms organic dibasic acid; m and n each represents 0 through 50; and p represents 1 through 100.

When silver halide light-sensitive photographic materials are produced, polyethylene oxides, represented by the above Formula, have been preferably employed as an anti-foaming agent against marked foaming which occurs while stirring and transporting emulsion raw materials in a process in which an aqueous gelatin solution is prepared, in the process in which water-soluble halides as well as water-soluble silver salts are added to said gelatin solution, and in a process in which the resultant emulsion is applied onto support. Techniques to employ polyethylene oxides as an anti-foaming agent are disclosed in, for example, Japanese Patent Publication Open to Public Inspection No. 44-9497. The polyethylene oxides, represented by the above Formula, work as an anti-foaming agent during nuclei formation.

The content ratio of polyethylene oxides, represented by the above Formula, is preferably less than or equal to 1 percent by weight with respect to silver, and is more preferably from 0.01 to 0.10 percent by weight.

It is desired that polyethylene oxides, represented by the above Formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at east 70 percent of the time of the same. The polyethylene oxides, represented by the above Formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within said range even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M, and is more preferably in a lower range of 0.01 to 2.50 M. The silver ion addition rate during nuclei formation is preferably from $1.5\times10^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of said formed nuclei, the preferred pH is from 2 to 6. Further, the pBr during nuclei formation is usually from about 0.05 to about 3.00, is preferably from 1.0 to 2.5, and is more preferably from 1.5 to 2.0.

The silver halide grains of the present invention may be added to a light-sensitive layer employing any appropriate method. When added, it is preferable that silver halide grains are arranged so as to be adjacent to reducible silver sources (being aliphatic carboxylic acid silver salts).

From the viewpoint of production control, it is preferable that silver halide of the present invention is previously prepared and is added to a solution which is employed to prepare aliphatic carboxylic acid sliver salt grains, since in that manner, the process to prepare silver halide and the process to prepare aliphatic carboxylic acid silver salt grains are separately handled. On the other hand, as described in British Patent No. 1,447,454, during preparation of aliphatic carboxylic acid silver salt grains, halogen components such as halide ions are mixed with aliphatic carboxylic acid silver salt forming components and by pouring a silver ion solution into the resulting mixture, it is possible to prepare silver halide at almost the same time as the formation of aliphatic carboxylic acid silver salt grains. Further, it is possible to prepare silver halide grains through conversion of aliphatic carboxylic acid silver salts while allowing halogen containing compounds to act on aliphatic carboxylic acid silver salts. Namely, it is possible to convert some of the aliphatic carboxylic acid silver salts to light-sensitive silver halide upon allowing silver halide forming components to act on a previously prepared aliphatic carboxylic acid silver salt solution or dispersion, or a sheet material comprising aliphatic carboxylic acid silver salts.

Silver halide grain forming components include inorganic halides, onium halides, halogenated hydrocarbons, N-halogenated compounds, and other halogen-containing compounds. Specific examples, which are detailed in U.S. Pat. Nos. 4,009,039, 3,457,075, and 4,003,749; British Patent No. 1,498,956; and Japanese Patent Publication Open to Public Inspection Nos. 53-27027 and 53-25420, include, for example, metal halides, inorganic halides such as ammonium halide, onium halides such as trimethylphenylammonium bromide, cetylethyldimethylammonium bromide, trimethylbenzylammonium bromide, halogenated hydrocarbons such as iodoform, bromoform, carbon tetrachloride, and 2-bromo-2-methylpropane, N-halogenated compounds such as N-bromosuccinic acid imide, N-bromophthalimide, and N-bromoacetamide, and other components such as triphenylmethyl chloride, triphenylmethyl bromide, 2-bromoacetic acid, 2-bromoethanol, and dichlorobenzophenone. As described above, it is possible to prepare silver halide by converting some or all the silver in organic acid silver salts into silver halide upon allowing organic acid silver to react with halogen ions. Further, silver halide grains, which are produced upon converting some of the aliphatic carboxylic acid silver salts employing separately prepared silver halide may be employed in combination.

These silver halide grains, together with separately prepared silver halide grains, as well as silver halide grains, which are prepared by converting aliphatic carboxylic acid silver salts, are employed in an amount of 0.001 to 0.700 mol per mol of aliphatic carboxylic acid silver salts and more preferably in an amount of 0.03 to 0.50 mol.

Silver halide grains, employed in the present invention, preferably comprise ions of transition metals which belong to Groups 6 through 11 of the Periodic Table. Preferably employed as said metals are W, Fe, Co, Ni, Cu, Ru, Rh, Pd, Re, Os, Ir, Pt, and Au. One kind of metal or at least two of the same kind or different kinds of metal complexes may be employed in combination. These metal ions may be incorporated in silver halide in the form of salts without any special treatment, but may be incorporated in silver halide in the form of metal complexes or complex ions. The content ratio is preferably in the range of $1\times10^{-9}$ to $1\times10^{-2}$ mol per mol of silver, and is more preferably in the range of $1\times10^{-8}$ to $1\times10^{-4}$. In the present invention, transition metal complexes or complex ions represented by the Formula, described below, are preferred.

$$[ML_6]^m \qquad \text{Formula}$$

wherein M represents a transition metal selected from the elements of Groups 6 through 11 in the Periodic Table; L represents a ligand; and m represents 0, -, 2-, 3-, or 4-. Listed as specific examples of ligands represented by L each of a halogen ion (a fluoride ion, a chloride ion, a bromide ion, or an iodide ion), a cyanide, a cyanato, a thiocyanatato, a selenocyanato, a tellurocyanato, an azido, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in said silver halide grains. Said compounds may be added at any stage of silver halide grain preparation, namely nuclei formation, growth, physical ripening, or prior to or after chemical ripening. However, they are preferably added at the stage of nuclei formation, growth, and physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in Japanese Patent Publication Open to Public Inspection Nos. 63-29603, 2-306236, 3-167545, 4-76534, 6-110146, and 5-273683, they may be incorporated so as to result in a desired distribution in the interior of the grains.

These metal compounds may be added after dissolving them in water or suitable organic solvents (for example, alcohols, ethers, glycols, ketones, esters, and amides). Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a said compound solution a third aqueous solution employing a triple-jet precipitation method, a method in which, during grain formation, an aqueous metal compound solution in a necessary amount is charged into a reaction vessel, or a method in which, during preparation of silver halide, separate silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

The separately prepared light-sensitive silver halide particles are subjected to desalting employing desalting methods known in the photographic art, such as a noodle method, a flocculation method, an ultrafiltration method, and an electrophoresis method, while they may be employed without desalting.

The light-insensitive organic silver salts of the present invention are reducible silver sources and are light-insensitive. Employed as organic acids employed in the present invention, are aliphatic carboxylic acids, carbon cyclic carboxylic acids, heterocyclic ring carboxylic acids, and heterocyclic ring compounds.

Examples of organic acid silver salts are described in Research Disclosure Items 17029 and 29963, and include aliphatic carboxylic acid silver salts (for example, silver salts of gallic acid, oxalic acid, behenic acid, arachidic acid, stearic acid, palmitic acid, and lauric acid); silver carboxyalkylthiourea salts (for example, 1-(3-carboxypropyl) thiourea, 1-(3-carboxypripyl)-3,3-dimethylthiourea); silver complexes of polymerization products of aldehydes with hydroxy-substituted aromatic carboxylic acids (for example, silver complexes of polymerization products of aldehydes such as formaldehyde, acetaldehyde, and butylaldehyde with hydroxy-substituted aromatic carboxylic acids such as salicylic acid, benzoic acid, 3,5-dihydroxybenzoic acid, and 4,5-thiodisalicylic acid); silver salts or complexes of thiones (for example, complexes or salts of silver with 3-(2-carboxyethyl)-4-hydroxymethyl-4-thizoline-2-thione and 3-caroboxymethyl-4-thiazoline-2-thione, and nitrogen acid selected from imidazole, pyrazole, urazole, 1,2,4-thiazole, 1H-tetrazole, 3-amino-5-benzylthio-1,2,4-triazole, and benzotriazole; silver salts of saccharine and 5-chlorosalicylaldoxime; and silver salts of mercaptides.

Of the organic silver salts described above, silver salts of aliphatic carboxylic acids are preferably employed and aliphatic carboxylic acid silver salts, having from 10 to 30 carbon atoms, are more preferred and those, having from 15 to 25 carbon atoms are still more preferred. Listed as examples of suitable silver salts are those described below.

Silver salts of gallic acid, oxalic acid, behenic acid, stearic acid, arachidic acid, palmitic acid, and lauric acid. Of these, listed as preferable silver salts are silver behenate, silver arachidate, and silver stearate. Further, in the present invention, in order to form high contrast and high density silver images upon enhancing developability, it is preferable that at least two aliphatic carboxylic acid silver salts are mixed. For example, preparation is preferably carried out by mixing a silver ion solution with a mixture consisting of at least two aliphatic carboxylic acids.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in Japanese Patent Publication Open to Public Inspection No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing said soap with silver nitrate. In such a case, silver halide grains may be mixed together with them.

In the aliphatic carboxylic acid silver salt grains of the present invention, it is preferable that the average circle equivalent diameter is from 0.05 to 0.80 μm, and the average thickness is from 0.005 to 0.070 μm, and it is still more preferable that the average circle equivalent diameter is from 0.2 to 0.5 mm, and it is more preferable that the average circle equivalent diameter is from 0.2 to 0.5 μm and the average thickness is from 0.01 to 0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, said silver ions are not used to form silver images. As a result, the image retention properties are markedly degraded. On the other hand, when the average thickness is more than or equal to 0.07 μm, the surface area becomes smaller, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

The average thickness is determined employing a method utilizing a transmission electron microscope (hereinafter referred to as a TEM) as described below.

First, a light-sensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. Said ultra-thin slice is supported by a copper mesh and transferred onto a hydrophilic carbon layer, employing a glow discharge. Subsequently, while cooling the resultant slice at less than or equal to −130° C. employing liquid nitrogen, a bright field image is observed at a magnification of 5,000 to 40,000, employing TEM, and images are quickly recorded employing either film, imaging plates, or a CCD camera. During said operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, said organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out said image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of said thickness of aliphatic carboxylic acid silver salts, extracted as above, are manually determined employing appropriate software, and an average value is then obtained.

Methods to prepare aliphatic carboxylic acid silver salt grains, having the shape as above, are not particularly limited. It is preferable to maintain a mixing state during formation of an organic acid alkali metal salt soap and/or a mixing state during addition of silver nitrate to said soap as desired, and to optimize the proportion of organic acid to said soap, and of silver nitrate which reacts with said soap.

It is preferable that, if desired, the planar aliphatic carboxylic acid silver salt grains (referring to aliphatic carboxylic acid silver salt grains, having an average circle equivalent diameter of 0.05 to 0.80 $\mu$m as well as an average thickness of 0.005 to 0.070 $\mu$m) are preliminarily dispersed together with binders as well as surface active agents, and thereafter, the resultant mixture is dispersed employing a media homogenizer or a high pressure homogenizer. Said preliminary dispersion may be carried out employing a common anchor type or propeller type stirrer, a high speed rotation centrifugal radial type stirrer (being a dissolver), and a high speed rotation shearing type stirrer.

Further, employed as said media homogenizers may be rotation mills such as a ball mill, a planet ball mill, and a vibration ball mill, media stirring mills such as a bead mill and an attriter, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, $Al_2O_3$, $BaTiO_3$, $SrTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_3O_3$, $SrTiO_3$ (strontium titanate), $BeAl_2O_4$, $Y_3Al_5O_{12}$, $ZrO_2$—$Y_2O_3$ (cubic crystalline zirconia), 3BeO—$Al_2O_3$—$6SiO_2$ (synthetic emerald), C (synthetic diamond), $Si_2O$—$nH_2O$, silicon nitride, yttrium-stabilized zirconia, and zirconia-reinforced alumina. Due to the fact that impurity formation due to friction with beads as well as the homogenizer during dispersion is minimized, yttrium-stabilized zirconia and zirconia-reinforced alumina (hereinafter, ceramics comprising said zirconia are abbreviated as zirconia) are preferably employed.

In apparatuses which are employed to disperse the planar aliphatic carboxylic acid silver salt grains of the present invention, preferably employed as materials of the members which come into contact with said aliphatic carboxylic acid silver salt grains are ceramics such as zirconia, alumina, silicon nitride, and boron nitride, or diamond. Of these, zirconia is preferably employed. During said dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high pressure homogenizer is employed as a dispersion means, preferable operation conditions are from 29.42 to 98.06 Mpa, and at least double operation frequency. Further, when the media homogenizer is employed as a dispersion means, the peripheral rate of 6 to 13 m/second is cited as the preferable condition.

In the present invention, compounds, which are described herein as crystal growth retarding agents or dispersing agents for aliphatic carboxylic acid silver salt grains, refer to compounds which, in the production process of aliphatic carboxylic acid silver salts, exhibit more functions and greater effects to decrease the grain diameter, and to enhance monodispersibility when said aliphatic carboxylic acid silver salts are prepared under the presence of said compounds, compared to the case in which said compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isosteraric acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as poly(vinyl alcohol), poly(acrylic acid), acrylic acid copolymers, maleic acid copolymers, carboxymethyl cellulose, hydroxypropyl cellulose, hydroxypropyl methyl cellulose, poly(vinylpyrrolidone), and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease grain size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts so as to increase the distortion of crystal lattices whereby grain size decreases due to non-formation of over-sized crystals.

As noted above, in terms of the constitution of the silver salt photothermographic dry imaging materials, the greatest difference from conventional silver halide light-sensitive photographic materials is that in the materials of the former, irrespective of pre-development or post-development, a large amount of light-sensitive silver halide, organic silver salts, and reducing agents, which may result in fogging as well as print-out silver, are incorporated. Due to that, it is essential to apply advanced fog inhibiting and image stabilizing techniques to the silver salt photothermographic dry imaging materials in order to maintain the storage stability prior to development as well as after development. Heretofore, in addition to aromatic heterocyclic ring compounds, which retard the growth of fog specks as well as development, mercury compounds such as mercury acetate, which oxidize and remove said fog specks, have been employed as a very effective storage stability-improving agent. However, the use of said mercury compounds have caused problems from the viewpoint of safety as well as environmental protection.

Antifoggants as well as image stabilizing agents employed in the silver salt photothermographic dry imaging material of the present invention will now be described.

In the silver salt photothermographic dry imaging material of the present invention, mainly employed as reducing agents are bisphenols as described below. Accordingly, it is preferable that incorporated compounds are which are capable of deactivating reducing agents upon generating reaction active species which extract hydrogen of said bisphenols. Compounds are preferred which are colorless and photo-oxidizing compounds which are capable of generating free radicals during exposure as a reaction active specie.

Accordingly, any compounds may be employed as long as they exhibit the functions as described above. However, organic free radicals, which are comprised of a plurality of atoms, are preferred. Compounds of any appropriate structure may be employed as long as they exhibit said functions and do not adversely affect the silver salt photothermographic dry image materials.

Further, it is preferable that said free radical generating compounds have a carbocyclic type or heterocyclic type aromatic group so as to result in stability of the position during sufficient contact time so that generated free radicals react with reducing agents to deactivate them.

Listed as such representative compounds may be bi-imidazolyl compounds as well as iodonium compounds, described below.

Listed as bi-imidazolyl compounds are those represented by Formula [1], described below.

Formula [1]

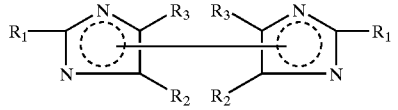

wherein $R_1$, $R_2$, and $R_3$ (which may be the same or different) each represents an alkyl group (for example, a methyl group, an ethyl group, or a hexyl group), an alkenyl group (for example, a vinyl group or an allyl group), an alkoxy group (for example, a methoxy group, an ethoxy group, or an octyloxy group), an aryl group (for example, a phenyl group, a naphthyl group, or a tolyl group), a hydroxyl group, a halogen atom, an aryloxy group (for example a phenoxy group), an alkylthio group (for example, a methylthio group or a butylthio group), an arylthio group (for example, a phenylthio group), an acyl group (for example, an acetyl group, a propionyl group, a butyryl group, or a vareryl group), a sulfonyl group (for example, a methylsulfonyl group or a phenylsulfonyl group), an acylamino group, a sulfonylamino group, an acyloxy group (for example, an acetoxy group or a benzoxy group), a carboxyl group, a cyano group, a sulfo group, and an amino group. Of these, preferable substituents include an aryl group, an alkenyl group, and a cyano group.

The aforesaid bi-imidazolyl compounds can be synthesized employing the production methods described in U.S. Pat. No. 3,734,733 and British Patent No. 1,271,177 and analogous methods thereof.

Listed as preferable specific examples may be compounds described in Japanese Patent Publication Open to Public Inspection No. 2000-321711.

Further, listed as similarly suitable compounds may be iodonium compounds represented by Formula [2], describe below.

Formula [2]

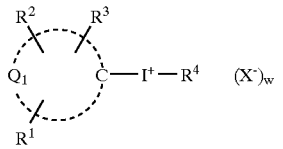

wherein $Q_1$ represents a group of atoms which are necessary to form a 5-, 6-, or 7-membered ring and in which necessary atoms may be selected from the group consisting of a carbon atom, a nitrogen atom, an oxygen atom, and a sulfur atom; $R^1$, $R^2$, and $R^3$ (which may be different or the same) each represents a hydrogen atom, an alkyl group (for example, a methyl group, an ethyl group, or a hexyl group), an alkenyl group (for example, a vinyl group or an allyl group), an alkoxy group (for example, a methoxy group, an ethoxy group, or an octyloxy group), an aryl group (for example, a phenyl group, a naphthyl group, or a tolyl group), a hydroxyl group, a halogen atom, an aryloxy group (for example, a phenoxy group), an alkylthio group,(for example, a methylthio group or butylthio group), an arylthio group (for example, a phenylthio group), an acyl group (for example, an acetyl group, a propionyl group, a butyryl group, or a valeryl group), a sulfonyl group (for example, a methylsulfonyl group or a phenylsulfonyl group), an acylamino group, a sulfonylamino group, an acyloxy group (for example, an acetoxy group or a benzoxy group), a carboxyl group, a cyano group, a sulfo group, and a cyano group;

$R^4$ represents a carboxylate group such as an acetate group, a benzoate group, and trifluoroacetate group, and $O^-$; W represents 0 or 1;

$X^-$ represents an anionic counter ion including $CH_3CO_2^-$, $CH_3SO_3^-$ and $PFe_6^-$ as a suitable example.

When $R^3$ represents a sulfo group or a carboxyl group, W represents 0 and $R^4$ represents $O^-$.

Incidentally, any of $R^1$, $R^2$, or $R^3$ may be combined with each other to form a ring.

Of these, particularly preferable compounds are represented by Formula, [3] described below.

Formula [3]

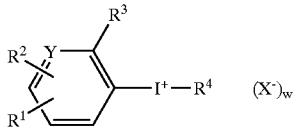

wherein $R^1$, $R^2$, $R^3$, $R^4$, $X^-$ and W are the same as defined in the aforesaid Formula [2] and Y represents a carbon atom (—CH═; benzene ring) or a nitrogen atom (—N═; pyridine ring).

The aforesaid iodonium compounds can be synthesized employing the production methods described in Org. Syn., 1961 and Frieser, "Advanced Organic Chemistry", (Reinhold, N.Y., 1961) or any analogous methods thereof.

Listed as preferable examples may be compounds described in Japanese Patent Publication Open to Public Inspection No. 2000-321711.

The added amount of the compounds represented by Formulas [1] and [2] is commonly from $10^{-3}$ to $10^{-1}$ mol/m$^2$, and is preferably from $5\times10^{-3}$ to $5\times10^{-2}$ mol/m$^2$. Said compounds may be incorporated in any constituting layer of the light-sensitive material of the present invention, but is preferably incorporated near the reducing agents.

Further, preferred as compounds which inactivate reducing agents so that said reducing agents are not capable of reducing aliphatic carboxylic acid silver salts to silver are those in which reactive components are not halogen atoms. However, compounds, which release halogen atoms as an active component, may be employed together with compounds which release active components other than halogen atoms. Many compounds are known as those which are capable of releasing halogen atoms as active components, and when employed in combination, desired effects are obtained.

Listed as specific examples of compounds which create such active halogen atoms are the compound represented by Formula [4].

Formula [4]

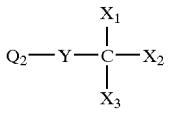

wherein $Q_2$ represents an aryl group or a heterocyclic group; $X_1$, $X_2$, and $X_3$ each represents a hydrogen atom, a halogen atom, an acyl group, an alkoxycarbonyl group, a sulfonyl group, or an aryl group, however, at least one of these is to represent a halogen atom; and Y represents —C(═O)—, —SO—, or —$SO_2$—.

Aryl groups represented by $Q_2$ may be comprised of a single ring or a condensed ring. They are preferably single ring or 2-ring aryl groups containing from 6 to 30 carbon atoms (for example, a phenyl group or a naphthyl group); are more preferably phenyl groups or naphthyl groups, and are further more preferably phenyl groups.

The heterocyclic group represented by $Q_2$ is a 3 to 10-membered saturated or unsaturated heterocyclic group containing at least one of a nitrogen atom, an oxygen atom or a sulfur atom, and may be comprised of a single ring or may form a condensed ring with another ring.

Said heterocyclic ring is preferably a 5- or 6-membered unsaturated heterocyclic group which may have a condensed ring; is more preferably a 5- or 6-membered aromatic heterocyclic group which may have a condensed ring; is further more preferably a 5- or 6-membered aromatic heterocyclic group which may have a condensed ring containing a nitrogen atom; and is most preferably a 5- or 6-membered aromatic heterocyclic group which may have a condensed ring containing from 1 to 4 nitrogen atoms. Listed as preferable heterocycles in said heterocyclic rings are imidazole, pyrazole, pyridine, pyrimidine, pyrazine, pyridazine, triazole, triazine, indole, indazole, purine, thiadiazole, oxadiazole, quinoline, phthalazine, naphthyrizine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene. Of these, more preferred are imidazole, pyridine, pyrimidine, pyrazine, pyridazine, triazole, triazine, thiadiazole, oxadiazole, quinoline, phthalazine, naphthyrizine, quinoxaline, quinazoline, cinnoline, tetrazole, thiazole, oxazole, benzimidazole, benzoxazole, benzthiazole, and tetraazaindene. Of these, further more preferred are imidazole, pyridine, pyrimidine, pyrazine, pyridazine, triazole, triazine, thiadiazole, quinoline, phthalazine, naphthyrizine, quinoxaline, quinazoline, cinnoline, tetrazole, thiazole, benzimidazole, and benzthiazole, and of these, most preferred are pyridine, thiadiazole, quinoline and benzthiazole.

The aryl group as well as the heterocyclic group represented by $Q_2$ may have a substituent besides —Y—C($X_1$)($X_2$)($X_3$). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, an amidophosphate group, a halogen atom, a cyano group, a sulfo group, a carbocyclic group, a nitro group, and a heterocylic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, amidophosphate group, a halogen atom, a cyano group, a nitro group, and a heterocyclic group. Of these, further more preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group. Of these, most preferred are an alkyl group, an aryl group or a halogen atom.

$X_1$, $X_2$, and $X_3$ each is preferably a halogen atom, a haloalkyl group, an acyl group, an alkoxycarbonyl group, an aryloxycarbonyl group, a carbamoyl group, a sulfamoyl group, a sulfonyl group or a heterocyclic group; is more preferably a halogen atom, a haloalkyl group, an acyl group, an alkoxycarbonyl group, an aryloxycarbonyl group, or a sulfonyl group; is further more preferably a halogen atom or a trihalomethyl group; and is most preferably a halogen atom. Of halogen atoms, a chlorine atom, a bromine atom, and an iodine atom are preferred; a chlorine atom or a bromine atom is more preferred; and a bromine atom is most preferred.

Y represents —C(=O)—, —SO—, and —$SO_2$—. Of these, —$SO_2$— is preferred.

The added amount of these compounds is preferably in the range which substantially causes no problems with an increase in print-out silver due to the formation of silver halide. Said added amount is preferably less than or equal to 150 percent, and more preferably less than or equal to 100 percent in terms of the ratio to the aforesaid compounds which do not create a halogen radical.

Incidentally, other than the aforesaid compounds, compounds, which are conventionally known as an antifoggant, may be incorporated in the silver salt photothermographic dry imaging material of the present invention. Said compounds may be ones which are capable of creating reactive components in the same manner as the aforesaid compounds or others which result in different antifogging mechanism. Listed as examples of said compounds are those described in U.S. Pat. Nos. 3,589,903, 3,874,946, 4,546,075, 4,452,885, and 4,756,999, and Japanese Patent Publication Open to Public Inspection No. 59-572234, 9-288328, and 9-90550. Further listed as other antifoggants are compounds which are disclosed in U.S. Pat. No. 5,028,523, and European Patent Nos. 600,587, 605,981, and 631,176.

In the present invention, specified compounds, in which at least one of said silver ion-reducing agents is a bisphenol derivative, are employed individually or together with other reducing agents which have different chemical structures. By employing the compounds above, it is possible to surprisingly minimize quality degradation, due to fogging during storage, as well as to minimize color variation during storage of silver images after thermal development of the silver salt photothermographic imaging material according to the present invention. Further, specifically, it is possible to obtain surprising effects that, by employing silver-saving agents together with other additives, the maximum density reaches the desired level even at a relatively low silver coverage, and images are obtained which exhibit desired silver tone as well as excellent process fluctuation resistance. Specifically, when the silver saving agents represented by Formula (X) are employed together with other additives, the resultant effects are pronounced.

Preferred as reducing agents employed in the present invention are bisphenol derivatives represented by aforesaid Formulas (S), (T), or (A). Compounds having a ring structure, represented by Formulas (S) or (T) are more preferred. Said ring is preferably a 6-membered ring.

In Formula (S), Z represents a group of atoms which are necessary to form 3- to 10-membered non-aromatic rings. Listed as said 3-membered rings are cyclopropyl, aziridyl, and oxiranyl; as said 4-membered rings are cylcobutyl, cyclobutenyl, oxetanyl, and azetidinyl; as said 5-membered rings are cyclopentyl, cyclopentenyl, cylopentadienyl, tetrahydrofuranyl, pyrrolidinyl, and tetrahydrothienyl; as said 6-membered rings are cyclohexyl, cyclohexenyl, cyclohexadienyl, tetrahydropyranyl, pyranyl, piperidinyl, dioxanyl, tetrahydrothiopyranyl, norcaranyl, norpinanyl, and norbornyl; as said 7-membered rings are cycloheptyl, cycloheptynyl, and cycloheptadienyl; as said 8-membered rings are cyclooctanyl, cyclooctenyl, cyclooctadienyl, and cyclooctatrienyl; as said 9-membered rings are cyclononanyl, cyclononenyl, cyclononadienyl, and cyconatrienyl; and as said 10-membered rings are cyclodecanyl, cyclodecenyl, cyclodecadienyl, and cyclodecatrienyl.

Rings are preferably from 3- to 6-membered rings, are more preferably 5- or 6-membered rings, and are most preferably 6-membered rings. Of these, hydrocarbon rings containing no heteroatoms are preferred. Said ring may form a spiro bond with another ring through a spiro atom, or may form any condensed ring with another ring containing an aromatic ring. Further, said ring may have an optional substituent in its ring. Specifically listed as said substituents are a halogen atom (for example, a fluorine atom, a chlorine atom, or a bromine atom), an alkyl group (for example, a methyl group, an ethyl group, a propyl group, a butyl group, a pentyl group, an isopentyl group, a 2-ethyl-hexyl group, an octyl group, or a decyl group), a cycloalkyl group (for example, a cyclohexyl group or a cycloheptyl group), an alkenyl group (for example, an ethenyl-2-propenyl group, a 3-butenyl group, a 1-methyl-3-propenyl group, a 3-pentenyl group, or a 1-methyl-3-butenyl group), a cycloalkenyl group (for example, a 1-cycloalkenyl group or a 2-cycloalkenyl group), an alkynyl group (for example, an ethynyl group or a 1-propynyl group), an alkoxy group (for example, a methoxy group, an ethoxy group, or a propoxy group), an alkylcarbonyloxy group (for example, an acetyloxy group), an alkylthio group (for example, a methylthio group or trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group or an N,N-dimethylcarbamoyl group, an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfoneamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group) Further, when two or more substituents are employed, they may be the same or different. Of these, an alkyl group is particularly preferred. $R_0'$ and $R_0''$ each represents a hydrogen atom, an alkyl group, an aryl group, or a heterocyclic group. Preferred as said alkyl groups are ones having from 1 to 10 carbon atoms. Listed as specific examples are a methyl group, an ethyl group, a propyl group, an isopropyl group, a butyl group, a t-butyl group, a pentyl group, an isopentyl group, a 2-ethyl-hexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethynyl group, and a 1-propynyl group. More preferably listed are a methyl group, an ethyl group, an isopropyl group, a t-butyl group, a cyclohexyl group, and a 1-methylcyclohexyl group. Further more preferably listed are a methyl group, a t-butyl group, and a 1-methylcyclohexyl group. Of these, a methyl group is most preferred. Listed as specific examples of said aryl groups are a phenyl group, a naphthyl group, and an anthranyl group. Listed as specific examples of said heterocyclic groups are aromatic heterocyclic groups such as a pyridine group, a quinoline group, an isoquinoline group, an imidazole group, a pyrazole group, a triazole group, an oxazole group, a thiazole group, an oxadiazole group, a thiadiazole group, and a tetrazole group, as well as non-aromatic heterocyclic groups such as a piperizino group, a morpholine group, a tetrahydrofuryl group, a tetrahydrothienyl group, and a tetrahydropiranyl group. Said groups may have substituents. Listed as said substituents may be those in the rings as above described. A plurality of $R_0'$ and $R_0''$ may be the same or different. The most preferred case is that all $R_0'$ and $R_0''$ represent a methyl group.

$R_X$ represents a hydrogen atom or an alkyl group, which preferably contains from 1 to 10 carbon atoms. Listed as specific examples are a methyl group, an ethyl group, a propyl group, an isopropyl group, a butyl group, a t-butyl group, a pentyl group, an isopentyl group, a 2-ethyl-hexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethnyl group, and a 1-propynyl group. More preferably listed are a methyl group, an ethyl group, and an isopropyl group. $R_x$ is preferably a hydrogen atom.

$Q_0$ represents a group which can be substituted onto a benzene ring. Specifically listed are an alkyl group having from 1 to 25 carbon atoms (such as a methyl group, an ethyl group, a propyl group, an isopropyl group, a tert-butyl group, a pentyl group, a hexyl group, and a cyclohexyl group), a halogenated alkyl group (such as a trifluoromethyl group and a perfluorooctyl group), a cycloalkyl group (such as a cyclohexyl group and a cyclopentyl group), an alkynyl group (such as a propargyl group), a glycidyl group, an acrylate group, a methacrylate group, an aryl group (such as a phenyl group), a heterocyclic group (such as a pyridyl group, a thiazolyl group, an oxazolyl group, an imidazolyl group, a furyl group, a pyrolyl group, a pyradinyl group, a pyrimidinyl group, a pyridadinyl group, a selenazolyl group, a sliphoranyl group, a piperidinyl group, a pyrazolyl group, and a tetrazolyl group), a halogen atom (such as a chlorine atom, a bromine atom, an iodine atom, and a fluorine atom), an alkoxy group (such as a methoxy group, an ethoxy group, a propyloxy group, a pentyloxy group, a cyclopentyloxy group, a hexyloxy group, and a cyclohexyloxy group), an aryloxy group (such as a phenoxy group), an alkoxycarbonyl group (such as a methyloxycarbonyl group, an ethyloxycarbonyl group, and a butyloxycarbonyl group), an aryloxycarbonyl group (such as a phenyloxycarbonyl group), a sulfonamido group (such as a methanesulfonamido group, an ethanesulfonamido group, a butanesulfonamido group, a hexanesulfonamido group, a cyclohexanesulfonamido group, and a benzenesulfonamido group), a sulfamoyl group (such as an aminosulfonyl group, a methylsulfonyl group, a dimethylaminosulfonyl group, a butylaminosulfonyl group, a hexylaminosulfonyl group, a cyclohexylaminosulfonyl group, a phenylaminosulfonyl group, and a 2-pyridylaminosulfonyl group), a urethane group (such as a methylureido group, an ethylureido group, a pentylureido group, a cyclohexylureido group, a phenylureido group, and a 2-pyridylureido group), an acyl group (such as an acetyl group, a propionyl group, a butanoyl group, a hexanoyl group, a cyclohexanoyl group, a benzoyl group, and a pyridinoyl group), a carbamoyl group (such as an aminocarbonyl group, a methylaminocarbonyl group, a dimethylaminocarbonyl group, a propylaminocarbonyl group, a pentylaminocaerbonyl group, a cyclohexylaminocarbonyl group, a phenylaminocarbonyl group, and a 2-pyridinylaminocarbonyl group), an amido group (such as an acetamide group, a propionamido group, a butaneamido group, a hexaneamido group, and a benzamido group), a sulfonyl group (such as a methylsulfonyl group, an ethylsulfonyl group, a butylsulfonyl group, a cyclohexylsulfonyl group, a phenylsulfonyl group, and a 2-pyridylsulfonyl group), an amino group (such as an amino group, an ethylamino group, a dimethylamino group, a butylamino group, a cyclopentylamino group, an anilino group, and a 2-pyridylamino group), a cyano group, a nitro group, a sulfo group, a carboxyl group, a hydroxyl group, an oxamoyl group. Further, said group may be substituted with said groups. n and m each represents an integer of 0, 1, and 2. However, most preferably, n and m each represents 0.

In Formula (T), $Q_1$ represents a halogen atom, an alkyl group, an aryl group, or a heterocyclic group, and $Q_2$ represents a hydrogen atom, a halogen atom, an alkyl group, an aryl group, or a heterocyclic group. Specifically listed as halogen atoms are chlorine, bromine, fluorine, and iodine. Of these, fluorine, chlorine and bromine are preferred. Specific alkyl groups are preferably those having from 1 to 10 carbon atoms. Listed as specific examples are a methyl group, an ethyl group, a propyl group, an isopropyl group, a butyl group, a t-butyl group, a pentyl group, an isopentyl group, a 2-ethyl-hexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethynyl group, and a 1-propynyl group. Of these, a methyl group as well as an ethyl group is more preferred. Specifically listed as aryl groups are a phenol group and a naphthyl group. Preferably listed as heterocyclic groups are 5- or 6-membered heterocyclic aromatic groups such as a pyridyl group, a furyl group, a thienyl group, and an oxazolyl group. G represents a nitrogen atom or a carbon atom, of which said carbon atom is preferred. ng represents 0 or 1, and is preferably 1. $Q_1$ is most preferably a methyl group, while $Q_2$ is preferably a hydrogen atom or a methyl group, and is most preferably a hydrogen atom.

$Z_2$ represents a group of atoms which are necessary to form a 3- to 10-membered non-aromatic ring together with carbon atoms as well as G. Said 3- to 10-membered non-aromatic rings are the same as defined as those in the aforesaid Formula (S).

$R_0'$, $R_0''$, $R_x$, $Q_0$, n, and m are the same as those defined in Formula (S).

Specifically listed as chalcogen atoms represented by X in Formula (A) are a sulfur atom, a selenium atom, and a tellurium atom. Of these, a sulfur atom is preferred. R represents a hydrogen atom, a halogen atom, and an aliphatic chain group having carbon atoms fewer than or equal to 7. Listed as halogen atoms are, for example, a fluorine atom, a chlorine atom, and a bromine atom, while listed as aliphatic chain groups having carbon atoms less than or equal to 7 are, for example, a methyl group, an ethyl group, a propyl group, an isopropyl group, a butyl group, a hexyl group, a heptyl group, a vinyl group, an allyl group, a butenyl group, a hexadienyl group, an ethenyl-2-propenyl group, a 3-butenyl group, a 1-methyl-3-propenyl group, a 3-pentenyl group, and a 1-methyl-3-butenyl group. As R, preferred are aliphatic chain groups having carbon atoms fewer than or equal to 7. Of these, a methyl group, an ethyl group, and an isopropyl group are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different.

R' and R" each represents an alkyl group. Specifically, it is preferable that R' and R" each contains from 1 to 10 carbon atoms. Listed as specific examples are a methyl group, an ethyl group, a propyl group, an isopropyl group, a butyl group, a t-butyl group, a pentyl group, an isopentyl group, a 2-ethyl-hexyl group, an octyl group, a decyl group, a cyclohexyl group, a cycloheptyl group, a 1-methylcyclohexyl group, an ethenyl-2-propenyl group, a 3-butenyl group, a 1-methyl-3-propenyl group, a 3-pentenyl group, a 1-methyl-3-butenyl group, a 1-cycloalkenyl group, a 2-cycloalkenyl group, an ethynyl group, or a 1-propyl group. Of these, preferred are a methyl group, an ethyl group, an isopropyl group, a t-butyl group, a cyclohexyl group, or a 1-methylcyclohexyl group. Of these, most preferred is a methyl group. These groups may have a substituent. Listed as said substituents may be those which are employed in the ring described above. Both R' and R" may be the same or different. However, most preferably, both are methyl groups.

Specific examples of compounds represented by Formulas (S), (T), and (A) of the present invention will now be listed below. However, the present invention is not limited to these examples.

| Compound | Formula |
|---|---|
| 1-1 to 1-27: | A |
| 1-28 to 1-33: | S |
| 1-34 & 1-35: | T |
| 1-36 to 1-38: | S |
| 1-39 to 1-41: | T |

-continued

| Compound | Formula |
|---|---|
| 1-42 to 1-44: | S |
| 1-45: | T |
| 1-46: | S |
| 1-47 to 1-50: | T |
| 1-51: | S |
| 1-52: | T |
| 1-53 to 1-60: | S |
| 1-61: | T |
| 1-62 to 1-64: | S |
| 1-65 to 1-67: | T |
| 1-68 to 1-75: | S. |

(1-1)

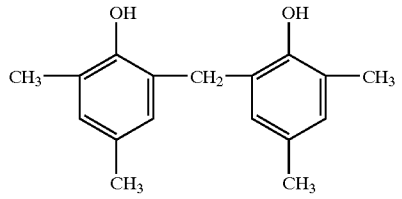

(1-2)

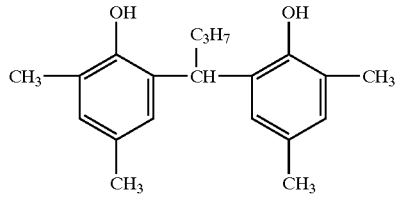

(1-3)

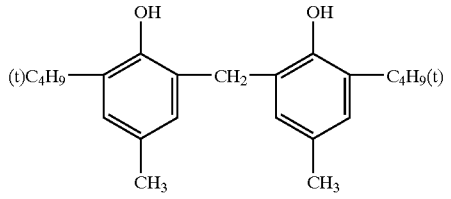

(1-4)

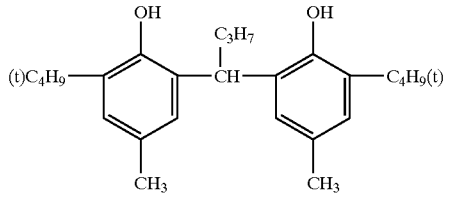

(1-5)

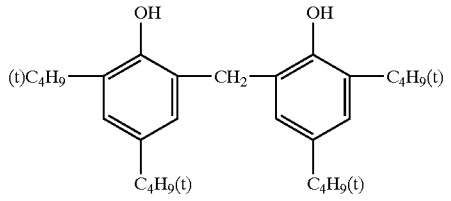

(1-6)

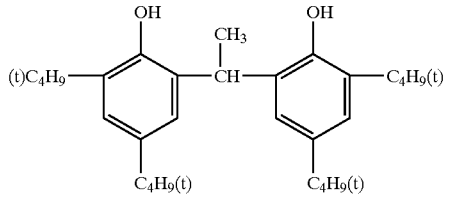

-continued
(1-7)
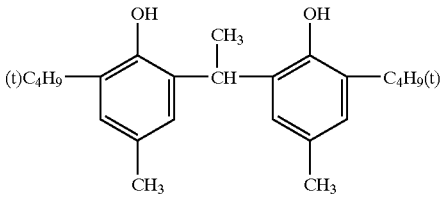
(1-8)
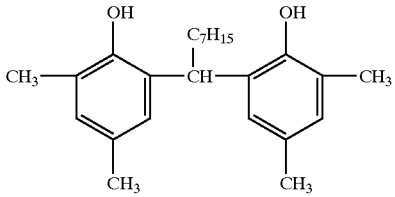
(1-9)
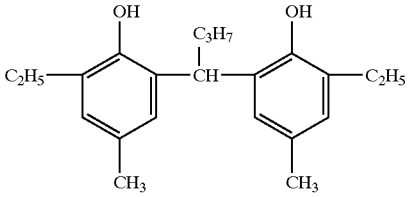
(1-10)
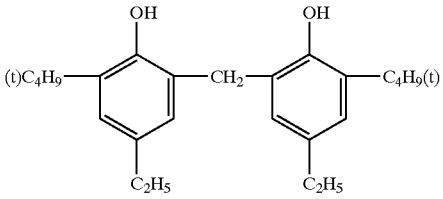
(1-11)
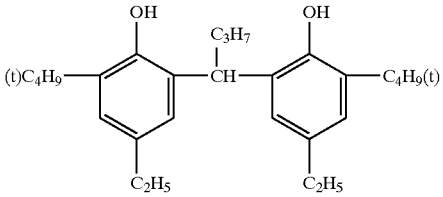
(1-12)
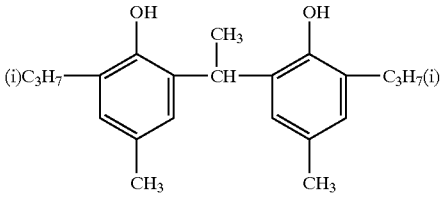
(1-13)
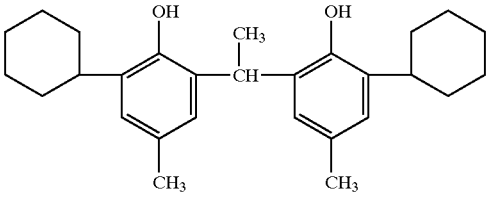
-continued
(1-14)
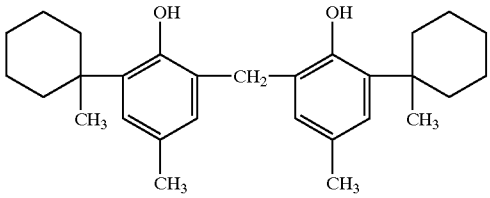
(1-15)
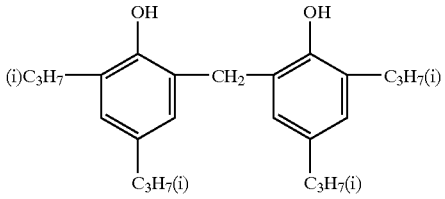
(1-16)
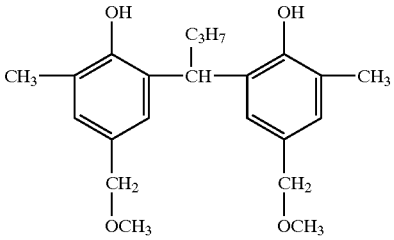
(1-17)
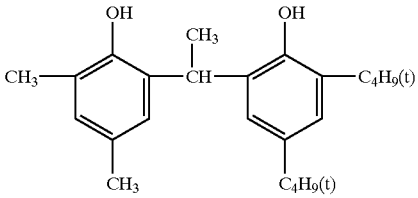
(1-18)
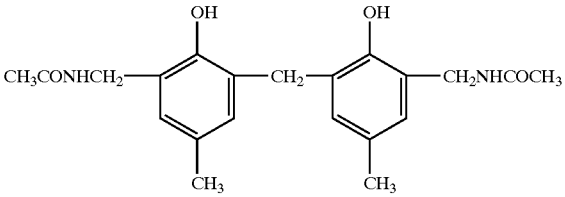
(1-19)
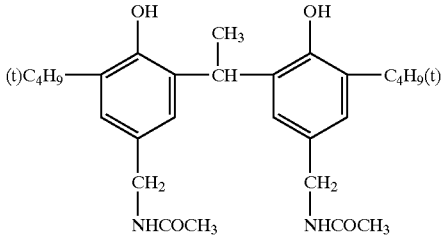
(1-20)
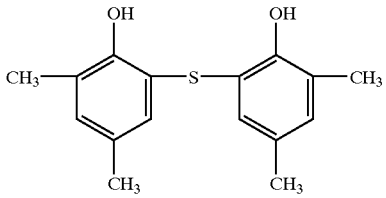

-continued
(1-21)
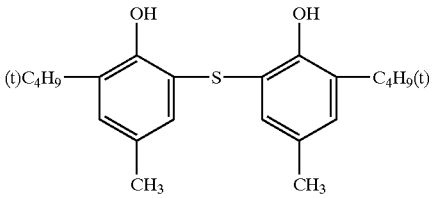
(1-22)
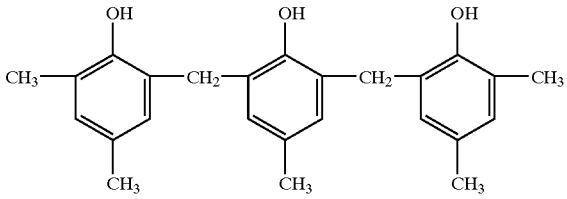
(1-23)
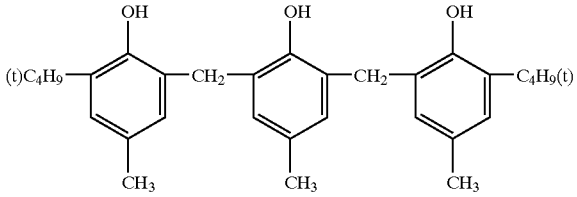
(1-24)
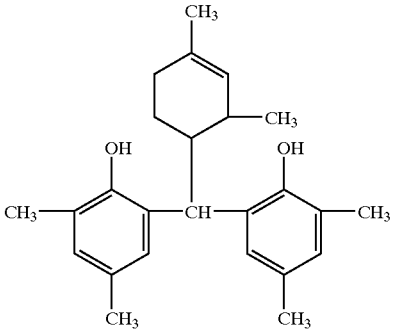
(1-25)
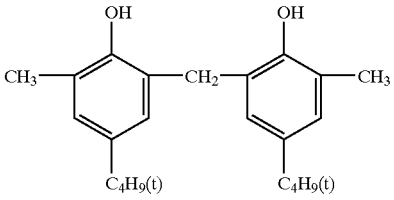
(1-26)
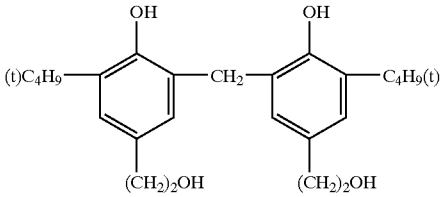
(1-27)
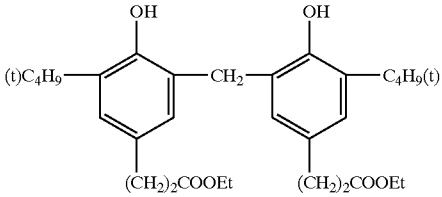
-continued
(1-28)
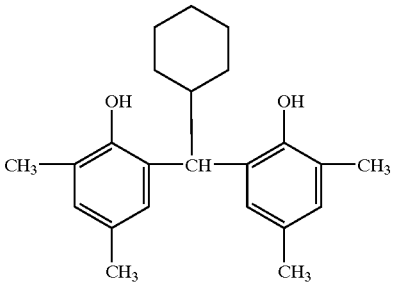
(1-29)
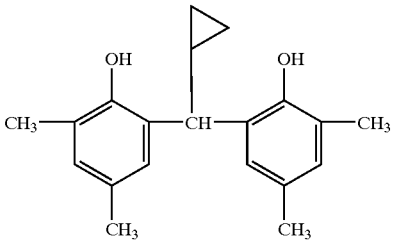
(1-30)
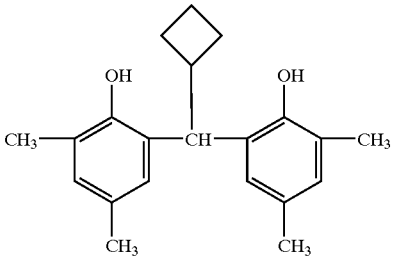
(1-31)
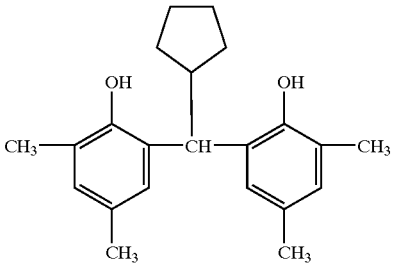
(1-32)
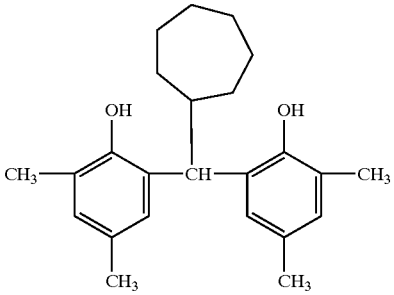
(1-33)
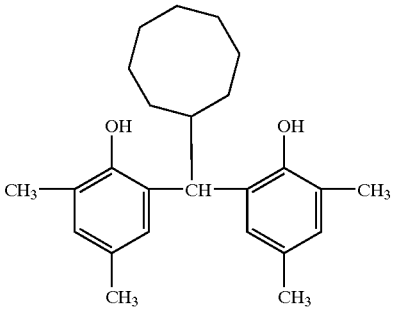

-continued
(1-34)
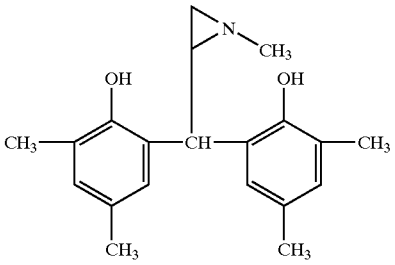
(1-35)
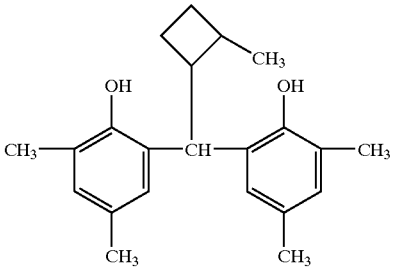
(1-36)
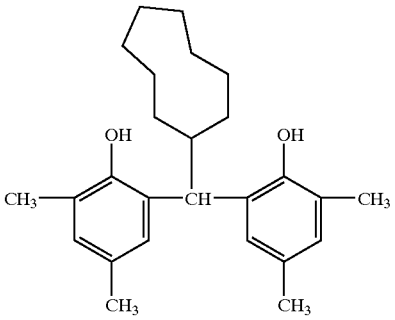
(1-37)
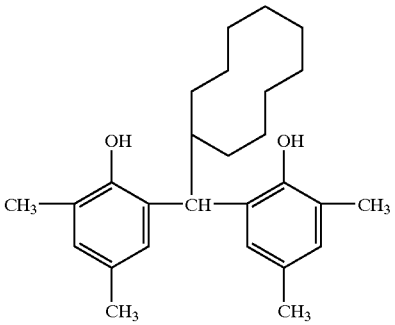
(1-38)
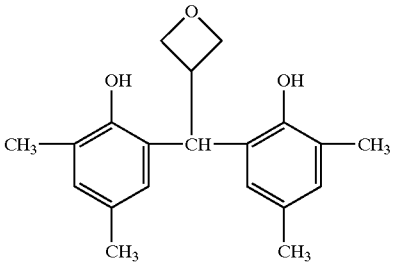
-continued
(1-39)
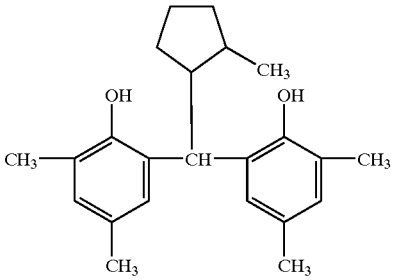
(1-40)
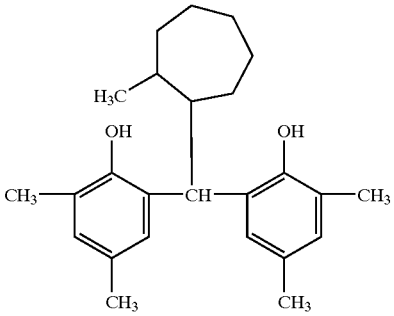
(1-41)
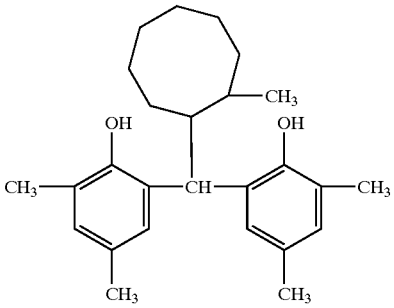
(1-42)
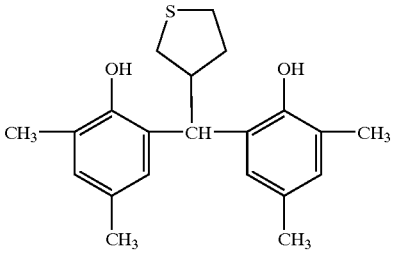
(1-43)
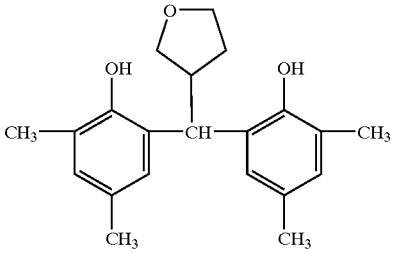

-continued
(1-44)
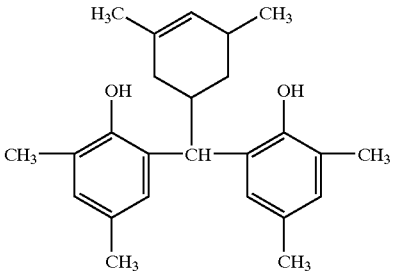
(1-45)
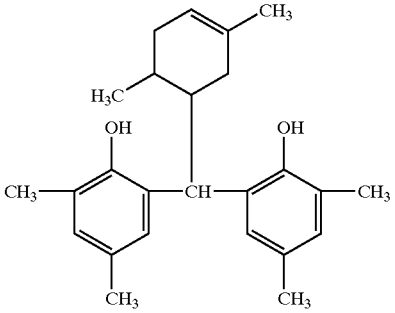
(1-46)
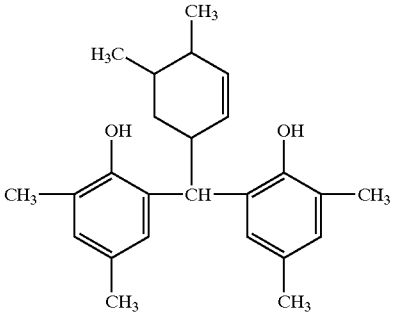
(1-47)
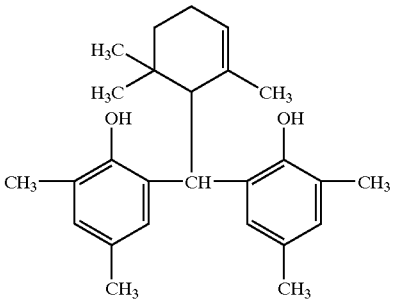
(1-48)
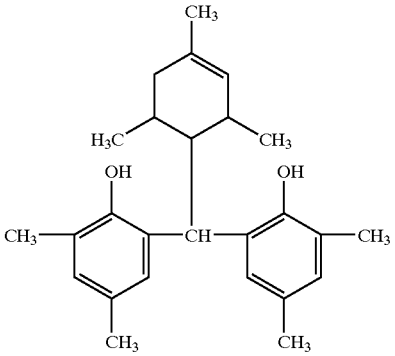
-continued
(1-49)
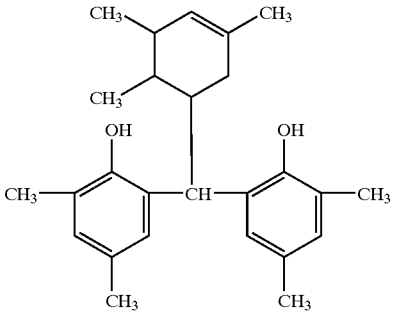
(1-50)
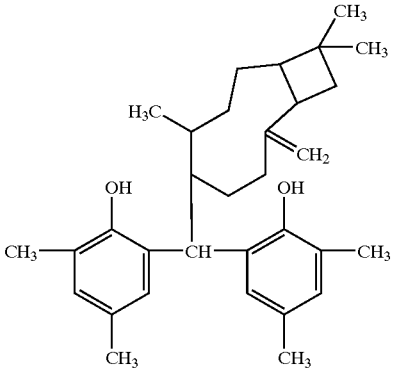
(1-51)
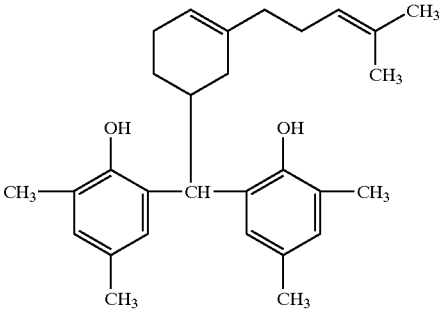
(1-52)
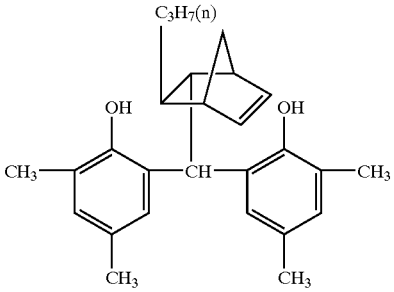
(1-53)
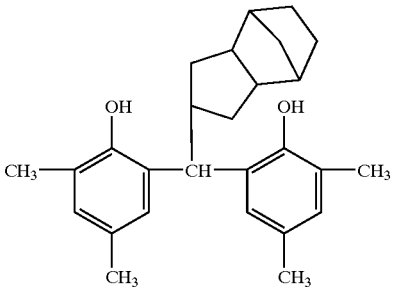

-continued
(1-54)
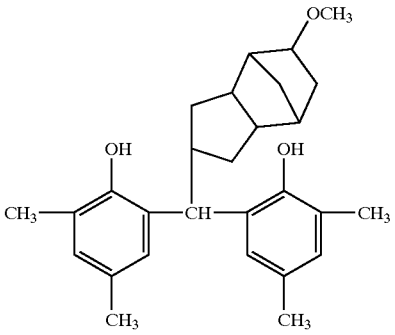
(1-55)
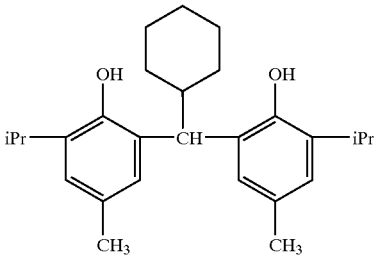
(1-56)
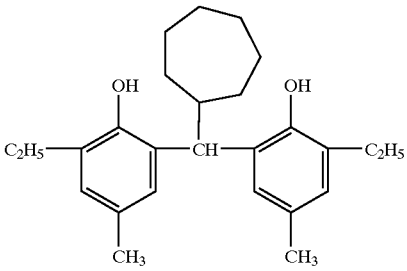
(1-57)
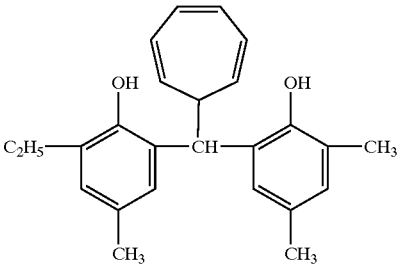
(1-58)
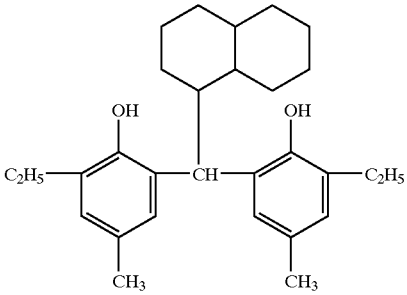
-continued
(1-59)
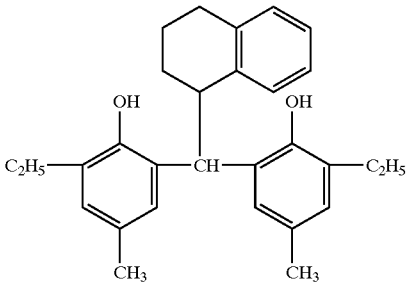
(1-60)
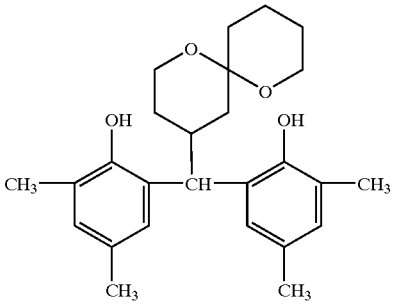
(1-61)
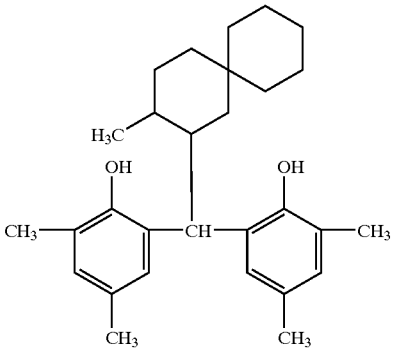
(1-62)
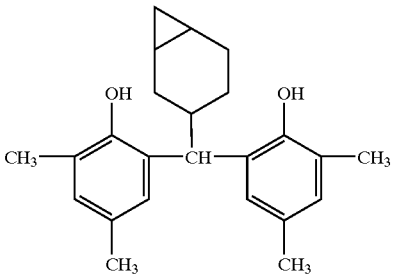
(1-63)
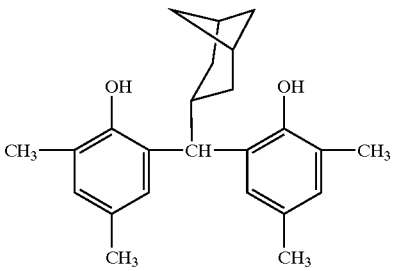

-continued
(1-64)
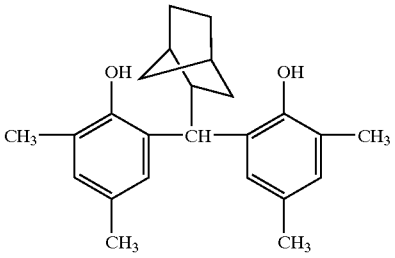
(1-65)
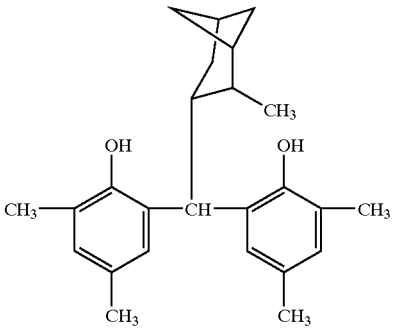
(1-66)
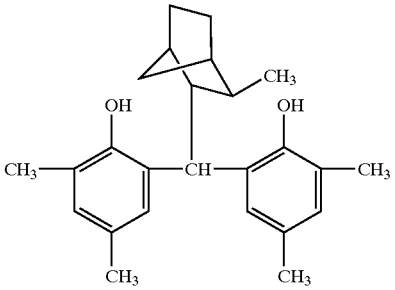
(1-67)
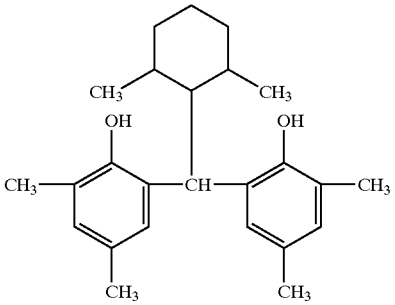
(1-68)
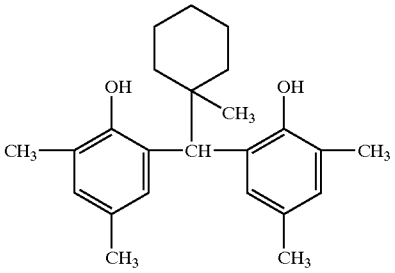
-continued
(1-69)
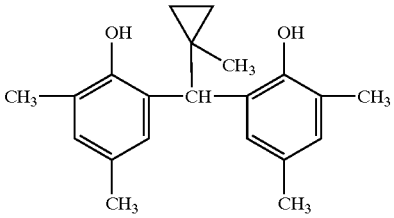
(1-70)
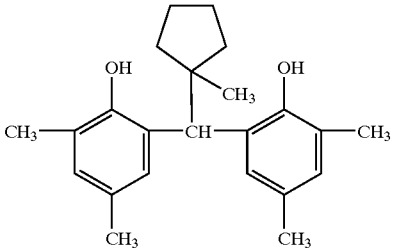
(1-71)
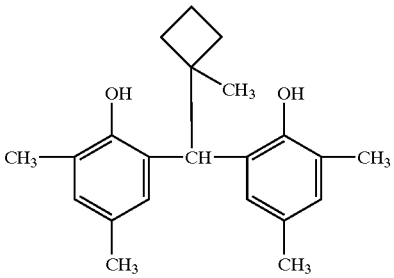
(1-72)
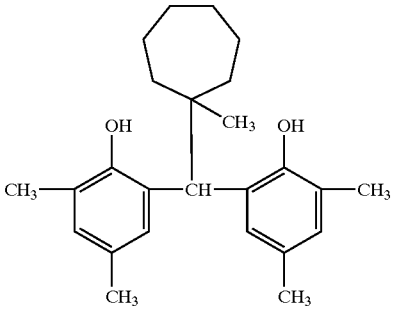
(1-73)
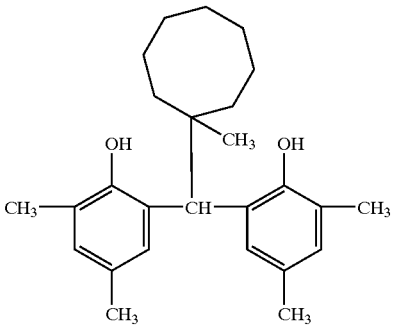

-continued (1-74)

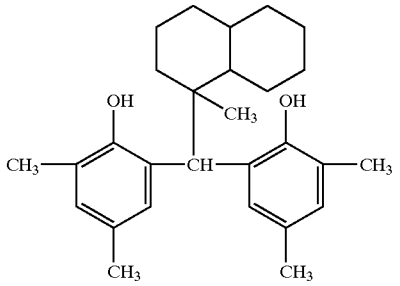

(1-75)

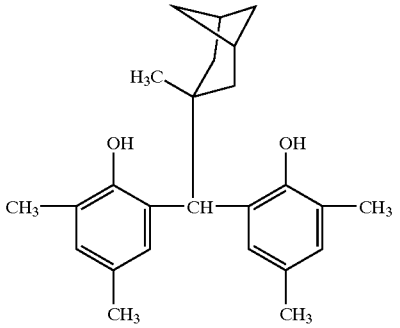

The compounds represented by Formulas (S), (T), and (A) of the present invention can easily be synthesized, employing conventional methods known in the art. For example, a preferable synthetic scheme of the compounds represented by Formula (S) will be illustrated below.

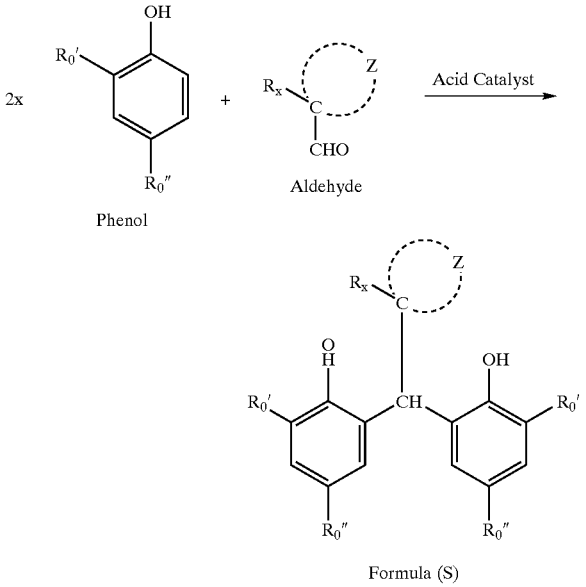

Namely, two equivalents of phenol and one equivalent of aldehyde are mixed in the absence of a solvent or are dissolved in suitable organic solvents and dispersed. Subsequently, acid in a catalytic amount is added, and the resulting mixture undergoes reaction preferably at −20 to 120° C. for 0.5 to 60.0 hours, whereby it is possible to prepare a target compound represented by Formula (S) at the desired yield. Compounds represented by Formulas (T) or (A) are synthesized in the same manner as above.

Said organic solvents are preferably hydrocarbon based organic solvents, and specifically include benzene, toluene, xylene, dichloromethane, and chloroform. Of these, toluene is preferred. However, from the viewpoint of achieving the desired yield, it is most preferable that said reaction is performed in the absence of solvents. Employed as acid catalysts may be all inorganic acids and organic acids. Of these, concentrated hydrochloric acid, p-toluenesulfonic acid and phosphoric acid are preferably employed. The catalyst is preferably employed in an amount of 0.001 to 1.500 equivalents with respect to the corresponding aldehyde. The reaction temperature is preferably near room temperature (15 to 25° C.) and the reaction time is preferably from 3 to 20 hours.

In the present invention, it is possible to employ compounds described below as a silver ion reducing agent; namely, polyphenol compounds such as 2,2'-dihyroxy-1,1'-binaphthyl and 6,6'-dibromo-2,2,2,2'-dihydroxy-1,1-binaphthyl described in U.S. Pat. Nos. 3,589,903 and 4,021,249, British Patent No. 1,486,148, Japanese Patent Publication Open to Public Inspection Nos. 51-51933, 50-36110, 50-116023, and 52-84727, and Japanese Patent Publication No. 51-35727; bisnaphthols described in U.S. Pat. No. 3,672,904; and sulfonamidophenols or sulfonamidonaphthols such as 4-benzenesulfonamidophenol, 2-benzenesulfonamidophenol, 2,6-dichloro-4-benzenesulfonamidophenol, and 4-benxenesulfonamidonaphthol described in U.S. Pat. No. 3,801,321.

The employed amount of the reducing agents represented by the aforesaid Formulas (S), (T), and (A) is preferably from $1\times10^{-2}$ to 10 mol per mol of silver, and is more preferably from $1\times10^{-2}$ to 1.5 mol.

The amount of reducing agents, employed in the photothermographic dry imaging material of the present invention, varies depending on the types of organic silver salts as well as on the reducing agents and other additives. However, said amount is generally from 0.05 to 10.00 mol per mol of organic silver salts, and is preferably from 0.1 to 3.0 mol. In said range, two or more types of said reducing agents may be employed in combination. In the present invention, it is occasionally preferable that just prior to coating, said reducing agents are added to a light-sensitive emulsion comprised of light-sensitive silver halide, organic silver salt grains, and solvents so as to minimize the vitiation of photographic properties during the period of its standing.

The light-sensitive silver halide of the present invention may undergo chemical sensitization. For instance, it is possible to create chemical sensitization centers (being chemical sensitization nuclei) utilizing compounds which release chalcogen such as sulfur as well as noble metal compounds which release noble metals ions, such as gold ions, while employing methods described in, for example, Japanese Patent Application Nos. 2000-057004 and 2000-061942. It is preferable that said silver halide is chemically sensitized employing organic sensitizers containing chalcogen atoms, as described below.

It is preferable that said organic sensitizers, comprising chalcogen atoms, have a group capable of being adsorbed onto silver halide grains and unstable chalcogen atom positions.

Employed as said organic sensitizers may be those having various structures, as disclosed in Japanese Patent Publication Open to Public Inspection Nos. 60-150046, 4-109240, and 11-218874. Of these, said organic sensitizer is preferably at least one of compounds having a structure in which said chalcogen atom bonds to a carbon atom, or to a phosphorus atom, via a double bond.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. Said chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. Said sensitization conditions are that the pAg is preferably from 6 to 11, but is more preferably from 7 to 10, and the pH is preferably from 4 to 10, but is more preferably from 5 to 8. Further, said sensitization is preferably carried out at a temperature of lass than or equal to 30° C.

Accordingly, in the silver salt photothermographic dry imaging material of the present invention, it is preferable to employ a light-sensitive emulsion prepared in such a manner that light-sensitive silver halide undergoes chemical sensitization at a temperatureofless than or equal to 30° C. in the presence of oxidizing agents capable of oxidizing silver nuclei on said grains; and that the resultant silver halide is mixed with aliphatic carboxylic acid silver salts; and further that the resultant mixture is dispersed, followed by dehydration and drying.

Further, it is preferable that chemical sensitization, employing said organic sensitizers, be carried out in the presence of either spectral sensitizing dyes or compounds containing heteroatoms, which exhibit said adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher sensitivity as well as lower fogging. Though spectral sensitizing dyes will be described below, the compounds comprising heteroatoms, which exhibit adsorption onto silver halide grains, as described herein, refer to, as preferable examples, nitrogen containing heterocyclic compounds described in Japanese Patent Publication Open to Public Inspection No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of said rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzthiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

Said heterocyclic ring may have substituents other than a hydroxyl group. As substituents, said heterocyclic ring may have, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of these heterocyclic compounds varies widely depending on the size and composition of silver halide grains, and other conditions. However, said amount is in the range of about $10^{-6}$ to 1 mol per mol of silver halide, and is preferably in the range of $10^{-4}$ to $10^{-1}$ mol.

The light-sensitive silver halide of the present invention may undergo noble metal sensitization utilizing compounds which release noble metal ions such as gold ions. For example, employed as gold sensitizers may be chloroaurates and organic gold compounds.

Further, other than said sensitization methods, it is possible to employ a reduction sensitization method. Employed as specific compounds for said reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

Silver halide which undergoes said chemical sensitization, according to the present invention, includes one which has been formed in the presence of organic silver salts, another which has been formed in the absence of organic silver salts, or still another which has been formed by mixing those above.

It is preferable that light-sensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in Japanese Patent Publication Open to Public Inspection Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in Japanese Patent Publication Open to Public Inspection Nos. 9-34078, 9-54409, and 9-80679.

Useful cyanine dyes include cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to said basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a maronitryl nucleus, and a pyrazolone nucleus.

In the present invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

Specifically preferred as said infrared spectral sensitizing dyes are long chain polymethine dyes which are characterized in that a sulfinyl group is substituted onto the benzene ring of a benzazole ring.

It is possible to easily synthesize said infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

Said infrared sensitizing dyes may be added at any time after preparing the silver halide. For example, said dyes may be added to solvents, or said dyes, in a so-called solid dispersion state in which said dyes are dispersed into minute particles, may be added to a light-sensitive emulsion comprising silver halide grains or silver halide grains/aliphatic carboxylic acid silver salts. Further, in the same manner as said heteroatoms containing compounds which exhibit adsorption onto silver halide grains, said dyes are adsorbed onto silver halide grains prior to chemical sensitization, and subsequently, undergo chemical sensitization, whereby it is possible to minimize the dispersion of chemical sensitization center nuclei so at to enhance sensitivity, as well as to decrease fogging.

In the present invention, said spectral sensitizing dyes may be employed individually or in combination. Combinations of sensitizing dyes are frequently employed when specifically aiming for supersensitization.

An emulsion comprising light-sensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby said silver halide grains may be supersenstized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and Japanese Patent Publication Open to Public Inspection Nos. 59-19032, 59-192242, and 5-431432. Preferred as supersensitizers are hetero-aromatic mercapto compounds or mercapto derivatives.

Ar—SM wherein M represents a hydrogen atom or an alkali metal atom, and Ar represents an aromatic ring or a condensed aromatic ring having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthoxazole, benzserenazole, benztellurazole, imidazole, oxazole, pyrazole, triazole, triazine, pyrimidine, pyridazine, pyrazine, pyridine, purine, quinoline, or quinazoline. However, other hetero-aromatic rings are no excluded.

Incidentally, mercapto derivatives, when incorporated in the dispersion of aliphatic carboxylic acid silver salts and/or a silver halide grain emulsion, are also included which substantially prepare said mercapto compounds. Specifically, listed as preferred examples are the mercapto derivatives described below.

Ar—S—S-Ar wherein Ar is the same as the mercapto compounds defined above.

Said hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than said supersensitizers, employed as supersensitizers may be compounds represented by Formula [5], shown below, which is disclosed in Japanese Patent Application No. 2000-070296 and large ring compounds.

Formula [5]

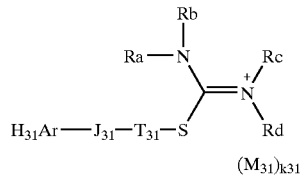

wherein $H_{31}Ar$ represents either an aromatic hydrocarbon group or an aromatic heterocyclic ring group; $T_{31}$ represents a divalent linking group comprised of an aliphatic hydrocarbon group or a linking group; $J_{31}$ represents a divalent linking group containing at least one of an oxygen atom, a sulfur atom, or a nitrogen atom or a linking group; Ra, Rb, Rc, and Rd each represents a hydrogen atom, an acyl group, an aliphatic hydrocarbon group, an aryl group, or a heterocyclic ring group, or Ra and Rb, Rc and Rd, Ra and Rc, or Rb and Rc cam be joined together to form a nitrogen-containing heterocyclic ring group; $M_{31}$ represents an ion necessary to offset the charge in the molecule; and $k_{31}$represents an ion necessary to offset the charge in the molecule.

In Formula [5], the divalent linking group represented by $T_{31}$, comprised of an aliphatic hydrocarbon group, includes a straight chain, branched or cyclic alkylene group (having preferably from 1 to 20 carbon atoms, more preferably from 1 to 16 carbon atoms, and further more preferably from 1 to 12 carbon atoms), an alkenyl group (having preferably from 2 to 20 carbon atoms, more preferably from 2 to 16 carbon atoms, and further more preferably from 2 to 12 carbon atoms), an alkynyl group (having preferably from 2 to 20 carbon atoms, more preferably from 2 to 16 carbon atoms, and further more preferably from 2 to 12 carbon atoms), which may have a substituent. Said substituent includes, for example, as an aliphatic hydrocarbon group, a straight chain, branched or cyclic alkyl group (having preferably from 1 to 20 carbon atoms, more preferably from 1 to 16 carbon atoms, and further more preferably from 1 to 12 carbon atoms), an alkenyl group (having preferably from 2 to 20 carbon atoms, more preferably from 2 to 16 carbon atoms, and further more preferably from 2 to 12 carbon atoms), an alkynyl group (having preferably from 2 to 20 carbon atoms, more preferably from 2 to 16 carbon atoms, and further more preferably from 2 to 12 carbon atoms); as an aryl group, a single ring or a fused ring aryl group (for example, phenyl and naphthyl are listed, and of these, phenyl is preferred); and as a heterocyclic group, a 3- to 10-membered saturated and unsaturated heterocyclic group (for example, 2-thiszolyl, 1-piperadinyl, 2-pyridyl, 3-pyridyl, 2-furyl, 2-thienyl, 2-benzimidazolyl, and carbazolyl). The heterocyclic rings in these groups may be a single ring or may form a fused ring with other rings. These groups may have a substituent at an optional position. Listed as said substituents are, for example, an alkyl group (including a cycloalkyl group, and aralkyl group, and having preferably from 1 to 20 carbon atoms, more preferably from 1 to 12 carbon atoms, and further more preferably from 1 to 8 carbon atoms, and listed as, for example, a methyl group, an ethyl group, an n-propyl group, an isopropyl group, an n-butyl group, a tert-butyl group, an n-heptyl group, an n-octyl group, an n-decyl group, an n-undecyl group, an n-hexadecyl group, a cyclopropyl group, a cyclopentyl group, a cyclohexyl group, a benzyl group, and a phenethyl group), an alkenyl group (having preferably from 2 to 20 carbon atoms, more preferably from 2 to 12 carbon atoms, and further more preferably from 2 to 8 carbon atoms, and including, for example, a vinyl group, an allyl group, a 2-butenyl group, and a 3-pentenyl group); an alkynyl group (having preferably from 2 to 20 carbon atoms, more preferably from 2 to 12 carbon atoms, and further more preferably from 2 to 8 carbon atoms, and including, for example, a propagyl group and a 3-pentynyl group); an aryl group (having preferably from 6 to 30 carbon atoms, more preferably from 6 to 20 carbon atoms, and further more preferably from 6 to 12 carbon atoms, and including, for example, a phenyl group, a p-tolyl group, an o-aminophenol group, and a naphthyl group); an amino group (having preferably from 0 to 20 carbon atoms, further more preferably from 0 to 10 carbon atoms, and most preferably from 0 to 6 carbon atoms, and including, for example, an amino group, a methylamino group, an ethylamino group, a dimethylamino group, a diethylamino group, a diphenylamino group, and a dibenzylamino group); an imino group (having preferably from 1 to 20 carbon atoms, more preferably from 1 to 18 carbon atoms, and furthermore preferably from 1 to 12 carbon atoms, and including, for example, a methylamino group, an ethylimino group, a propylimino group, and a phenylimono group); an alkoxy group (having preferably from 1 to 20 carbon atoms, more preferably from 1 to 12 carbon atoms, and further more preferably from 1 to 8 carbon atoms, and including, for example, a methoxy group, an ethoxy group, and a butoxy group); an aryloxy group (having preferably from 6 to 20 carbon atoms, more preferably from 6 to 16 carbon atoms, and furthermore preferably from 6 to 112 carbon atoms, and including, for example, a phenyloxy group and a naphthyloxy group); an acyl group (having preferably from 1 to 20 carbon atoms, more preferably from 1 to 16 carbon atoms, and furthermore preferably from 1 to 12 carbon atoms, and including, for example, acetyl group, a benzoyl group, a formyl group, and a pivaloyl group); an alkoxycarbonyl group (having preferably from 2 to 20 carbon atoms, more preferably from 2 to 16 carbon atoms, and further more preferably from 2 to 12 carbon atoms, and including, for example, a methoxycarbonyl group and an ethoxycarbonyl group); an aryloxycarbonyl group (having preferably from 7 to 20 carbon atoms, more preferably from 7 to 16 carbon atoms, and furthermore preferably from 7 to 10 carbon atoms, and including, for example, phenyloxycarbonyl group); an acyloxy group (having preferably from 1 to 20 carbon atoms, more preferably from 1 to 16 carbon atoms, and furthermore preferably from 1 to 10 carbon atoms, and including, for example, an acetoxy group and a benzoyloxy group); an acylamino group (having preferably from 1 to 20 carbon atoms, more preferably from 1 to 16 carbon atoms, and further more preferably from 1 to 10 carbon atoms, and including, for example, an acetylamino group and a benzoylamino group); an alkoxycarbonyl group (having preferably from 2 to 20 carbon atoms, more preferably from 2 to 16 carbon atoms, and further more preferably from 2 to 12 carbon atoms, and including, for example, a methoxycarbonylamino group); an aryloxycarbonylamino group (having preferably from 7 to 20 carbon atoms, more preferably from 7 o 16 carbon atoms, and further more preferably from 7 to 12 carbon atoms, and including, for a phenyloxycarbonylamino group); a sulfonylamino group (having preferably from 1 to 20 carbon atoms, more preferably from 1 to 16 carbon atoms, and furthermore preferably from 1 to 12 carbon atoms, and including, for example, methanesulfonylamino group and a benzenesulfonylamino group); a sulfamoyl group (having preferably from 0 to 20 carbon atoms, more preferably from 0 to 16 carbon atoms, and further more preferably from 0 to 12 carbon atoms, and including, for example, a sulfamoyl group, a methylsulfamoyl group, a dimethylsulfamoyl group, and a phenylsulfamoyl group); a carbamoyl group (having preferably from 1 to 20 carbon atoms, more preferably from 1 to 16 carbon atoms, and further more preferably from 1 to 12 carbon atoms, and including, for example, a carbamoyl group, a methylcarbamoyl group, a diethylcarbamoyl group, and a phenylcarbamoyl group); an alkylthio group (having preferably from 1 to 20 carbon atoms, more preferably from 1 to 16 carbon atoms, and further more preferably from 1 to 12 carbon atoms, and including, for example, a methylthio group and an ethylthio group); an arylthio group (having preferably from 6 to 20 carbon atoms, more preferably from 6 to 16 carbon atoms, and further more preferably from 6 to 12 carbon atoms, and including, for example, a phenylthio group); a sulfonyl group (having preferably from 1 to 20 carbon atoms, more preferably from 1 to 16 carbon atoms, and further more preferably from 1 to 12 carbon atoms, and including, for example, a methanesulfonyl group and a tocyl group); a sulfinyl group (having preferably from 1 to 20 carbon atoms, more preferably from 1 to 16 carbon atoms, and further more preferably from 1 to 12 carbon atoms, and including, for example, a methanesulfonyl group, a benzenesulfonyl group); an ureido group (having preferably from 1 to 20 carbon atoms, more preferably from 1 to 16 carbon atoms, and most preferably from 1 to 12 carbon atoms, and including, for example, a ureido group, a methylureido, and a phenylureido group.); an phosphoric acid amido group (having preferably from 1 to 20 carbon atoms, more preferably from 1 to 16 carbon atoms, and further more preferably from 1 to 12 carbon atoms, and including, for example, a diethyl phosphate amido group and a phenyl phosphoric acid amido group; a hydroxyl group; a mercapto group; a halogen atom (for example, a fluorine atom, a chlorine atom, a bromine atom, and an iodine atom); a cyano group; a sulfo group; a sulfino group; a carboxyl group; a phosphono group; a nitro group; a hydroxamic acid group; a hydrazino group; a heterocyclic ring group (for example, an imidazolyl group, a benzimidazolyl group, a thiazolyl group, a benzthiazolyl group, a carbazolyl group, a pyridyl group, a furyl group, a pyperidyl group, and a morpholine group).

Of said groups, groups such as a hydroxyl group, a mercapto group, a sulfo group, a sulfino group, a carboxyl group, a phosphono group, and a phosphino group, which can form a salt, may be in the form of salts. Said substituents may be substituted. Further, when there are at least two substituents, they may be the same or different. Preferred as substituents are an alkyl group, an aralkyl group, an alkoxy group, an aryl group, an alkylthio group, an acyl group, an acylamino group, an imino group, a sulfamoyl group, a sulfonyl group, a sulfamoylamino group, a ureido group, an amino group, a halogen atom, a nitro group, a heterocyclic group, an alkoxycarbonyl group, a hydroxyl group, a sulfo group, a carbamoyl group, or a carboxyl group. More preferred are an alkyl group, an alkoxy group, an aryl group, an alkylthio group, an acyl group, an acylamino group, an imino group, a sulfonylamino group, a ureido group, an amino group, a halogen atom, a nitro group, a heterocyclic group, an alkoxycarbonyl group, a hydroxyl group, a sulfo group, a carbamoyl group, or a carboxyl group. Further more preferred are an alkyl group, an alkoxy group, an aryl group, an alkylthio group, an acylamino group, an imino group, a ureido group, an amino group, a heterocyclic group, an alkoxycarbonyl group, a hydroxyl group, a carbamoyl group, or a carboxyl group. An amidino group includes those having a substituent. Listed as said substituents are, for example, an alkyl group (being either a methyl, ethyl, a pyridylmethyl, benzyl, phenethyl, carboxybenzyl, or aminophenylmethyl group), an aryl group (being either a phenyl, p-tolyl, naphthyl, o-aminophenyl, or o-methoxyphenyl group), and a heterocyclic group (being either a 2-thiazolyl, 2-pyridyl, 3-pyridyl, 2-furyl, 3-furyl, 2-thieno, 2-imidazolyl, benzothiazole, or a carbazolyl group).

Listed as divalent linking groups containing at least one of an oxygen atom, a sulfur atom, or a nitrogen atom, are, for example, those described below. Further, those may be employed in combination.

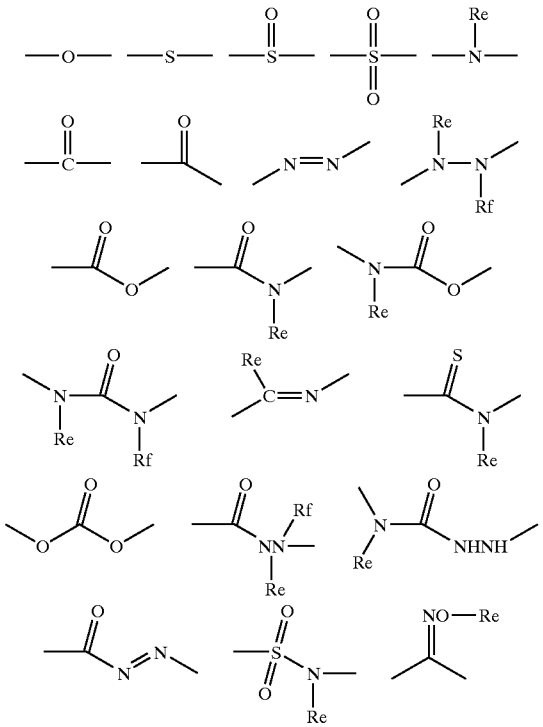

Herein, Re and Rf each represents the same as those defined for the aforesaid Ra through Rd.

The aromatic hydrocarbon group represented by $H_{31}Ar$ is preferably a group having from 6 to 30 carbon atoms, and is more preferably a single ring or fused ring aryl group having from 6 to 20 carbon atoms. For example, a phenyl group and a naphthyl group are listed, and among them, the phenyl group is particularly preferred. The aromatic heterocyclic group represented by $H_{31}Ar$ is a 5- to 10-membered unsaturated heterocyclic ring having at least one of N, O, or S. The heterocyclic ring in said group may be either a single ring or a fused ring. Preferred as heterocyclic rings in such heterocyclic groups are 5- or 6-membered aromatic heterocyclic rings and their benzo-fused rings. Of these, more preferred are 5- or 6-membered aromatic heterocyclic or 5 or 6-membered aromatic heterocyclic rings containing a nitrogen atom and benzo-fused rings thereof. Of these, further more preferred are 5- or 6-membered aromatic heterocyclic rings containing one or two nitrogen atoms and benzo-fused rings thereof.

Listed as specific examples of heterocyclic groups are those derived from, for example, thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, benzothiazoline, benzotriazole, tetraazaindene, and carbazole, of these, preferred as heterocyclic groups are groups comprised of imidazole, pyrazole, pyridine, pyrazine, indole, indazole, thiadiazole, oxadiazole, quinoline, phenazine, tetrazole, thiazole, oxazole, benzimidazole, benzoxazole, benzothiazole, benzothiazoline, benzotriazole, tetraazaindene, and carbazole. Of these, further more preferred are groups derived from imidazole, pyridine, pyrazine, quinoline, phenazine, tetrazole, thiazole, benzoxazole, benzimidazole, benzothiazole, benzothiazoline, benzotriazole, and carbazole.

Aromatic hydrocarbon groups as well as aromatic heterocyclic groups, represented by $H_{31}Ar$, may have a substituent. Listed as said substituents may be, for example, the same groups as listed as the substituents for $T_{31}$ and the preferred range is also the same. These substituents may be substituted. Further, when there are at least two substituents, they may be the same or different. The groups represented by $H_{31}Ar$ are preferably aromatic heterocyclic groups.

Listed as aliphatic hydrocarbon groups, aryl groups, and heterocyclic groups, represented by Ra, Rb, Rc, and Rd, may be the same groups listed as examples of aromatic hydrocarbon-groups, aryl groups, and heterocyclic groups in aforesaid $T_{31}$, and the preferred range is also the same as above. Listed as acyl groups represented by Ra, Rb, Rc, and Rd are aliphatic or aromatic groups having from 1 to 12 carbon atoms. Specifically listed are an acetyl group, a benzoyl group, a formyl group, and a pivaloyl group. Listed as nitrogen-containing heterocyclic groups which are formed by combining Ra and Rb, Rc and Rd, Ra and Rc, or Rb and Rd are 3- to 10-membered unsaturated heterocyclic rings (for example, cyclic groups such as a piperidine ring, a piperazine ring, an acridine ring, a pyrrole ring, and a morpholine ring).

Listed as specific examples of acid anions, represented by $M_{31}$, which are ions necessary to offset the charge in the molecule are, for example, halogen ions (for example, chloride ions, bromide ions, and iodide ions), p-toluenesulfonate ions, perchlorate ions, boron tetrafluoride ions, sulfate ions, methyl sulfate ions, ethyl sulfate ions, methanesulfonate ions, and trifluoromethanesulfonate ions.

The supersensitizers according to the present invention are preferably employed in a light-sensitive layer comprising organic silver salts and silver halide grains in an amount of 0.001 to 1.000 mol per mol of silver, and more preferably in an amount of 0.01 to 0.50 mol.

The silver saving agents, employed in the present invention, refer to compounds which are capable of reducing the silver amount to obtain a definite silver image density. Various action mechanisms are considered to explain said silver saving functions. However, preferred are compounds which enhance the covering power of silver formed through development. The covering power of silver formed though development, as described herein, refers to the optical density per unit amount of silver. Said silver saving agents may be incorporated in a light-sensitive layer or a light-insensitive layer, or in both such layers.

Listed as preferred examples of silver saving agents are hydrazine derivatives represented by Formula [H] described below, vinyl compounds represented by Formula (G) described below, and quaternary onium compounds represented by Formula (P) described below.

Formula [H]

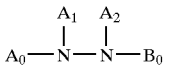

Formula (G)

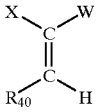

Formula (P)

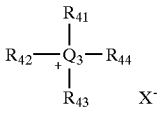

In Formula [H], $A_0$ represents an aliphatic group, an aromatic group, a heterocyclic group, or a —$G_0$—$D_0$ group, each of which may have a substituent; $B_0$ represents a blocking group; and $A_1$ and $A_2$ each represents a hydrogen atom, or one represents a hydrogen atom and the other represents an acyl group, a sulfonyl group, or a oxalyl group. Herein, $G_0$ represents a —CO— group, a —COCO— group, a —CS— group, a —C(=N$G_1D_1$)— group, a —SO— group, a —$SO_2$— group, or a —P(O)($G_1D_1$)— group, wherein $G_1$ represents a simple bonding atom or a group such as an —O— group, a —S— group, or an —N($D_1$)— group, wherein $D_1$ represents an aliphatic group, an aromatic group, a heterocyclic group, or a hydrogen atom; when there is a plurality of $D_1$ in the molecule, those may be the same or different; and $D_0$ represents a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In Formula [H], the aliphatic group represented by $A_0$ is preferably a straight chain, branched, or cyclic alkyl group having from 1 to 30 carbon atoms and more preferably from 1 to 20 carbon atoms. Listed as said alkyl groups are, for example, a methyl group, an ethyl group, a t-butyl group, an octyl group, a cyclohexyl group, and a benzyl group. Said groups may be substituted with a suitable substituent (for example, an aryl group, an alkoxy group, an aryloxy group, an alkylthio group, an arylthio group, a sulfoxyl group, a sulfonamido group, a sulfamoyl group, an acylamino group, and a ureido group).

In Formula [H], the aromatic group represented by $A_0$ is preferably a single ring or fused ring aryl group. Listed as examples are a benzene ring or a naphthalene ring. Preferably listed as heterocyclic groups represented by $A_0$ are those containing at least one heteroatom selected from nitrogen, sulfur and oxygen atoms. Listed as examples are a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and —$G_0$—$D_0$ group may each have a substituent. Particularly preferred as $A_0$ are an aryl group and a —$G_0$—$D_0$— group.

Further, in Formula [H], $A_0$ preferably contains at least one of non-diffusive groups or silver halide adsorbing groups. Preferred as said non-diffusive groups are ballast groups which are commonly employed for immobilized photographic additives such as couplers. Listed as ballast groups are an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In Formula [H], listed as silver halide adsorption enhancing groups are thiourea, a thiourethane group, a mercapto group, a thioether group, a thione group, a heterocyclic group, a thioamido heterocyclic group, a mercapto heterocyclic group, or the adsorption group described in Japanese Patent Publication Open to Public Inspection No. 64-90439.

In Formula [H], $B_0$ represents a blocking group, and preferably represents —$G_0$—$D_0$ group, wherein $G_0$ represents a —CO— group, a —COCO— group, a —CS— group, a —C(=N$G_1D_1$)— group, an —SO— group, an —$SO_2$— group, or a —P(O)($G_1D_1$) group. Listed as preferred $G_0$ are a —CO— group and a —COCO— group. $G_1$ represents a simple bonding atom or group such as an —O— atom, an —S— atom or an —N($D_1$)— group, wherein $D_1$ represents an aliphatic group, an aromatic group, a heterocyclic group, or a hydrogen atom, and when there is a plurality of $D_1$ in a molecule, they may be the same or different. $D_0$ represents a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$ each represents a hydrogen atom, or when one represents a hydrogen atom, the other represents an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group).

Said compounds represented by Formula [H] can be easily synthesized employing methods known in the art. They can be synthesized based on, for example, U.S. Pat. Nos. 5,464,738 and 5,496,695.

Other than those, preferably usable hydrazine derivatives include Compounds H-1 through H-29 described in columns 11 through 20 of U.S. Pat. No. 5,545,505, and Compounds 1 through 12 in columns 9 through 11 of U.S. Pat. No. 5,464,738. Said hydrazine derivatives can be synthesized employing methods known in the art.

In Formula (G), X as well as $R_{40}$ are illustrated utilizing a cis form, while X and $R_{40}$ include a trans form. This is applied to the structure illustration of specific compounds.

In Formula (G), X represents an electron attractive group, while W represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

$R_{40}$ represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. X and W may be joined together to form a ring structure, while X and $R_{40}$ may also be joined together in the same manner. Listed as rings which are formed by X and W are, for example, pyrazolone, pyrazolidinone, cyclopentanedione, β-ketolactone, β-ketolactum.

Formula (G) will be described further. The electron attractive group represented by X refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyalyl group), a thioxyalyl group (such as an ethylthioxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a σp value of at least 0.30 are particularly preferred.

Alkyl groups represented by W include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as W are electron attractive groups having a positive σp value, and more preferred are those having a σp value of at least 0.30.

Of said substituents of $R_{40}$, preferably listed are a hydroxyl group, a mercapto group, an alkoxy group, an alkylthio group, a halogen atom, an organic or inorganic salt of a hydroxyl group or a mercapto group, and a heterocyclic group, and of these, more preferably listed are a hydroxyl group, and an organic or inorganic salt of a hydroxyl group or a mercapto group.

Further, of said substituents of X and W, preferred are those having an thioether bond in the substituent.

In Formula (P), $Q_2$ represents a nitrogen atom or a phosphorous atom; $R_{41}$, $R_{42}$, $R_{43}$, and $R_{44}$ each represent a hydrogen atom or a substituents; and $X^-$ represents an anion. Incidentally, $R_{41}$ through $R_{44}$ may join together to form a ring.

Listed as substituents represented by $R_{41}$ through $R_{44}$ are an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group), a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group.

Listed as rings which are formed by joining $R_{41}$ though $R_{44}$ are a piperidine ring, a morpholine ring, a piperazine ring, quinuclidine ring, a pyridine ring, a pyrrole ring, an imidazole ring, a triazole ring, and a tetrazole ring.

Groups represented by $R_{41}$ through $R_{44}$ may have a substituent such as a hydroxyl group, an alkoxy group, an aryloxy group, a carboxyl group, a sulfo group, an alkyl group, and an aryl group. $R_{41}$, $R_{42}$, $R_{43}$, and $R_{44}$ each is preferably a hydrogen atom or an alkyl group.

Listed as anions represented by $X^-$ are inorganic or organic anions such as a halogen ion, a sulfate ion, a nitrate ion, acetate ion, and a p-toluenesulfonate ion.

The aforesaid quaternary onium compounds can easily be synthesized employing methods known in the art. For instance, the aforesaid tetrazolium compounds can be synthesized based on the method described in Chemical Reviews Vol. 55. pages 335 through 483.

Further, listed as the most preferable silver saving agents of the present invention are compounds represented by the aforesaid Formula (X), which will be detailed below.

In Formula (X), $R_{1X}$ and $R_{2X}$ each represents a hydrogen atom or a substituent. Listed as examples of said substituents are an alkyl group having from 1 to 25 carbon atoms (such as a methyl group, an ethyl group, a propyl group, an isopropyl group, a tert-butyl group, a pentyl group, a hexyl group, and a cyclohexyl group), a halogenated alkyl group (a trifluoromethyl group and a perfluoroctyl group), a cycloalkyl group (such as a cyclohexyl group and a cyclopentyl group), an alkynyl group (such as a propargyl group), a glycidyl group, an acrylate group, a methacrylate group, an aryl group (such as a phenyl group), a heterocyclic group (such as a pyridyl group, a thiazolyl group, an oxazolyl group, an imidazolyl group, a furyl group, a pyrrolyl group, a pirazinyl group, a pyrimidinyl group, a pyridazinyl group, a selenazolyl group, a sliforanyl group, a piperidinyl group, a pierazolyl group, and a tetrazolyl group), a halogen atom (such as a chlorine atom, a bromine atom, an iodine atom, and a fluorine atom), an alkoxy group (such as a methoxy group, an ethoxy group, a propyloxy group, a pentyloxy group, a cyclopentyloxy group, a hexyloxy group, and a cyclohexyloxy group), an aryloxy group (such as a phenoxy group), an alkoxycarbonyl group (such as a methyloxycarbonyl group, and an ethyloxycarbonyl group, a butyloxycarbonyl group), an aryloxycarbonyl group (such as a phenyloxycarbonyl group), a sulfonamido group (such as a methanesulfonamido group, an ethanesulfonamido group, a butanesulfonamido group, a hexanesulfonamido group, a cyclohexanesulfonamido group, and a benzenesulfonamido group), a sulfamoyl group (such as an aminosulfonyl group, a methylaminosulfonyl group, a dimethylaminosulfonyl group, a butylaminosulfonyl group, a hexylaminosulfonyl group, a cyclohexylaminosulfonyl group, a phenylaminosulfonyl group, and a 2-pyridylaminosulfonyl group), a urethane group (such as a methylureido group, an ethylureido group, a pentylureido group, a cyclohexylureido group, a phenylureido group, and a 2-pyridylureido group), an acyl group (such as an acetyl group, a propionyl group, a butanoyl group, a hexanoyl group, a cyclohexanoyl group, a benzoyl group, and a pyridinoyl group), a carbamoyl group (an aminocarbonyl group, a methylaminocarbonyl group, a dimethylaminocarbonyl group, a propylaminocarbonyl group, a pentylaminocarbonyl group, a cyclohexylaminocarbonyl group, a phenylaminocarbonyl group, and a 2-pyridylaminocarbonyl group), an amido group (such as an acetamide group, a propionamido group, a butaneamido group, a hexaneamido group, and a benzamido group), a sulfonyl group (such as a methylsulfonyl group, an ethylsulfonyl group, a butylsulfonyl group, a cyclohexylsulfonyl group, a phenylsulfonyl group, and a 2-pyridylsulfonium group), an amino group (such as an amino group, an ethylamino group, a dimethylamino group, a butylamino group, a cyclopentylamino group, an anilino group, and a 2-pyridylamino group), a cyano group, a nitro group, a sulfo group, a carboxyl group, a hydroxyl group, and an oxamoyl group. Said groups may be substituted with any of said groups. $R_{1X}$ and $R_{2x}$ each is preferably a hydrogen atom and an alkyl group having from 1 to 3 carbon atoms. Among them, a hydrogen atom is particularly preferred.

$R_{3X}$ represents a hydrogen atom or a substituent. Listed as examples of said substituents may be the same as those described in aforesaid $R_{1X}$ and $R_{2X}$. Of these, preferred are a hydrogen atom and an alkyl group having from 1 to 3 carbon atoms. Of these, a hydrogen atom is particularly preferred.

$X_{1X}$ represents —S—, —O—, or —N($R_{3X}$)—. Of these, —N($R_{3X}$)— is preferred, and —NH— is particularly preferred. $n_x$ represents 2 or 3, and preferably 2. $m_x$ represents an integer of 1 through 3, preferably 1 or 2, and most preferably 1.

$X_{2x}$ represents a non-diffusive group, a silver halide adsorptive group, or a silyl group. Preferred as said non-diffusive groups are aryl groups which are substituted with an aliphatic group having at least 6 carbon atoms or an alkyl group having at least 3 carbon atoms. Through introduction of said non-diffusive groups, it is possible to enhance storage stability due to limiting the migration distance in a system during storage at room temperature, though it may vary depending on binders in the system as well as the employed amount of crosslinking agents. A method to evaluate non-diffusive properties is as follows. A binder is placed in a capillary tube with both ends open and subsequently undergoes crosslinking. Thereafter, a test compound comes into contact with one open end of the resultant capillary tube and is maintained at a specified temperature for a specified period. Subsequently, the migration amount is determined employing infrared spectroscopy, mass spectrometry, an isotope method, or an NMR method. In said test, it is possible to determine the magnitude of diffusion while varying time as well as temperature. It is possible to retard said diffusion by a factor of 100 to 100,000,000. However, when the diffusion is excessively retarded, the original function may be degraded. Therefore, it is desired to introduce a group which retards the diffusion rate by a factor of 10 to 1,000,000.

Listed as said adsorptive groups are an aromatic group, a group containing at least one of sulfur and nitrogen atoms, an alkylene oxide group, and a carboxyl group. Listed as preferable adsorptive groups are a mercapto group, a thioether group, a thioureido group, a nitrogen atom-containing primary, secondary, or tertiary amino group, and a heterocyclic group, such as a pyridine group, a quinoline group, an iso-quinoline group, an imidazole group, a pyrazole group, a triazole group, oxazole group, a thiazole group, an oxadiazole group, a thiadiazole group, and a tetrazole group. It is possible to evaluate said adsorptive groups while determining the adsorption amount onto silver halide grains. The adsorption amount is determined as follows. A test compound is added to a composition containing silver halide. After collecting silver halide employing filtration, the concentration of said test compound in the residual composition is determined, whereby it is possible to calculate the adsorption amount onto said silver halide grains. Said adsorption amount varies depending on the silver ion concentration of the silver halide composition, the shape of the silver halide grains, and the grain diameter. However, herein, it is preferable to determine the adsorption amount under conditions of the silver halide grain shape and the grain diameter, and electric potential, which is added to organic silver. A preferable example is as follows. Cubic, octahedral, or planar iodobromide silver, containing iodine of 0.1 to 10 mole percent, having an average grain diameter of 10 to 300 nm, is set aside at a pAg of 6 to 8 at 25±5° C. for 1 to 48 hours. Subsequently, the adsorption amount, employing said silver halide grains, is determined. Said adsorption amount may be determined employing silver bromide grains or silver chloride grains containing no iodine. When the resultant calculation shows that 3 to 100 percent of the surface area of silver halide grains is covered with the test compound, it is possible to evaluate said test compound is adsorptive. It is preferable that said adsorption is carried out employing a silver halide emulsion with no additives such as dyes, stabilizers, and antifoggants. However, said measurement may be carried out employing a silver halide emulsion with dyes, stabilizers and antifoggants, which is analogous to the practically employed emulsion.

Specifically listed as silyl groups are those substituted with a hydrogen atom, a hydroxyl group, an alkyl group, an aryl group, a halogen atom, an amino group, a siloxy group, an acyloxy group, an alkoxyl group, or an aryloxy group. Preferred are silyl groups substituted with an alkoxyl group having from 1 to 3 carbon atoms, and more preferred are a triethoxysilyl group and a trimethoxysilyl group.

$q_X$ represents an integer of 1 through 3, is preferably 1 or 2, and is more preferably 1.

$L_X$ represents a divalent to hexavalent linking group, and is preferably a divalent linking group. Specifically listed as linking groups are alkylene, arylene, heteroarylene, a heterocyclic group, a heteroatom (such as an oxygen, nitrogen, or sulfur atom), as well as groups formed by optionally combining these groups. Of these, an alkylene group, having from 2 to 4 carbon atoms, is preferred.

Specific examples of compounds represented by Formula (X) will now be illustrated. However, the present invention is not limited to these examples.

(1)-1

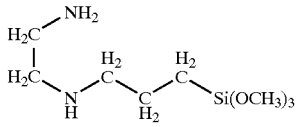

(1)-2

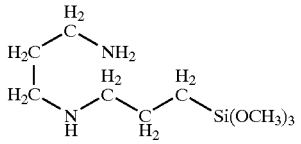

-continued
(1)-3
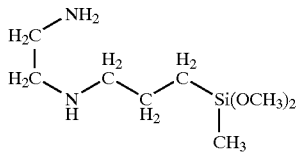
(1)-4
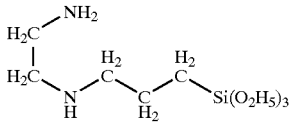
(1)-5
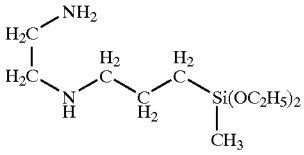
(1)-6
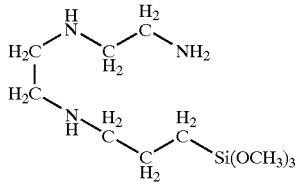
(1)-7
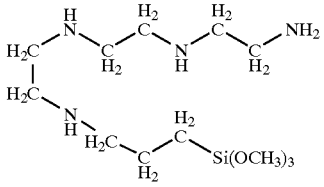
(1)-8
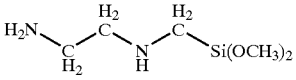
(1)-9
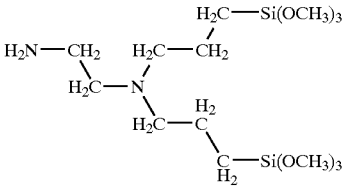
(1)-10
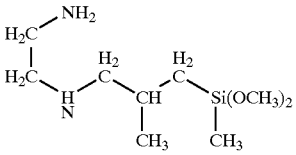
(1)-11
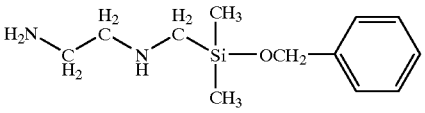
(1)-12
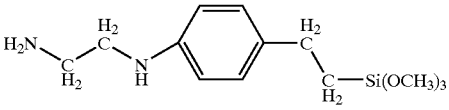
-continued
(1)-13
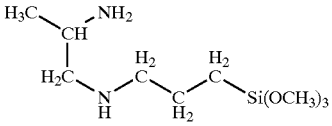
(1)-14
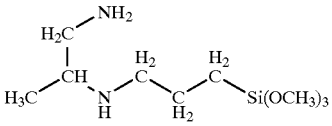
(1)-15
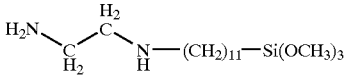
(1)-16
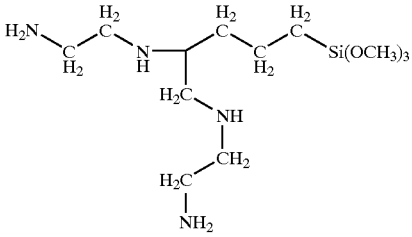
(1)-17
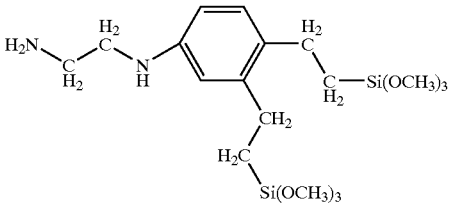
(1)-18
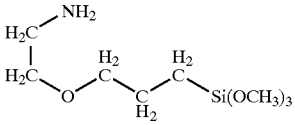
(1)-19
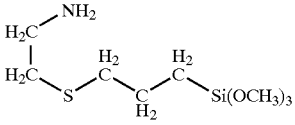
(1)-20
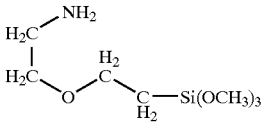
(1)-21
$NH_2CH_2CH_2NHCH_2CH_2OH$
(1)-22
$NH_2CH_2CH_2NHCH_2CH_2CH_2NHCH_2CH_2NH$
(1)-23
$NH_2CH_2CH_2NHCH_2CH_2NH_2$
(1)-24
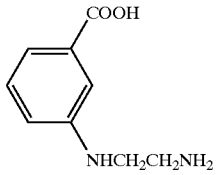
(1)-25
$NH_2CH_2CH_2NHCH_2CH_2COOH$ -continued (1)-26

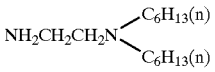

(1)-27

$NH_2(CH_2CH_2NH)_4CH_2CH_2NH_2$ (1)-28

$NH_2(CH_2CH_2NH)_3CH_2CH_2NH_2$ (1)-29

$NH_2CH_2CH_2NH(CH_2)_{11}CH_3$ (1)-30

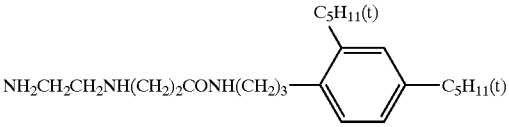

(1)-31

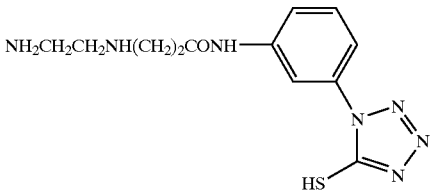

(1)-32

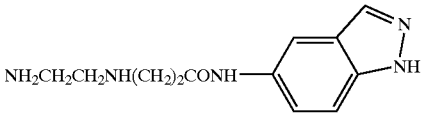

(1)-33

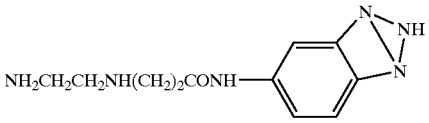

(1)-34

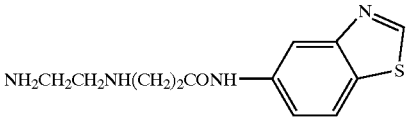

(1)-35

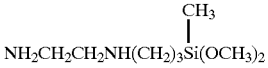

In the silver salt photothermographic dry imaging material of the present invention, one type of a silver saving agent may be individually incorporated or at least two types of the silver saving agents may be incorporated in combination. Further, said silver saving agent(s) are preferably incorporated in a light-sensitive layer, but may be incorporated in a light-insensitive layer adjacent to said light-sensitive layer. The added amount is commonly in the range of $10^{-9}$ to 1 mol per mol of the light-insensitive organic silver salts, and is preferably in the range of $10^{-4}$ to $5\times10^{-1}$ mol.

Said silver saving agents may be incorporated in a coating composition or liquid employing any method which results in the form of a solution, an emulsion dispersion or a solid fine particle dispersion, whereby they are incorporated in the material of the present invention. When added in the form of a solution, a method is listed in which said silver saving agents are dissolved in low boiling point organic solvents such as ethyl acetate, methyl ethyl ketone, toluene, methanol, and cyclohexanone. When added in the form of emulsion dispersion, a method is listed in which said silver saving agents are dissolved in a mixture consisting of oil such as dibutyl phthalate, tricresyl phosphate, glyceryl triacetate, and diethyl phthalate and auxiliary solvents such as ethyl acetate, methyl ethyl ketone, or cyclohexane, the resultant mixture is mechanically emulsify-dispersed and added to a coating composition. When added in the form of a solid fine particle dispersion, a method is listed in which the powder of the compound represented by Formula (X) is dispersed into suitable solvents employing a ball mill, a colloid mill, a vibration ball mill, a sand mill, a jet mill, a roller mill, or an ultrasonic wave, so as to form a solid dispersion, which is added to a coating composition. Further, in such a case, employed may be protective colloids (for example, polyvinyl alcohol) and anionic surface active agents (for example, sodium triisopropyl naphthalenesulfonate, a mixture of compounds in which the three positions substituted with an isopropyl group are different). Antiseptic agents (for example, a sodium salt of benzoisothiazolinone) may be incorporated in an aqueous dispersion. In the present invention, said silver saving agents are preferably incorporated in the coating composition in the form of said solution or said fine solid powder dispersion.

Suitable binders for the silver salt photothermographic material of the present invention are to be transparent or translucent and commonly colorless, and include natural polymers, synthetic resin polymers and copolymers, as well as media to form film. Said binders include, for example, gelatin, gum Arabic, casein, starch, poly(acrylic acid), poly (methacrylic acid), poly(vinyl chloride), poly(methacrylic acid), copoly(styrene-maleic anhydride), coply(styrene-acrylonitrile), coply(styrene-butadiene), poly(vinyl acetals) (for example, poly(vinyl formal) and poly(vinyl butyral), poly(esters), poly(urethanes), phenoxy resins, poly (vinylidene chloride), poly(epoxides), poly(carbonates), poly(vinyl acetate), cellulose esters, poly(amides). Said binders may be hydrophilic or hydrophobic.

Preferable binders for the light-sensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, said binders may be employed in combination of at least two types.

Said binders are employed in the range of a proportion in which said binders function effectively. Skilled persons in the art can easily determine the effective range. For example, preferred as the index for maintaining aliphatic carboxylic acid silver salts in a light-sensitive layer is the proportion range of binders to aliphatic carboxylic acid silver salts of 15:1 to 1:2 and most preferably of 8:1 to 1:1. Namely, the binder amount in the light-sensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

The present invention is characterized in that thermal transition point temperature after development at higher or equal to 100° C. is from 46 to 200° C. The thermal transition point temperature, as described in the present invention, refers to the VICAT softening point or the value shown by the ring and ball method, and also refers to the endothermic peak which is obtained by measuring the individually peeled light-sensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the light-sensitive layer. The inventors of the present invention conducted diligent investigations while paying special attention to said thermal transition point temperature. As a result, it was discovered that by adjusting said thermal transition point temperature to the range of 46 to 200° C., durability of the resultant coating layer increased and in addition, photographic characteristics such as sensitivity, maximum density and image Retention Properties were markedly improved. Based on said discovery, the present invention was achieved.

The glass transition temperature (Tg) is determined employing the method, described in Brandlap, et al., "Polymer Handbook", pages from III-139 through III-179, 1966 (published by Wily and Son Co.). The Tg of the binder comprised of copolymer resins is obtained based on the following formula.

Tg of the copolymer (in ° C.)$=v_1Tg_1+v_2Tg_2+\ldots+v_nTg_n$ wherein $v_1, v_2, \ldots v_n$ each represents the mass ratio of the monomer in the copolymer, and $Tg_1, Tg_2, \ldots Tg_n$ each represents Tg (in ° C.) of the homopolymer which is prepared employing each monomer in the copolymer. The accuracy of Tg, based on said formula calculation, is ±5° C.

In the silver salt photothermographic dry imaging material of the present invention, employed as binders, which are incorporated in the light-sensitive layer, on the support, comprising aliphatic carboxylic acid silver salts, light-sensitive silver halide grains and reducing agents, may be conventional polymers known in the art. Said polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Listed as homopolymers or copolymers which comprise said ethylenic unsaturated monomers as constitution units are alkyl acrylates, aryl acrylates, alkyl methacrylates, aryl methacrylates, alkyl cyanoacrylate, and aryl cyano acrylates, in which said alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorobenzyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-isoproxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chlorides.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metacrylonitrile, methylene malononitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by Formula (V) described below.

Formula (V)

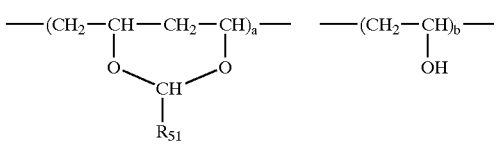

-continued $$-(CH_2-\underset{\underset{OR_{52}}{|}}{CH})_c-$$

wherein $R_{51}$ represents a substituted or unsubstituted alkyl group, and a substituted or unsubstituted aryl group, however, groups other than the aryl group are preferred; $R_{52}$ represents a substituted or unsubstituted alkyl group, a substituted or unsubstituted aryl group, —$COR_{53}$ or —$CONHR_{53}$, wherein $R_{53}$ represents the same as defined above for $R_{51}$.

Unsubstituted alkyl groups represented by $R_{51}$, $R_{52}$, and $R_{53}$ preferably have from 1 to 20 carbon atoms and more preferably have from 1 to 6 carbon atoms. Said alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. of these, particularly preferred is a methyl group or a propyl group.

Unsubstituted aryl groups preferably have from 6 to 20 carbon atoms and include, for example, a phenyl group and a naphthyl group. Listed as groups which can be substituted for said alkyl groups as well as said aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of said substituents are employed, they may be the same or different. The number of total carbons of the substituted alkyl group is preferably from 1 to 20, while the number of total carbons of the substituted aryl group is preferably from 6 to 20.

$R_{52}$ is preferably —$COR_{53}$ (wherein $R_{53}$ represents an alkyl group or an aryl group) and —$CONHR_{53}$ (wherein $R_{53}$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c" is in the range of 0 to 40 mol percent. The repeated units having each composition ratio of "a", "b", and "c" may be the same or different.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —$N(R_{54})_2$, —$N^+(R_{54})_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than said polar groups, it is preferable that the molecular terminal of the polyurethane molecule has at least one OH group and at least two OH groups in total. Said OH group crosslinks with polyisocyanate as a hardening agent so as to form a 3-dimensional net structure. Therefore, the more OH groups which are incorporated in the molecule, the more preferred. It is particularly preferable that said OH group is positioned at the terminal of the molecule since thereby the reactivity with said hardening agent is enhanced. Said polyurethane preferably has at least three OH groups at the terminal of the molecules, and more preferably has at least four OH groups. When polyurethane is employed, said polyurethane preferably has a glass transition temperature of 70 to 105° C., a breakage elongation of 100 to 2,000 percent, and a breakage stress of 0.5 to 100 M/mm$^2$.

Polymers represented by the aforesaid Formula (V) of the present invention can be synthesized employing common synthetic methods described in "Sakusan Binihru Jushi (Vinyl Acetate Resins)", edited by Ichiroh Sakurada (Kohbunshi Kagaku Kankoh Kai, 1962). Examples of representative synthetic methods will now be described. However, the present invention is not limited to these representative synthetic examples.

Synthetic Example 1

Synthesis of P-1

Charged into a reaction vessel were 20 g of polyvinyl alcohol, Gosenol GH18 (manufactured by Nihon Gosei Co., Ltd.) and 180 g of pure water, and the resulting mixture was dispersed in pure water so that 10 weight percent polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent hydrochloric acid, as an acid catalyst, was added to said solution. The resultant solution was designated as Dripping Solution A. Subsequently, 11.5 g of a mixture consisting of butylaldehyde and acetaldehyde in a mol ratio of 1:1 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into said pure water over 2 hours, employing a dripping funnel. During said addition, the reaction was conducted while minimizing coalescence of deposit particles by controlling the stirring rate. After said dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of the obtained P-1 was determined employing a DSC, resulting in 75° C.

Other polymers described in Table 1 were synthesized in the same manner as above.

These polymers may be employed individually or in combinations of at least two types as a binder. Said polymers are employed as a main binder in the light-sensitive silver salt containing layer (preferably in a light-sensitive layer) of the present invention. The main binder, as described herein, refers to the binder in the state in which the proportion of said binder is at least 50 percent by weight of the total binders of the light-sensitive silver salt containing layer. Accordingly, other binders may be employed in the range of less than 50 weight percent of the total binders. Said other polymers are not particularly limited as long as they are soluble in the solvents capable of dissolving the polymers of the present invention. More preferably listed as said polymers are poly(vinyl acetate), acrylic resins, and urethane resins.

The composition of polymers, which are preferably employed in the present invention, is shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal in mol % | Butyral in mol % | Acetal in mol % | Acetyl in mol % | Hydroxyl Group in mol % | Tq Value (in °C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a poly(vinyl butyral) resin B-79, manufactured by Solutia Ltd.

In the present invention, it is known that by employing crosslinking agents in the aforesaid binders, uneven development is minimized due to the improved adhesion of the layer to the support. In addition, it results in such effects that fogging during storage is minimized and the creation of print-out silver after development is also minimized.

Employed as crosslinking agents used in the present invention may be various conventional crosslinking agents, which have been employed for silver halide light-sensitive photographic materials, such as aldehyde based, epoxy based, ethyleneimine based, vinylsulfone based sulfonic acid ester based, acryloyl based, carbodiimide based, and silane compound based crosslinking agents. of these, preferred are isocyanate based compounds, silane compounds, epoxy compounds or acid anhydrides, as shown below.

As one of preferred crosslinking agents, isocyanate based and thioisocyanate based crosslinking agents represented by Formula [8], described below, will now be described.

$$X_2{=}C{=}N{-}L{-}(N{-}C{=}X_2)_v \qquad \text{Formula [8]}$$

wherein v represents 1 or 2; L represents an alkyl group, an aryl group, or an alkylaryl group which is a linking group having a valence of v+1; and $X_2$ represents an oxygen atom or a sulfur atom.

Incidentally, in the compounds represented by said Formula [8], the aryl ring of said aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

Said isocyanate based crosslinking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Specifically, employed may be isocyanate compounds described on pages 10 through 12 of Japanese Patent Publication Open to Public Inspection No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when said support is paper, they may be incorporated in a sizing composition), and optional layers such as a light-sensitive layer, a surface protective layer, an interlayer, an antihalation layer, and a subbing layer, all of which are placed on the light-sensitive layer side of said support, and may be incorporated in at least two of said layers.

One embodiment of the present invention is characterized in that at least one type of crosslinking agent employed in the present invention is a polyfunctional aromatic isocyanate compound. The polyfunctional aromatic isocyanate compound, as described in the present invention, refers to a compound which has at least two of an isocyanate group or an isothiocyanate group in its molecular structure and, further, has an aromatic group in its molecular structure.

Generally, aromatic isocyanate compounds occasionally acquire a yellow tint during storage. As a result, it has been pointed out that they are not preferable in terms of image retention. The inventors of the present invention, however, discovered that by employing polyfunctional aromatic isocyanate compounds, especially polyfunctional aromatic isocyanate compounds represented by the aforesaid Formula (IH) while controlling the thermal transition temperature, it was possible to minimize minute density variation during storage of images without yellowing. In the aforesaid Formula (IH), each arylene group represented by $J_1$ and $J_2$ includes, for example, phenylene, tolylene, and naphthalene, and each alkylene group represented by $J_1$ and $J_2$ includes, for example, methylene, ethylene, trimethylene, tetramethylene, and hexamethylene. Alkynyl groups having a valence of (v+1), represented by L, include methyl, ethyl, propyl, butyl and pentyl; alkenyl groups include ethenyl, propenyl, butadiene, and pentadiene; aryl groups include benzene, naphthalene, toluene, and xylene; heterocyclic groups include furan, thiophene, dioxane, pyridine, piperazine, and morpholine. Said group may include those formed by linking those groups via a linking group. Said linking group is one comprised of an oxygen atom, a nitrogen atom, a sulfur atom and phosphorous atom and optionally a carbon atom, and include, for example, O, S, NH, CO, SO, $SO_2$, NHCO, NHCONH, PO, and PS. The integer, which is represented by v as an integer of at least 1 is preferably an integer of 1 through 6, and is more preferably 1, 2, or 3.

Specific examples, represented by the aforesaid Formula (IH), are illustrated hereunder.

IH-1
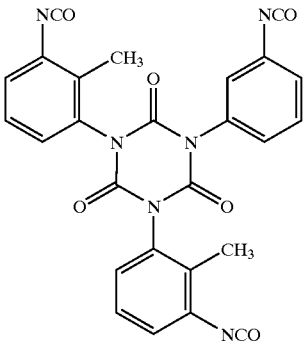
1H-2
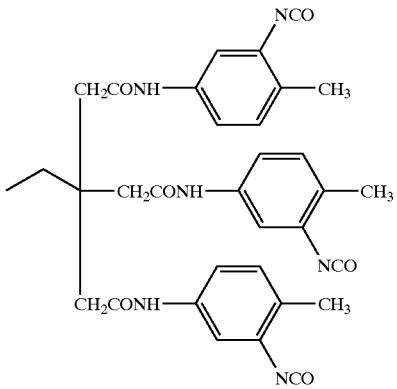
1H-3
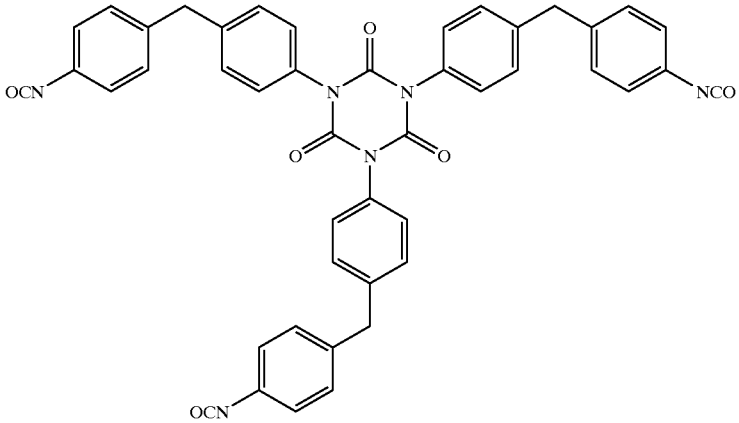
1H-4
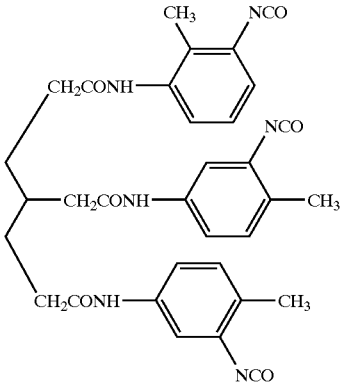
1H-5
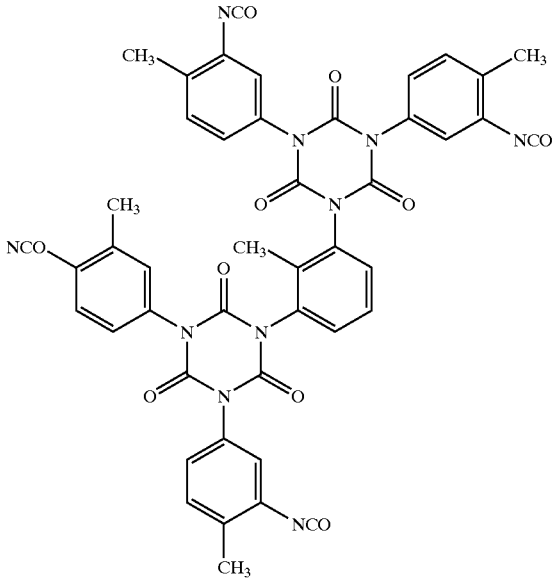

-continued
IH-6
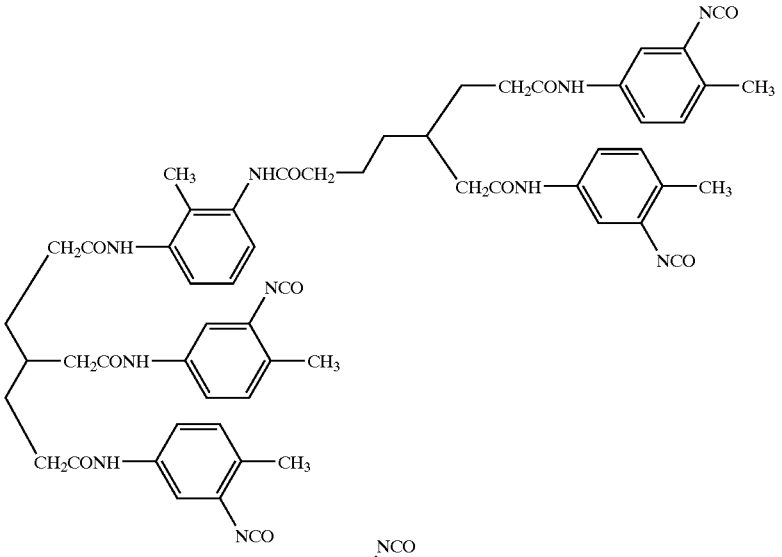
IH-7
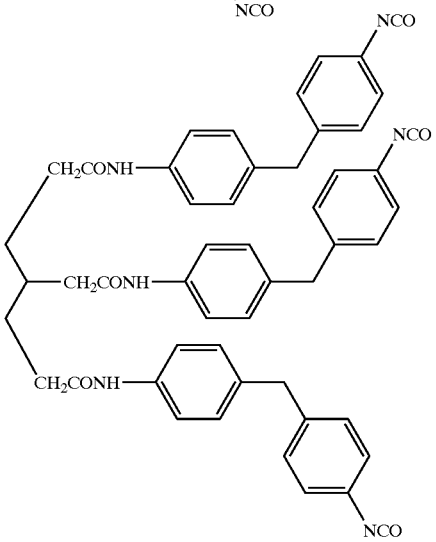
IH-8
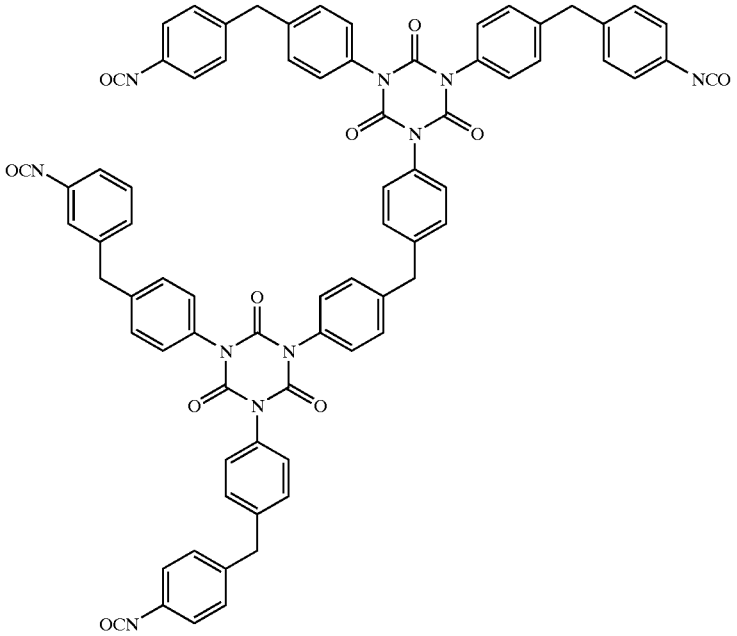

-continued
IH-9
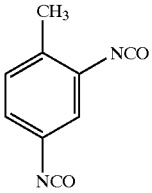
IH-10
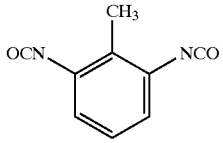
IH-11
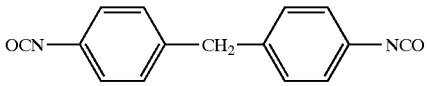
IH-12
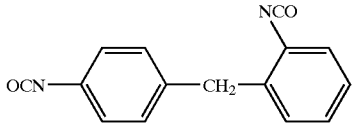
IH-13
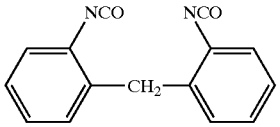
IH-14
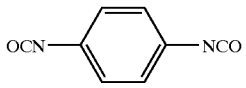
IH-15
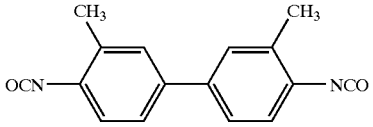
IH-16
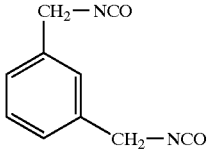
IH-17
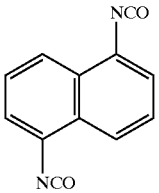
IH-18
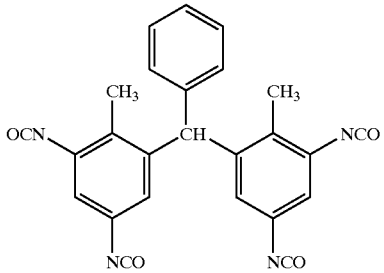
IH-19
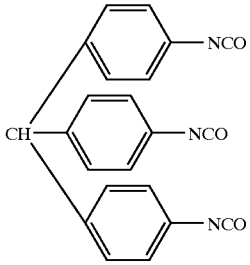
IH-20
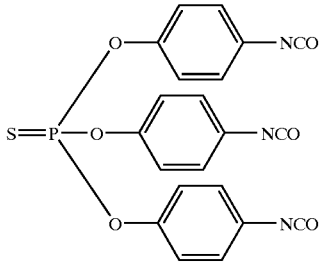
IH-21
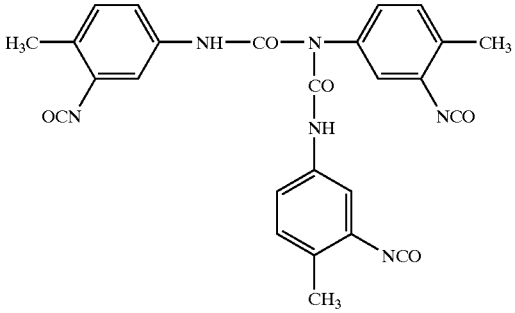
IH-22
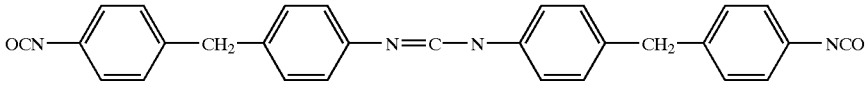

-continued

IH-23

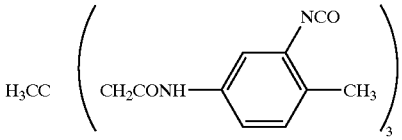

Such isocyanate compounds may be incorporated in any portion of the silver salt photothermographic dry imaging material. They may be incorporated in, for example, a support (particularly, when said support is paper, they may be incorporated in a sizing composition), and optional layers such as a light-sensitive layer, a surface protective layer, an interlayer, an antihalation layer, and a subbing layer which are placed on the light-sensitive layer side of said support, and may be incorporated in at least two of said layers.

Further, as thioisocyanate based crosslinking agents usable in the present invention, compounds having a thioisocyanate structure corresponding to said isocyanates are also useful.

The amount of said crosslinking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as said crosslinking agent. However, it is possible to obtain the desired results by employing compounds which have a v of 0, namely compounds having only one functional group.

Listed as examples of silane compounds which can be employed as a crosslinking agent in the present invention are compounds represented by General Formal (1) or Formula (2), described in Japanese Patent Application No. 2000-077904.

In said Formulas, $R^1$, $R^2$, $R^3$, $R^4$, $R^5$, $R^6$, $R^7$, and $R^8$ each represents a straight or branched chain or cyclic alkyl group having from 1 to 30 carbon atoms, which may be substituted, (such as a methyl group, an ethyl group, a butyl group, an octyl group, a dodecyl group, and a cycloalkyl group), an alkenyl group (such as a propenyl group, a butenyl group, and a nonenyl group), an alkynyl group (such as an acetylene group, a bisacetylene group, and a phenylacetylene group), an aryl group, or a heterocyclic group (such as a phenyl group, a naphthyl group, a tetrahydropyrane group, a pyridyl group, a furyl group, a thiophenyl group, an imidazole group, a thiazole group, a thiadiazole group, and an oxadiazole group, which may have either an electron attractive group or an electron donating group as a substituent.

At least one of substituents selected from $R^1$, $R^2$, $R^3$, $R^4$, $R^5$, $R^6$, $R^7$, and $R^8$ is preferably either a non-diffusive group or an adsorptive group. Specifically, $R^2$ is preferably either a non-diffusive group or an adsorptive group.

Incidentally, said non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of crosslinking agents. By introducing said non-diffusive groups, migration distance in the molecule at room temperature is retarded, whereby it is possible to retard reactions during storage.

Compounds, which can be used as a crosslinking agent, may be those having at least one epoxy group. The number of epoxy groups and corresponding molecular weight are not limited. It is preferable that said epoxy group be incorporated in the molecule as a glycidyl group via an ether bond or an imino bond. Further, said epoxy compound may be a monomer, an oligomer, or a polymer. The number of epoxy groups in the molecule is commonly from about 1 to about 10, and is preferably from 2 to 4. When said epoxy compound is a polymer, it may be either a homopolymer or a copolymer, and its number average molecular weight Mn is most preferably in the range of about 2,000 to about 20,000.

Preferred as epoxy compounds are those represented by Formula [9] described below.

Formula [9]

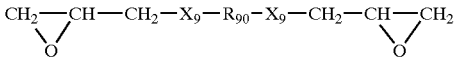

In Formula [9], the substituent of the alkylene group represented by $R_{90}$ is preferably a group selected from a halogen atom, a hydroxyl group, a hydroxyalkyl group, or an amino group. Further, the linking group represented by $R_{90}$ preferably has an amido linking portion, an ether linking portion, or a thioether linking portion. The divalent linking group, represented by $X_9$, is preferably —$SO_2$—, —$SO_2NH$—, —S—, —O—, or —$NR_{91}$—, wherein $R_{91}$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/$m^2$, and is more preferably in the range of $1\times10^{-5}$ to $1\times10^{-3}$ mol/$m^2$.

Said epoxy compounds may be incorporated in optional layers on the light-sensitive layer side of a support, such as a light-sensitive layer, a surface protective layer, an interlayer, an antihalation layer, and a subbing layer, and may be incorporated in at least two layers. In addition, said epoxy compounds may be incorporated in optional layers on the side opposite the light-sensitive layer on the support. Incidentally, when a light-sensitive material has a light-sensitive layer on both sides, said epoxy compounds may be incorporated in any layer.

Acid anhydrides are compounds which have at least one acid anhydride group having the structural Formula described below.

—CO—O—CO—

Said acid anhydrites are to have at least one such acid anhydride group. The number of acid anhydride groups, and the molecular weight are not limited, but the compounds represented by Formula [B] are preferred.

Formula [B]

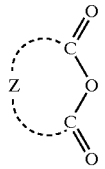

In Formula [B], Z represents a group of atoms necessary for forming a single ring or a polycyclic system. These cyclic systems may be unsubstituted or substituted. Example of substituents include, for example, an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/m$^2$ and is more preferably in the range of $1\times10^{-6}$ to $1\times10^{-3}$ mol/m$^2$.

In the present invention, said acid anhydrides may be incorporated in optional layers on the light-sensitive layer side on a support, such as a light-sensitive layer, a surface protective layer, an interlayer, an antihalation layer, or a subbing layer, and may be incorporated in at least two layers. Further, said acid anhydrides may be incorporated in the layer(s) in which said epoxy compounds are incorporated.

In the silver salt photothermographic dry imaging material of the present invention, photographic images are formed by thermal development. It is preferable that reducible silver sources (aliphatic carboxylic acid silver salts), light-sensitive silver halide grains, reducing agents, and if desired, image toners, which control silver tone, are incorporated in an (organic) binder matrix under a dispersed state.

Examples of suitable image toners are disclosed in Research Disclosure, Item 17029, and U.S. Pat. Nos. 4,123,282, 3,994,732, 3,846,136, and 4,021,249. Particularly preferred image color control agents are either phthalazinones or combinations of phthalazine with phthalic acids or phthalic anhydrides.

Incidentally, heretofore, it has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

"Colder tone" as well as "warmer tone", which is terminology of image tone, is expressed, employing minimum density $D_{min}$ and hue angle $h_{ab}$ at an optical density D of 1.0. Said hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of $180°<h_{ab}<270°$, is more preferably in the range of $200°<h_{ab}<270°$, and is most preferably in the range of $220°<h_{ab}<260°$.

In the present invention, in order to minimize image abrasion caused by handling prior to development as well as after thermal development, matting agents are preferably incorporated in the surface layer (on the light-sensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for said matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for said matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of said matting agents is preferably from 0.5 to 10.0 $\mu$m, and is more preferably from 1.0 to 8.0 $\mu$m. Further, the variation coefficient of the particle size distribution of the same is preferably less than or equal to 50 percent, is more preferably less than or equal to 40 percent, and is most preferably from less than or equal to 30 percent.

Herein, the variation coefficient of the particle size distribution refers to the value expressed by the formula described below.

(Standard deviation of particle diameter)/(particle diameter average)×100

Addition methods of the matting agent according to the present invention may include one in which said matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, poly(ethylene terephthalate) film, poly(ethylene naphthalate) film, polyamide film, polyimide film, cellulose triacetate film or polycarbonate film). Of these, in the present invention, biaxially stretched poly(ethylene terephthalate) film is particularly preferred. The thickness of said supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. Said compounds may be incorporated in any layer, but are preferably incorporated in a subbing layer, a backing layer, and an interlayer between the light-sensitive layer and the subbing layer. In the present invention, preferably employed are electrically conductive compounds described in columns 14 through 20 of U.S. Pat. No. 5,244,773.

The silver salt photothermographic dry imaging material of the present invention comprises a support having thereon at least one light-sensitive layer. Said light-sensitive layer may only be formed on the support. However, it is preferable that at least one light-insensitive layer is formed on said light-sensitive layer. For example, it is preferable that for the purpose of protecting a light-sensitive layer, a protective layer is formed on said light-sensitive layer, and in order to minimize adhesion between light-sensitive materials as well as adhesion in a wound roll, a backing layer is provided on the opposite side of the support. As binders employed in said protective layer as well as said backing layer, polymers such as cellulose acetate, cellulose acetate butyrate, which has a higher glass transition point from the thermal development layer and exhibit abrasion resistance as well as distortion resistance are sleeted from the aforesaid binders. Incidentally, for the purpose of increasing latitude, one of the preferred embodiments of the present invention is that at least two light-sensitive layers are provided on the one side of the support or at least one light-sensitive layer is provided on both sides of the support.

In the silver salt photothermographic dry imaging material of the present invention, in order to control the light amount as well as the wavelength distribution of light which transmits the light-sensitive layer, it is preferable that a filter layer is formed on the light-sensitive layer side or on the opposite side, or dyes or pigments are incorporated in said light-sensitive layer.

Employed as dyes may be compounds, known in the art, which absorb various wavelength regions according to the spectral sensitivity of light-sensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes, as described in Japanese Patent Application No. 11-255557, and thiopyryliumcroconium dyes or pyryliumcroconium dyes which are analogous to said squarylium dyes.

Incidentally, the compounds having a squarylium nucleus, as described herein, refers to ones having 1-cyclobutene-2-hydroxy-4-one in their molecular structure. Herein, said hydroxyl group may be dissociated. Hereinafter, all of these dyes are referred to as squarylium dyes.

Further, preferably employed as said dyes are compounds described in Japanese Patent Publication Open to Public Inspection No. 8-201959.

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a light-sensitive layer and a protective layer) is prepared. When the resultant coating compositions are applied onto a support, said coating compositions are not applied onto a support in such a manner that they are individually applied and subsequently dried, and said operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called as an extrusion coating method. Said extrusion coating method is suitable for accurate coating as well as organic solvent coating because volatilization on a slide surface, which occurs in a slide coating system, does not occur. Coating methods have been described for coating layers on the light-sensitive layer side. However, the backing layer and the subbing layer are applied onto a support in the same manner as above.

Incidentally, in the present invention, it is preferable that the silver coverage is suitably determined depending on the use purpose of silver salt photothermographic imaging materials. When employed for preparing medical images, said silver coverage is preferably from 0.1 to 2.5 g/m$^2$, and is more preferably from 0.5 to 1.5 g/m$^2$. Said silver coverage, derived from silver halide, is preferably from 2 to 18 percent with respect to the total silver weight, and is more preferably from 3 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within said range, from the viewpoint of maximum optical silver image density per definite silver coverage, namely covering power as well as silver image tone, desired results are obtained.

In the present invention, development conditions vary depending on employed devices and apparatuses, or means. Typically, an imagewise exposed silver salt photothermographic dry imaging material is heated at optimal high temperature. It is possible to develop a latent image formed by exposure by heating said material at relatively high temperature (for example, from about 100 to about 200° C.) for a sufficient period (commonly from about 1 second to about 2 minutes). When heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating said material, silver images are formed through an oxidation-reduction reaction between aliphatic carboxylic acid silver salts (which function as an oxidizing agent) and reducing agents. Said reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of said material while said surface comes into contact with the heating rollers.

When the silver salt photothermographic dry imaging material of the present invention is exposed, it is preferable to employ an optimal light source for the spectral sensitivity provided to said light-sensitive material. For example, when said light-sensitive material is sensitive to infrared radiation, it is possible to use any radiation source which emits radiation in the infrared region. However, infrared semiconductor lasers (at 780 nm and 820 nm) are preferably employed due to their high power, as well as ability to make light-sensitive materials transparent.

In the present invention, it is preferable that exposure is carried out utilizing laser scanning. Employed as said exposure methods are various ones. For example, listed as a firstly preferable method is the method utilizing a laser scanning exposure apparatus in which the angle between the scanning surface of a light-sensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When said laser beam scans light-sensitive materials, the beam spot diameter on the exposed surface of said light-sensitive material is preferably at most 200 $\mu$m, and is more preferably at most 100 mm, and is more preferably at most 100 $\mu$m. It is preferable to decrease said spot diameter due to the fact that it is possible to decrease the deviated angle from the verticality of laser beam incident angle. Incidentally, the lower limit of said laser beam spot diameter is 10 $\mu$m. By performing said laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple scanning, which minimizes degradation of image quality such as generation of unevenness analogous to interference fringes, compared to the scanning laser beam in a longitudinal single mode.

Said longitudinal multiple scanning is achieved utilizing methods in which return light due to integrated wave is employed, or high frequency superposition is applied. The longitudinal multiple scanning, as described herein, means that the wavelength of radiation employed for exposure is not single. The wavelength distribution of said radiation is commonly at least 5 nm, and is preferably at least 10 nm. The upper limit of the wavelength of said radiation is not particularly limited, but is commonly about 60 nm.

Incidentally, in the first and second embodiments as noted above, it is possible to suitably select any of the following lasers, which are generally well known, while matching the use. Said lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm. Incidentally, the beam spot diameter of lasers employed in laser imagers, as well as laser image setters, is commonly in the range of 5 to 75 $\mu$m in terms of a short axis diameter and in the range of 5 to 100 $\mu$m in terms of a long axis diameter. Further, it is possible to set a laser beam scanning rate at the optimal value for each light-sensitive material depending on the inherent sensitivity of the silver salt photothermographic dry imaging material at laser transmitting wavelength and the laser power.

EXAMPLES

The present invention will now be detailed with reference to examples. However, the present invention is not limited to these examples.

Example 1

<<Preparation of Support>>

One side surface of a poly(ethylene terephthalate) film base, tinted to blue at a density of 0.170 (of a thickness of 175 $\mu$m), was subjected to a corona discharge treatment of 0.5 kV.A.min/$m^2$. Thereafter, Subbing Layer "a" was formed by applying the Subbing Coating Composition A, described below, on the resultant surface so as to obtain a dried coating thickness of 0.2 $\mu$m. Further, in the same manner, the other surface was subjected to a corona discharge of 0.5 kV.A.min/$m^2$. Thereafter, Subbing Layer b was formed by applying the Subbing Coating Composition B described below onto the resultant surface so as to obtain a dried coating thickness of 0.1 $\mu$m. Subsequently, the resultant coating was subjected to a thermal treatment at 130° C. for 15 minutes in a thermal processing type oven, having a film transport device comprised of a plurality of rollers.

(Subbing Coating Composition A)

Mixed were 270 g of latex (30 percent solids) comprised of a copolymer of 30 percent by weight of n-butyl acrylate, 20 percent by weight of t-butyl acrylate, 25 percent by weight of styrene, and 25 percent by weight of 2-hydroxyethyl acrylate, 0.6 g of a surface active agent (UL-1), and 0.5 g of methyl cellulose. Further, a dispersion was added which was prepared by adding 1.3 g of silica particles (Siloid 350, manufactured by Fuji Silysia Chemical Ltd.) to 100 g of water and by dispersing the resultant mixture for 30 minutes employing an ultrasonic homogenizer (Ultrasonic Generator at a frequency of 25 kHz and 600 W, manufactured by ALEX Corporation). Finally, the total volume was adjusted to 1,000 ml by adding water. The resultant dispersion was designated as Subbing Coating Composition A.

(Preparation of Colloidal Tin Oxide Dispersion)

Dissolved in 2,000 ml of a water/ethanol mixed solution was 65 g of stannic chloride hydrate, and a uniform solution was prepared. Subsequently, the resultant solution was boiled and coprecipitates were obtained. The resultant precipitates were collected employing decantation, and subsequently washed with water several times. After confirming that by dripping an aqueous silver nitrate solution into distilled water, no chloride ion reaction occurred, the total volume was adjusted to 2,000 ml by adding said distilled water. Further, 40 ml of 40 percent ammonia water was added. Subsequently, the resultant aqueous solution was heated and concentrated so that the volume was reduced to 470 ml, whereby a colloidal tin oxide dispersion was prepared.

(Subbing Coating Composition B)

The aforesaid colloidal tin oxide dispersion (37.5 g), 3.7 g of a latex (30 percent solids) comprised of a copolymer of 20 percent by weight of n-butyl acrylate, 30 percent by weight of t-butyl acrylate, 27 percent by weight of styrene, and 28 percent by weight of 2-hydroxyethyl acrylate, 14.8 g of a latex (30 percent solids) of a copolymer of 40 percent by weight of n-butyl acrylate, 20 percent by weight of styrene, and 40 percent by weight of glycidyl methacrylate, and 0.1 g of surface active agent UL-1 were mixed. The total volume of the resulting mixture was adjusted to 1,000 ml by adding water, and the resultant mixture was designated as Subbing Coating Composition B.

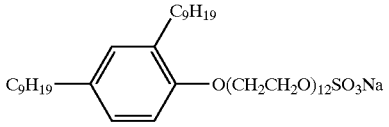

<<Back Side Coating>>

While stirring, added to 830 g of methyl ethyl ketone (MEK) were 84.2 g of cellulose acetate butyrate (CAB381-20 of Eastman Chemical Co.) and 4.5 g of a polyester resin (Vitel PE2200B of Bostic Co.), and dissolved. Subsequently, 0.30 g of Infrared Dye 1 was added to the resultant solution, and further, 4.5 g of an F based surface active agent (Surfron KH40 of Asahi Glass Co.) dissolved in 43.2 g of methanol and 2.3 g of an F based surface active agent (Megafag F120K of Dainippon Ink Co.) were added. Subsequently, the resultant mixture was well stirred until added compounds were completely dissolved. Finally, 75 g of silica (Siloid 64×6000 of W. R. Grace Co.) which was dispersed in methyl ethyl ketone at a concentration of 1 percent by weight, employing a dissolver type homogenizer, was added while stirring, whereby a coating composition for the back side was prepared.

Infrared Dye 1

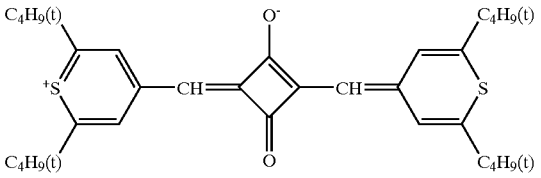

The back side coating composition prepared as above was applied onto the aforesaid Subbing Layer "b" so as to obtain a dried coating thickness of 3.5 μm, employing an extrusion coater, and subsequently dried. Drying was carried out for 5 minutes employing 100° C. airflow of a dew point of 10° C.

<<Preparation of Light—Sensitive Silver Halide Emulsion A>>

| | |
|---|---|
| Solution (A1) | |
| Phenylcarbamoyl-modified gelatin | 88.3 g |
| Compound (A) (10% aqueous methanol solution) | 10 ml |
| Potassium bromide | 0.32 g |
| Water to make | 5429 ml |
| Solution (B1) | |
| 0.67 mol/L aqueous silver nitrate solution | 2635 ml |
| Solution (C1) | |
| Potassium bromide | 51.55 g |
| Potassium iodide | 1.47 g |
| Water to make | 660 ml |
| Solution (D1) | |
| Potassium bromide | 154.9 g |
| Potassium iodide | 4.41 g |
| Iridium chloride (1 percent solution) | 0.93 ml |
| Water to make | 1982 ml |
| Solution (E1) | |
| 0.4 mol/L aqueous potassium bromide solution | the following amount controlled by silver potential |
| Solution (F1) | |
| Potassium hydroxide | 0.71 g |
| Water to make | 20 ml |
| Solution (G1) | |
| 56 percent aqueous acetic acid solution | 18.0 ml |
| Solution (H1) | |
| Sodium carbonate anhydride | 1.72 g |
| Water to make | 151 ml |
| Compound (A): $HO(CH_2CH_2O)_n(CH(CH_3)CH_2O)_{17}(CH_2CH_2O)_mH$ (m + N = 5 through 7) | |

Upon employing a mixing stirrer shown in Japanese Patent Publication Nos. 58-58288 and 58-58289, ¼ portion of Solution (B1) and whole Solution (C1) were added to Solution (A1) over 4 minutes 45 seconds, employing a double-jet precipitation method while adjusting the temperature to 30° C. and the pAg to 8.09, whereby nuclei were formed. After one minute, whole Solution (F1) was added. During said addition, the pAg was appropriately adjusted employing Solution (E1). After 6 minutes, ¾ portion of Solution (B1) and whole Solution (D1) were added over 14 minutes 15 seconds employing a double-jet precipitation method while adjusting the temperature to 30° C. and the pAg to 8.09. After stirring for 5 minutes, the mixture was cooled to 40° C., and whole Solution (G1) was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution (H1) was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodispersed cubic silver iodobromide grains having an average grain size of 0.040 μm, a grain size variation coefficient of 12 percent and a [100] plane ratio of 92 percent.

Subsequently, 240 ml of sulfur sensitizer S-5 (0.5 percent methanol solution) was added to the aforesaid emulsion and further, gold sensitizer Au-5 in an amount equivalent to 1/20 mol of said sensitizer was added. While stirring, the resultant mixture underwent chemical sensitization at 55° C. for 120 minutes, whereby a light-sensitive silver halide emulsion was prepared which was designated as Light-Sensitive Silver Halide Emulsion A.

<<Preparation of Powder Aliphatic Carboxylic Acid Silver Salt A>>

Dissolved in 4,720 ml of pure water were 130.8 g of behenic acid, 67.7 g of arachidic acid, 43.6 g of stearic acid, and 2.3 g of palmitic acid at 80° C. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 45.3 g of the aforesaid Light-Sensitive Silver Halide Emulsion A as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was set aside, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of said dryer, until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter.

<<Preparation of Preliminary Dispersion A>>

Dissolved in 1457 g of methyl ethyl ketone was 14.57 g of poly(vinyl butyral) resin P-9. While stirring, employing Dissolver DISPERMAT Type CA-40M, manufactured by VMA-Getzmann Co., 500 g of Powder Aliphatic Carboxylic Acid Silver Salt A was gradually added and sufficiently mixed, whereby Preliminary Dispersion A was prepared.

<<Preparation of Light-Sensitive Emulsion A>>

Preliminary Dispersion A was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/s, whereby Light-Sensitive Emulsion A was prepared.

<<Preparation of Stabilizer Solution>>

Stabilizer Solution was prepared by dissolving 1.0 g of Stabilizer 1 and 0.31 g of potassium acetate in 4.97 g of methanol.

<<Preparation of Infrared Sensitizing Dye A Solution>>

Infrared Sensitizing Dye A Solution was prepared by dissolving 19.2 mg of Infrared Sensitizing Dye 1, 1.488 g of 2-chloro-benzoic acid, 2.779 g of Stabilizer 2, and 365 mg of 5-methyl-2-mercaptobenzimidazole in 31.3 ml of MEK in a light-shielded room.

<<Preparation of Additive Solution "a">>

Additive Solution "a" was prepared by dissolving 27.98 g of 1,1-bis(2-hydroxy-3,5-dimethylphenyl)-3,5,5-trimethylhexane (Developing Agent A) and 1.54 g of 4-methylphthalic acid, and 0.48 g of the aforesaid Infrared Dye 1 in 110 g of MEK.

<<Preparation of Additive Solution "b">>

Additive Solution "b" was prepared by dissolving 3.56 g of Antifoggant 2 and 3.43 g of phthalazine in 40.9 g of MEK.

<<Preparation of Light-Sensitive Layer Coating Composition A>>

While stirring, 50 g of the aforesaid Light-Sensitive Emulsion A and 15.11 g of MEK were mixed and the resultant mixture was kept at 21° C. Subsequently, 390 μl of Antifoggant 1 (being a 10 percent methanol solution) was added and stirred for one hour. Further, 494 μl of calcium bromide (being a 10 percent methanol solution) was added and stirred for 20 minutes. Subsequently, 167 ml of Stabilizer Solution was added and stirred for 10 minutes. Thereafter the resulting mixture was cooled to 13° C. and stirred for an additional 30 minutes. While marinating at 13° C., 13.31 g of poly(vinyl acetal) Resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of Additive Solution "a", 1.6 ml of Desmodur N300/aliphatic isocyanate, manufactured by Mobay Chemical Co. (being a 10 percent MEK solution), and 4.27 g of Additive Solution "b" were successively added, whereby Light-Sensitive Layer Coating Composition A was prepared.

<<Preparation of Matting Agent Dispersion>>

Dissolved in 42.5 g of MEK was 7.5 g of cellulose acetate butyrate (CAB171-15 of Eastman Chemical Co.) and further, 5 g of calcium carbonate (Super-Pflex 200 of Speciality Minerals Co.) was added. The resultant mixture was dispersed at 8,000 rpm for 30 minutes, employing a dissolver type homogenizer, whereby a matting agent dispersion was prepared.

<<Preparation of Surface Protective Layer Coating Composition>>

While stirring, added to 865 g of MEK were 96 g of cellulose acetate butyrate (CAB171-15 of Eastman Chemical Co.), 4.5 g of poly(methyl methacrylic acid) (Paraloid A-21 of Rohm & Haas Co.), 1.5 g of vinylsulfone compound (VSC), 1.0 g of benzotriazole, and 1.0 g of an F-based surface active agent (Surfron KH40 of Asahi Glass Co.) and dissolved. Subsequently, 30 g of the aforesaid Matting Agent Dispersion was added and stirred, whereby a surface protective layer coating composition was prepared.

S-5

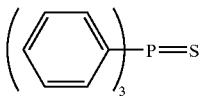

-continued

Au-5

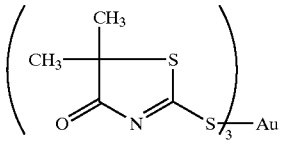

Stabilizer 1

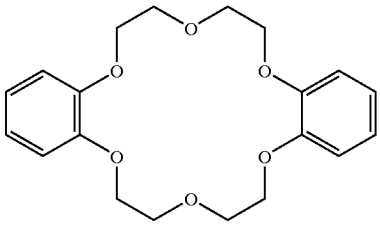

Antifoggant 1

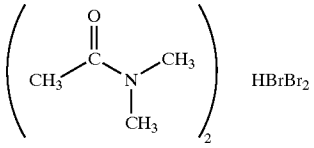

Stabilizer 2

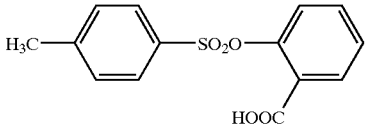

Antifoggant 2

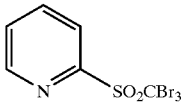

VSC

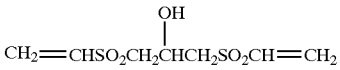

Infrared Sensitizing Dye 1

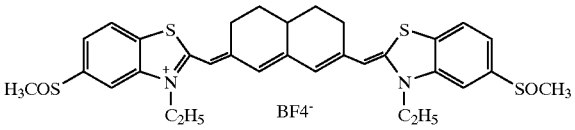

<<Preparation of Silver Salt Photothermographic Dry Imaging Material Sample 101>>

Sample 101 was prepared by simultaneously applying Light-Sensitive Layer Coating Composition A and Surface Protective Layer Coating Composition onto the aforesaid subbing layer "a", employing an extrusion type coater known in the art. Coating was carried out so as to obtain a silver coverage of said light-sensitive layer of 1.5 g/m$^2$ and a dried coating thickness of said protective layer of 2.5 $\mu$m. Thereafter, the coating was dried for 10 minutes employing 75° C. airflow having a dew temperature of 10° C., whereby Sample 101 was prepared.

Samples 102 through 122 were prepared in the same manner as Sample 101, except that the developing agent (a comparative developing agent in Additive Solution "a") and binder resin P-1 in Light-Sensitive Layer Coating Composition A were replaced with those described-in Table 2.

<<Exposure and Development Process>>

Scanning exposure was given onto the emulsion side surface of each sample prepared as above, employing an exposure apparatus in which a semiconductor laser, which was subjected to longitudinal multiple scanning mode of a wavelength of 800 to 820 nm, employing high frequency superimposition, was employed as a laser beam source. During said exposure, images were formed while adjusting the angle between the exposed surface of the sample and the exposure laser beam to 75 degrees (incidentally, compared to the case in which said angle was adjusted to 90 degrees, images were obtained which minimized unevenness and surprisingly exhibited excellent sharpness).

Thereafter, while employing an automatic processor having a heating drum, the protective layer of each sample was brought into contact with the surface of said drum and thermal development was carried out at 110° C. for 15 seconds. Exposure as well as development was carried out in the room which was conditioned at 23° C. and 50 percent relative humidity. The density of resulting images was determined employing a densitometer. Based on the resultant density, sensitivity (the reciprocal of an exposure amount ratio to result in density higher 1.0 than the unexposed part), fog, and maximum density were obtained as evaluation items. Table 2 shows results in which relative values are listed when the sensitivity or maximum density of Sample 101 is 100.

<Measurement of Thermal Transition Point Temperature>

Each of light-sensitive layer coating composition A and a surface protective layer coating composition having the same composition as above was applied onto a Teflon (R) plate, employing a wire bar under the same conditions as above and subsequently dried. Thereafter, the resultant coating was exposed so as to result in the maximum density and developed under the same conditions as above. Subsequently, the coating layer was peeled off from said Teflon (R) plate. Approximately 10 mg of each peeled sample was placed in an aluminum pan, and the thermal transition point temperature of each sample was determined employing a differential scanning calorimeter (EXSTAR 6000, manufactured by Seiko Denshi Co.). As conditions during said determination, temperature was increased at a rate of 10° C./minute from 0 to 200° C., while temperature was decreased at a rate of 20° C./minute from 200 to 0° C. Said operation was repeated twice and said thermal transition point temperature was determined.

<Evaluation of Storage Stability prior to Development>

Each sample was stored under the two commotions described below for 10 days. Thereafter, each sample was exposed and developed under the same conditions as above, and sensitivity was determined based on the resultant image. Further, the variation ratio of minimum density and sensitivity of each sample for Condition B to Condition A were obtained based on the Formula described below, and was utilized as the scale of the storage stability.

Condition A: 25° C. and 55 percent relative humidity

Condition B: 40° C. and 80 percent relative humidity

Variation ratio=minimum density or sensitivity under Condition *B*/minimum density or sensitivity under Condition *A*×100

<Evaluation of Image Retention Properties after Development>

The variation ratio of minimum density and that of maximum density under specified conditions, described below, were determined and the image retention properties after development was evaluated.

(1) Determination of Variation Ratio of Minimum Density ($D_{min}$)

Each of thermally developed samples, which had been prepared employing the same method as the aforesaid sensitivity determination, was allowed to stand for three days at an ambience of 45° C. and 55 percent relative humidity while a commercially available fluorescent lamp was arranged so as to result in an illuminance of 500 lux on the surface of each sample. The minimum density ($D_2$) of each of fluorescent light-exposed samples and the minimum density ($D_1$) of each of fluorescent light-unexposed samples were determined, and the variation ratio (in percent) of fog density was calculated based on the formula described below.

$$\text{Variation ratio of minimum density}=D_2/D_2\times 100 \text{ (in percent)}$$

(2) Determination of Variation Ratio of Maximum Density ($D_{max}$)

Each of thermally developed samples, which had been prepared in the same manner as the determination of said variation ratio of minimum density, was allowed to stand for three days at an ambience of 25° C. and 45° C. Thereafter, the variation of the maximum density was determined, and the variation ratio of image density was determined based on the Formula described below, which was utilized as the scale of the image retention Properties.

Variation ratio of image density=maximum density of the sample stored at 45° C./maximum density of the sample stored at 25° C.×100 (in percent)

<Determination of Hue Angle>

Hue angle $h_{ab}$ was determined as follows. The minimum density part and the part of an optical density of 1.0 of each of the developed samples were measured employing a spectral calorimeter CM-508d (manufactured by Minolta Co.) at a visual field of 2 degrees, while utilizing standard light source D65 specified by CIE as a calorimetric light source.

TABLE 2

| Sample No. | Developing Agent | Light-Sensitive Layer Binder | Light-Sensitive Layer Thermal Transition Point Temperature | Fog | Relative Sensitivity |
|---|---|---|---|---|---|
| 101 | A | P-1 | 55 | 0.220 | 100 |
| 102 | 1-3 | P-1 | 55 | 0.200 | 110 |
| 103 | 1-3 | P-2 | 50 | 0.202 | 110 |
| 104 | 1-3 | P-4 | 58 | 0.195 | 105 |
| 105 | 1-14 | P-1 | 55 | 0.203 | 110 |
| 106 | 1-24 | P-1 | 54 | 0.195 | 100 |
| 107 | A | P-9 | 44 | 0.242 | 95 |
| 108 | 1-3 | P-9 | 44 | 0.210 | 100 |
| 109 | 1-14 | P-9 | 44 | 0.212 | 103 |
| 110 | 1-24 | P-9 | 43 | 0.209 | 105 |
| 111 | 1-28 | P-1 | 55 | 0.196 | 105 |
| 112 | 1-31 | P-1 | 55 | 0.198 | 107 |
| 113 | 1-39 | P-1 | 55 | 0.197 | 108 |
| 114 | 1-47 | P-1 | 55 | 0.197 | 109 |
| 115 | A/1-24 | P-4 | 57 | 0.197 | 110 |
| 116 | A/1-28 | P-4 | 58 | 0.199 | 110 |
| 117 | 1-45 | P-5 | 62 | 0.200 | 106 |
| 118 | 1-55 | P-6 | 63 | 0.201 | 107 |
| 119 | 1-53 | P-7 | 50 | 0.201 | 105 |
| 120 | 1-60 | P-8 | 49 | 0.203 | 103 |
| 121 | 1-61 | P-3 | 66 | 0.205 | 102 |
| 122 | 1-28 | P-9 | 43 | 0.212 | 99 |

TABLE 2-continued

| | | Storage Stability prior to Development | | | Image Retention Properties after Development | | |
|---|---|---|---|---|---|---|---|
| Sample No. | Maximum Density (relative value) | $D_{min}$ Variation Ratio (in %) | Sensitivity Variation Ratio (in %) | Hue Angle $h_{ab}$ | $D_{min}$ Variation Ratio (in %) | $D_{max}$ Variation Ratio (in %) | Remarks |
| 101 | 100 | 150 | 75 | 150 | 150 | 85 | Comp. |
| 102 | 120 | 117 | 92 | 215 | 115 | 95 | Inv. |
| 103 | 125 | 115 | 93 | 214 | 112 | 92 | Inv. |
| 104 | 120 | 113 | 95 | 214 | 107 | 95 | Inv. |
| 105 | 120 | 115 | 93 | 210 | 108 | 98 | Inv. |
| 106 | 105 | 103 | 99 | 250 | 110 | 95 | Inv. |
| 107 | 92 | 175 | 65 | 130 | 165 | 82 | Comp. |
| 108 | 104 | 119 | 90 | 205 | 117 | 89 | Inv. |
| 109 | 103 | 120 | 89 | 205 | 118 | 88 | Inv. |
| 110 | 104 | 118 | 88 | 238 | 118 | 90 | Inv. |
| 111 | 128 | 107 | 95 | 235 | 107 | 93 | Inv. |
| 112 | 127 | 107 | 96 | 230 | 107 | 96 | Inv. |
| 113 | 127 | 106 | 94 | 230 | 106 | 97 | Inv. |
| 114 | 129 | 107 | 95 | 240 | 108 | 95 | Inv. |
| 115 | 130 | 103 | 98 | 245 | 107 | 96 | Inv. |
| 116 | 128 | 104 | 97 | 245 | 108 | 97 | Inv. |
| 117 | 126 | 109 | 96 | 255 | 107 | 97 | Inv. |
| 118 | 127 | 110 | 95 | 260 | 109 | 96 | Inv. |
| 119 | 125 | 110 | 95 | 260 | 105 | 97 | Inv. |
| 120 | 126 | 110 | 95 | 255 | 108 | 97 | Inv. |
| 121 | 125 | 109 | 96 | 250 | 110 | 97 | Inv. |
| 122 | 107 | 120 | 88 | 210 | 116 | 90 | Inv. |

Comp.: Comparative, Inv.: Present Invention

When developers are used in combination of two types, the weight ratio is to be 1:1.

As can clearly be seen from Table 2, silver salt photothermographic dry imaging materials of the present invention resulted in lower fog than Comparative Samples, even though the sensitivity was higher than or equal to said Comparative Samples, and exhibited excellent storage stability prior to development as well as excellent image retention Properties after development. Further, it was found that the hue angle of the samples of the present invention, specified in accordance with CIE, was from 180 to 270 degrees, which resulted in the cold image tone, whereby suitable output images for medical diagnosis were obtained.

Example 2

Silver salt photothermographic dry imaging materials were prepared in the same manner as Example 1, except for those described below.

<<Preparation of Powder Aliphatic Carboxylic Acid Silver Salt B>>

At 80° C., dissolved in 4,720 ml of pure water were 130.8 g of behenic acid, 67.7 g of arachidic acid, 43.6 g of stearic acid, and 2.3 g of palmitic acid. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 347 ml of t-butyl alcohol was added and stirred for 20 minutes. Thereafter, 45.3 g of the aforesaid Light-Sensitive silver Halide Emulsion A and 450 ml of pure water were added and the resultant mixture was stirred for 5 minutes.

Subsequently, 562.1 ml of 1 M silver nitrate solution was added over two minutes, and the resultant mixture was stirred for 10 minutes, whereby a aliphatic carboxylic acid silver salt dispersion was prepared. In the following, Powder Aliphatic Carboxylic Acid Silver Salt B was prepared in the same manner as Powder Aliphatic Carboxylic Acid Silver Salt A in Example 1.

<<Preparation of Powder Aliphatic Carboxylic Acid Silver Salt C>>

At 80° C., dissolved in 4,720 ml of pure water were 130.8 g of behenic acid, 67.7 g of arachidic acid, 43.6 g of stearic acid, and 2.3 g of palmitic acid. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 347 ml of t-butyl alcohol was added and stirred for 20 minutes. Thereafter, 45.3 g of the aforesaid Light-Sensitive Silver Halide Emulsion A and 450 ml of pure water were added and the resultant mixture was stirred for 5 minutes.

In the following, Powder Aliphatic Carboxylic Acid Silver Salt C was prepared in the same manner as Powder Aliphatic Carboxylic Acid Silver Salt A in Example 1.

<<Preparation of Powder Aliphatic Carboxylic Acid Silver Salt D>>

At 80° C., dissolved in 4,720 ml of pure water were 130.8 g of behenic acid, 67.7 g of arachidic acid, 32.2 g of stearic acid, 2.3 g of palmitic acid, and 17.0 g of isoarachidic acid. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 45.3 g of the aforesaid Light-Sensitive Silver Halide Emulsion A and 450 ml of pure water were added, and the resultant mixture was stirred for 5 minutes.

In the following, Powder Aliphatic Carboxylic Acid Silver Salt D was prepared in the same manner as Powder Aliphatic Carboxylic Acid Silver Salt A in Example 1.

<<Preparation of Powder Aliphatic Carboxylic Acid Silver Salt E>>

At 80° C., dissolved in 4,720 ml of pure water were 130.8 g of behenic acid, 67.7 g of arachidic acid, 37.6 g of stearic acid, 2.3 g of palmitic acid, and 6.0 g of oleic acid. Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 45.3 g of the aforesaid Light-Sensitive Silver Halide Emulsion A and 450 ml of pure water were added, and the resultant mixture was stirred for 5 minutes.

In the following, Powder Aliphatic Carboxylic Acid Silver Salt E was prepared in the same manner as Powder Aliphatic Carboxylic Acid Silver Salt A in Example 1.

<<Preparation of Powder Aliphatic Carboxylic Acid Silver Salt F>>

At 80° C., dissolved in 4,720 ml of pure water were 130.8 g of behenic acid, 67.7 g of arachidic acid, 43.6 g of stearic acid, 2.3 g of palmitic acid, and 1.5 g of poly(vinyl alcohol) (PVA-205, manufactured by Kuraray Co.). Subsequently, 540.2 ml of a 1.5 M aqueous sodium hydroxide solution was added, and further, 6.9 ml of concentrated nitric acid was added. Thereafter, the resultant mixture was cooled to 55° C., whereby an aliphatic acid sodium salt solution was prepared. While heating said aliphatic acid sodium salt solution at 55° C., 45.3 g of the aforesaid Light-Sensitive Silver Halide Emulsion A and 450 ml of pure water were added, and the resultant mixture was stirred for 5 minutes.

In the following, Powder Aliphatic Carboxylic Acid Silver Salt F was prepared in the same manner as Powder Aliphatic Carboxylic Acid Silver Salt A in Example 1.

<<Preparation of Preliminary Dispersions B through F>>

Each of preliminary dispersions was prepared in the same manner as Example 1, except that the powder aliphatic carboxylic acid silver salt was replace with each of Aliphatic Carboxylic Acid Silver Salts B through F.

<<Preparation of Light-Sensitive Emulsion B through F>>

Each of light-sensitive emulsions was prepared in the same manner as Example 1, except that the preliminary dispersion was replace with each of Preliminary Dispersions B through F.

<<Preparation of Light-Sensitive Layer Coating Compositions B through F>>

Each of Light-Sensitive Layer Coating compositions B through F was prepared in the same manner as the Light-Sensitive Layer Coating Composition A, while employing each of Light-Sensitive Emulsions B through F.

<<Preparation of Silver Salt Photothermographic Dry Imaging Material Sample 201>>

Sample 201 was prepared in the same manner as Example 1, employing the aforesaid Light-Sensitive Layer Coating Composition A as well as the aforesaid Surface Protective Layer Coating Composition.

Samples 202 through 223 were prepared in the same manner as Sample 201, except that the developing agent (being a developing agent in Additive Solution "a") and the Light-Sensitive Emulsion were replaced with those described in Table 3.

Incidentally, in all the samples, P-1 was employed as a binder resin in the light-sensitive layer coating composition. Further, the thermal transition temperature of the resultant light-sensitive layer was adjusted to approximately 55° C.

<Determination of Grain Diameter and Thickness of Aliphatic Carboxylic Acid Silver Salt>

A dispersed aliphatic carboxylic acid silver salt was diluted and applied onto a grid provided with a carbon supporting film. The grains in the resultant sample was captured at a magnification of 5,000, employing a transmission type electron microscope (Type 2000FX, manufactured by JEOL, Ltd.) The resultant negative images were scanned, converted to digital image, and stored. Subsequently, each diameter of 300 grains was determined employing an image processing apparatus Luzex III (manufactured by Nicolet Corp.) and an average was obtained.

The thickness of said grains was determined as follows. The light-sensitive layer coated on a support was adhered to a holder employing an adhesive, and 0.1 to 0.2 $\mu$m thick ultra-thin slices were prepared by cutting the resultant sample in the direction vertical to the surface of said support, employing a diamond knife. The resultant ultra-thin slice was held by a copper mesh and transferred to a carbon film which had been allowed to be hydrophilic by the application of a glow discharge. Subsequently, while cooling the resultant sample at less than or equal to −130° C., bright field images were observed at a magnification of 5,000 to 40,000, employing the aforesaid transmission type electron microscope and said images were recorded onto films. The diameter of each of 300 grains in the recorded images was determined employing an image processing apparatus Luzex III (manufactured by Nireco Corp.) and the average was obtained.

Exposure, development, and various types of evaluation were carried out in the same manner as Example 1.

TABLE 3

| Sample No. | Developing Agent | Light-Sensitive Emulsion | Aliphatic Carboxylic Acid Silver Salt Grain Diameter/ Thickness (in $\mu$m) | Fog | Relative Sensitivity |
|---|---|---|---|---|---|
| 201 | A | A | 0.82/0.08 | 0.220 | 100 |
| 202 | 1-3 | A | 0.82/0.08 | 0.198 | 110 |
| 203 | A | B | 0.77/0.06 | 0.225 | 115 |
| 204 | 1-3 | B | 0.77/0.06 | 0.202 | 112 |
| 205 | A | C | 0.34/0.03 | 0.230 | 110 |
| 206 | 1-3 | C | 0.34/0.03 | 0.203 | 118 |
| 207 | 1-14 | C | 0.34/0.03 | 0.198 | 122 |
| 208 | 1-14 | D | 0.42/0.03 | 0.203 | 117 |
| 209 | 1-14 | E | 0.46/0.04 | 0.199 | 122 |
| 210 | 1-14 | F | 0.48/0.04 | 0.192 | 119 |
| 211 | 1-24 | A | 0.82/0.08 | 0.188 | 125 |
| 212 | 1-24 | C | 0.34/0.03 | 0.175 | 131 |
| 213 | 1-24 | A | 0.77/0.06 | 0.200 | 127 |
| 214 | 1-28 | A | 0.34/0.03 | 0.205 | 125 |
| 215 | 1-28 | C | 0.77/0.06 | 0.204 | 124 |
| 216 | A/1-24 | A | 0.34/0.03 | 0.201 | 124 |
| 217 | A/1-28 | C | 0.46/0.04 | 0.202 | 123 |
| 218 | 1-35 | A | 0.82/0.08 | 0.208 | 121 |
| 219 | 1-40 | A | 0.77/0.06 | 0.200 | 122 |
| 220 | 1-44 | C | 0.34/0.06 | 0.201 | 124 |
| 221 | 1-52 | C | 0.34/0.03 | 0.202 | 123 |
| 222 | 1-60 | E | 0.34/0.03 | 0.203 | 123 |
| 223 | 1-28 | F | 0.48/0.04 | 0.204 | 122 |

| | | Storage Stability prior to Development | | | Image Retention Properties after Development | | |
|---|---|---|---|---|---|---|---|
| Sample No. | Maximum Density (relative value) | $D_{min}$ Variation Ratio (in %) | Sensitivity Variation Ratio (in %) | Hue Angle $h_{ab}$ | $D_{min}$ Variation Ratio (in %) | $D_{max}$ Variation Ratio (in %) | Remarks |
| 201 | 100 | 150 | 70 | 150 | 150 | 85 | Comp. |
| 202 | 110 | 114 | 89 | 215 | 112 | 92 | Inv. |
| 203 | 106 | 155 | 71 | 130 | 163 | 84 | Comp. |
| 204 | 113 | 117 | 89 | 217 | 114 | 94 | Inv. |
| 205 | 108 | 150 | 67 | 140 | 157 | 80 | Comp. |
| 206 | 122 | 117 | 90 | 217 | 122 | 96 | Inv. |
| 207 | 118 | 110 | 91 | 220 | 117 | 97 | Inv. |
| 208 | 116 | 110 | 91 | 220 | 121 | 95 | Inv. |
| 209 | 109 | 115 | 92 | 221 | 118 | 95 | Inv. |
| 210 | 107 | 115 | 91 | 221 | 122 | 95 | Inv. |
| 211 | 131 | 104 | 98 | 250 | 110 | 99 | Inv. |
| 212 | 141 | 107 | 97 | 255 | 107 | 99 | Inv. |
| 213 | 135 | 106 | 97 | 255 | 108 | 99 | Inv. |
| 214 | 133 | 105 | 97 | 260 | 109 | 98 | Inv. |
| 215 | 132 | 105 | 96 | 250 | 110 | 97 | Inv. |
| 216 | 137 | 104 | 97 | 243 | 107 | 99 | Inv. |
| 217 | 134 | 105 | 97 | 255 | 108 | 98 | Inv. |
| 218 | 130 | 107 | 95 | 243 | 109 | 96 | Inv. |
| 219 | 130 | 108 | 95 | 253 | 110 | 96 | Inv. |
| 220 | 130 | 107 | 95 | 253 | 111 | 96 | Inv. |
| 221 | 131 | 107 | 96 | 255 | 111 | 97 | Inv. |
| 222 | 130 | 109 | 95 | 253 | 111 | 97 | Inv. |
| 223 | 129 | 110 | 94 | 251 | 109 | 95 | Inv. |

Comp.: Comparative, Inv.: Present Invention

When developers are used in combination of two types, the weight ratio is to be 1:1.

As can clearly be seen from Table 3, silver salt photothermographic dry imaging materials of the present invention resulted in lower fogging than Comparative Samples, even though the sensitivity was higher than or equal to said Comparative Samples, and exhibited excellent storage stability prior to development as well as excellent image retention properties after development. Further, it was found that the hue angle of the samples of the present invention, specified in accordance with CIE, was from 180 to 270 degrees, which resulted in the cold image tone, whereby suitable output images for medical diagnosis were obtained.

Example 3

In order to investigate effects of silver saving agents according to the present invention, a support was prepared employing the same method as in Example, except that one g of the silver saving agent, described below, was added to the aforesaid Subbing Coating Composition A.

Silver Saving Agent

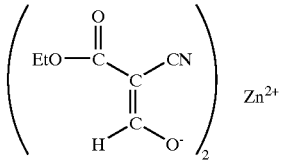

Further, the silver halide emulsion, described below, was prepared.

<<Preparation of Light-Sensitive Silver Halide Emulsion "a">>

Light-Sensitive Silver Halide Emulsion "a" was prepared in the same manner as Light-Sensitive Silver Halide Emulsion A of Example 1, except that the process, described as "240 ml of sulfur sensitizer S-5 (0.5 percent methanol solution) was added to the aforesaid emulsion and further, gold sensitizer Au-5 in an amount equivalent to 1/20 mol of said sensitizer was added. While stirring, the resultant mixture underwent chemical sensitization at 55° C. for 120 minutes", was removed.

<<Preparation of Light-Sensitive Emulsion "a" and Light-Sensitive Layer Coating Composition "a">>

Light-Sensitive Emulsion "a" and Light-Sensitive Layer Coating Composition "a" were prepared in the same manner except that Light-Sensitive Silver Halide Emulsion A of Light-Sensitive Layer Coating Composition C was replaced with the aforesaid Light-Sensitive Silver Halide Emulsion "a".

<<Preparation of Silver Salt Photothermographic Dry Imaging Material Sample 301>>

Sample 301 was prepared by simultaneously applying two light-sensitive layers and one protective layer. Coating was carried out so as to obtain a silver coverage of the light-sensitive layer (an upper layer) comprised of Light-Sensitive Emulsion C of 0.7 g/m$^2$, a silver coverage of the light-sensitive layer (an lower layer) comprised of Light-Sensitive Emulsion "a" of 0.3 g/m$^2$, and a dried coating thickness of said protective layer of 2.5 $\mu$m. Thereafter, the coating was dried for 10 minutes employing 50° C. airflow having a dew temperature of 10° C., whereby Sample 301 was prepared.

Samples 302 through 323 were prepared in the same manner as Sample 301, except that the developing agent (the developing agent in the aforesaid Additive Solution) in the light-sensitive layer coating composition was replaced with those described in Table 4.

Incidentally, in all the samples, P-1 was employed as a binder in said light-sensitive layer coating composition, and the thermal transition temperature of light-sensitive layers was adjusted to approximately 55° C.

Exposure, development, and various types of evaluation were carried out in the same manner as Example 1.

TABLE 4

| Sample No. | Developing Agent | Light-Sensitive Emulsion (upper layer/ lower layer) | Silver Saving Agent in Subbing Layer | Fog | Relative Sensitivity |
|---|---|---|---|---|---|
| 301 | A | C/a | not incorporated | 0.200 | 100 |
| 302 | A | C/a | Q | 0.415 | 125 |
| 303 | 1-3 | C/a | Q | 0.208 | 142 |
| 304 | 1-14 | C/a | Q | 0.202 | 136 |
| 305 | 1-18 | C/a | Q | 0.199 | 131 |
| 306 | 1-20 | C/a | Q | 0.203 | 129 |
| 307 | 1-24 | C/a | (1)-1 | 0.185 | 135 |
| 308 | 1-24 | C/a | (1)-35 | 0.170 | 150 |
| 309 | 1-24 | C/a | Q | 0.200 | 133 |
| 310 | 1-28 | C/a | (1)-1 | 0.188 | 147 |
| 311 | 1-28 | C/a | (1)-35 | 0.173 | 145 |
| 312 | 1-28 | C/a | (1)-4 | 0.179 | 140 |
| 313 | A/1-24 | C/a | (1)-1 | 0.180 | 149 |
| 314 | A/1-28 | C/a | (1)-35 | 0.180 | 146 |
| 315 | 1-33 | C/a | (1)-35 | 0.185 | 140 |
| 316 | 1-38 | C/a | (1)-20 | 0.186 | 137 |
| 317 | 1-41 | C/a | (1)-25 | 0.190 | 138 |
| 318 | 1-49 | C/a | (1)-33 | 0.195 | 140 |
| 319 | 1-52 | C/a | (1)-5 | 0.197 | 140 |
| 320 | 1-57 | C/a | (1)-6 | 0.198 | 141 |
| 321 | 1-60 | C/a | (1)-9 | 0.195 | 140 |
| 322 | 1-66 | C/a | (1)-15 | 0.196 | 138 |
| 323 | 1-67 | C/a | (1)-14 | 0.194 | 137 |

| | | Storage Stability prior to Development | | | Image Retention Properties after Development | | |
|---|---|---|---|---|---|---|---|
| Sample No. | Maximum Density (relative value) | $D_{min}$ Variation Ratio (in %) | Sensitivity Variation Ratio (in %) | Hue Angle $h_{ab}$ | $D_{min}$ Variation Ratio (in %) | $D_{max}$ Variation Ratio (in %) | Remarks |
| 301 | 100 | 160 | 65 | 150 | 148 | 88 | Comp. |
| 302 | 155 | 167 | 55 | 130 | 145 | 75 | Comp. |
| 303 | 152 | 117 | 92 | 215 | 119 | 95 | Inv. |
| 304 | 149 | 113 | 93 | 217 | 117 | 97 | Inv. |
| 305 | 150 | 113 | 92 | 220 | 111 | 96 | Inv. |
| 306 | 143 | 115 | 94 | 220 | 118 | 94 | Inv. |
| 307 | 165 | 106 | 97 | 255 | 107 | 97 | Inv. |
| 308 | 175 | 102 | 99 | 260 | 102 | 99 | Inv. |
| 309 | 160 | 109 | 95 | 235 | 103 | 96 | Inv. |
| 310 | 162 | 107 | 97 | 250 | 104 | 97 | Inv. |
| 311 | 165 | 107 | 98 | 260 | 103 | 97 | Inv. |
| 312 | 163 | 106 | 98 | 250 | 103 | 97 | Inv. |
| 313 | 170 | 103 | 96 | 255 | 107 | 98 | Inv. |
| 314 | 165 | 103 | 97 | 255 | 108 | 97 | Inv. |
| 315 | 157 | 106 | 96 | 250 | 110 | 97 | Inv. |
| 316 | 158 | 105 | 96 | 240 | 110 | 97 | Inv. |
| 317 | 160 | 105 | 95 | 241 | 110 | 97 | Inv. |
| 318 | 160 | 105 | 95 | 242 | 110 | 97 | Inv. |
| 319 | 158 | 106 | 94 | 246 | 109 | 97 | Inv. |
| 320 | 156 | 107 | 95 | 250 | 109 | 96 | Inv. |
| 321 | 157 | 107 | 95 | 255 | 109 | 96 | Inv. |
| 322 | 157 | 107 | 96 | 256 | 109 | 96 | Inv. |
| 323 | 157 | 107 | 95 | 260 | 109 | 96 | Inv. |

Comp.: Comparative, Inv.: Present Invention

When developers are used in combination of two types, the weight ratio is to be 1:1.

As can clearly be seen from Table 4, multilayer-coated silver salt photothermographic dry imaging materials of the present invention resulted in lower fogging than Comparative Samples, even though the sensitivity was higher than or equal to said Comparative Samples, and exhibited excellent storage stability prior to development as well as excellent image retention properties after development. Further, it was found that the hue angle of the samples of the present invention, specified in accordance with CIE, was from 180 to 270 degrees, which resulted in the cold image tone, whereby suitable output images for medical diagnosis were obtained.

Example 1B

<<Preparation of Silver Salt Photothermographic Dry Imaging Material Sample 101B>>

Sample 101B was prepared by simultaneously applying Light-Sensitive Layer Coating Composition A and Surface Protective Layer Coating Composition, employing an extrusion type coater known in the art. Coating was carried out so as to obtain a silver coverage of said light-sensitive layer of 1.7 g/m$^2$ and a dried coating thickness of said protective layer of 2.5 $\mu$m. Thereafter, the coating was dried for 10 minutes employing 75° C. airflow having a dew point temperature of 10° C., whereby Sample 101B was prepared.

Samples 102B through 115B were prepared in the same manner as Sample 101B, except that the comparative crosslinking agent as well as binder resin P-9 in the Light-Sensitive Layer Coating Composition A, and the silver coverage were replaced with those described in Table 2B. Exposure, development, and various types of evaluation were carried out in the same manner as Example 1.

TABLE 2B

| Sample No. | Aromatic Isocyanate | Light-Sensitive Layer Binder Resin | Light-Sensitive Layer Thermal Transition Point Temperature (° C.) | Silver Coverage (in g/m$^2$) | Fog |
|---|---|---|---|---|---|
| 101 | — | P-9 | 39 | 1.5 | 0.225 |
| 102 | — | P-1 | 52 | 1.5 | 0.231 |
| 103 | — | P-2 | 47 | 1.5 | 0.229 |
| 104 | — | P-4 | 56 | 1.5 | 0.232 |
| 105 | — | P-9 | 41 | 1.7 | 0.243 |
| 106 | IH-1 | P-9 | 40 | 1.5 | 0.211 |
| 107 | IH-2 | P-9 | 40 | 1.5 | 0.212 |
| 108 | IH-3 | P-9 | 41 | 1.5 | 0.209 |
| 109 | IH-1 | P-9 | 41 | 1.5 | 0.207 |
| 110 | IH-1 | P-1 | 55 | 1.5 | 0.197 |
| 111 | IH-1 | P-1 | 54 | 1.5 | 0.195 |
| 112 | IH-1 | P-2 | 49 | 1.5 | 0.203 |
| 113 | IH-1 | P-4 | 57 | 1.5 | 0.206 |
| 114 | IH-2 | P-1 | 52 | 1.5 | 0.209 |
| 115 | IH-3 | P-1 | 56 | 1.5 | 0.182 |

| | | | Image Retention Properties after Development | | |
|---|---|---|---|---|---|
| Sample No. | Relative Sensitivity | Maximum Density (relative value) | $D_{min}$ Variation Ratio (in %) | $D_{max}$ Variation Ratio (in %) | Hue Angle |
| 101B | 100 | 100 | 149 | 83 | 178 |
| 102B | 101 | 103 | 158 | 84 | 178 |
| 103B | 99 | 104 | 157 | 85 | 179 |
| 104B | 96 | 103 | 167 | 87 | 179 |
| 105B | 91 | 110 | 159 | 82 | 171 |
| 106B | 106 | 97 | 126 | 94 | 182 |
| 107B | 103 | 103 | 124 | 95 | 180 |
| 108B | 103 | 101 | 127 | 94 | 182 |

TABLE 2B-continued

| | | | | | |
|---|---|---|---|---|---|
| 109B | 100 | 102 | 119 | 94 | 185 |
| 110B | 107 | 108 | 121 | 97 | 192 |
| 111B | 110 | 110 | 115 | 95 | 193 |
| 112B | 110 | 109 | 125 | 93 | 189 |
| 113B | 113 | 113 | 118 | 95 | 193 |
| 114B | 105 | 113 | 110 | 98 | 189 |
| 115B | 110 | 110 | 107 | 96 | 191 |

As can clearly be seen from Table 2B, silver salt photothermographic dry imaging materials of the present invention resulted in lower fogging than Comparative Samples, even though the sensitivity was higher than or equal to said Comparative Samples, and exhibited excellent storage stability prior to development as well as excellent image retention properties after development. Further, it was found that the hue angle of the samples of the present invention, specified in accordance with CIE, was from 180 to 270 degrees, which resulted in the cold image tone, whereby suitable output images for medical diagnosis were obtained.

Example 2B

<<Preparation of Light-Sensitive Layer Coating Composition B>>

Light-Sensitive Layer Coating Composition B was prepared in the same manner as Light-Sensitive Layer Coating Composition A of Example 1, employing Light-Sensitive Emulsion B.

<<Preparation of Silver Salt Photothermographic Dry Imaging Material Sample 201B>>

Sample 201B was prepared in the same manner as Example 1, employing Light-Sensitive Layer Coating Composition B as well as the Surface Protective Layer Coating Composition of Example 1.

Samples 202B through 210B were prepared in the same manner as Sample 201B, except that the light-sensitive emulsion and the aromatic isocyanate compound in the light-sensitive layer coating composition were replaced with those described in Table 3B.

Incidentally, in all the samples, P-1 was employed as a binder resin in said light-sensitive layer coating composition. Further, the thermal transition temperature of said light-sensitive layer was adjusted to approximately 55° C.

Exposure, development, and various types of evaluation were carried out in the same manner as Example 1.

TABLE 3B

| Sample No. | Aromatic Isocyanate | Light-Sensitive Emulsion | Aliphatic Carboxylic Acid Silver Salt Grain Diameter/Thickness (in $\mu$m) | Fog | Relative Sensitivity | Maximum Density (relative value) | Image Retention Properties after Development: $D_{min}$ Variation Ratio (in %) | Image Retention Properties after Development: $D_{max}$ Variation Ratio (in %) |
|---|---|---|---|---|---|---|---|---|
| 201B | — | A | 0.82/0.08 | 0.237 | 100 | 100 | 164 | 84 |
| 202B | IH-1 | A | 0.82/0.08 | 0.198 | 107 | 108 | 121 | 97 |
| 203B | — | B | 0.77/0.06 | 0.241 | 114 | 106 | 163 | 84 |
| 204B | IH-1 | B | 0.77/0.06 | 0.203 | 112 | 114 | 123 | 96 |
| 205B | — | C | 0.34/0.03 | 0.242 | 110 | 108 | 157 | 80 |
| 206B | IH-1 | C | 0.34/0.03 | 0.197 | 122 | 124 | 121 | 95 |
| 207B | IH-2 | C | 0.34/0.03 | 0.21 | 117 | 115 | 118 | 94 |
| 208B | IH-3 | D | 0.42/0.03 | 0.201 | 119 | 118 | 121 | 95 |
| 209B | IH-1 | E | 0.46/0.04 | 0.199 | 118 | 109 | 118 | 95 |
| 210B | IH-1 | F | 0.48/0.04 | 0.192 | 117 | 107 | 122 | 95 |

As can clearly be seen from Table 3B, silver salt photothermographic dry imaging materials of the present invention resulted in lower fogging than Comparative Samples, even though the sensitivity was higher than or equal to said Comparative Samples, and exhibited excellent storage stability prior to development as well as excellent image retention Properties after development. Further, it was found that the hue angle of the samples of the present invention, specified in accordance with CIE, was from 180 to 270 degrees, which resulted in the cold image tone, whereby suitable output images for medical diagnosis were obtained.

Example 3B

<<Preparation of Silver Salt Photothermographic Dry Imaging Material Sample 301B>>

Sample 301B was prepared in the same manner as Sample 101 of Example 1, employing Light-Sensitive Layer Coating Composition A as well as the Surface Protective Layer Coating Composition of Example 1.

Samples 302B through 310B were prepared in the same manner as Sample 301B, except that the developing agent and the isocyanate compound in the Additive Solution were replaced with those described in Table 4B.

Incidentally, in all the samples, P-1 was employed as a binder resin in said light-sensitive layer coating composition. Further, the thermal transition temperature of said light-sensitive layer was adjusted to approximately 55° C.

Exposure, development, and various types of evaluation were carried out in the same manner as Example 1.

TABLE 4B

| Sample No. | Aromatic Isocyanate | Developing Agent | Fog | Relative Sensitivity | Maximum Density (relative value) | Image Retention Properties after Development: $D_{min}$ Variation Ratio (in %) | Image Retention Properties after Development: $D_{max}$ Variation Ratio (in %) | Remarks |
|---|---|---|---|---|---|---|---|---|
| 301B | — | Comp. | 0.237 | 100 | 100 | 164 | 84 | Comp. |
| 302B | IH-1 | — | 0.197 | 107 | 108 | 121 | 97 | Inv. |
| 303B | — | 1-3 | 0.247 | 114 | 110 | 163 | 84 | Comp. |
| 304B | IH-1 | 1-3 | 0.201 | 113 | 111 | 123 | 96 | Inv. |
| 305B | — | 1-14 | 0.247 | 115 | 114 | 152 | 83 | Comp. |
| 306B | IH-1 | 1-14 | 0.195 | 122 | 121 | 122 | 95 | Inv. |
| 307B | IH-2 | 1-14 | 0.204 | 117 | 115 | 118 | 94 | Inv. |
| 308B | IH-3 | 1-14 | 0.201 | 119 | 118 | 121 | 95 | Inv. |
| 309B | IH-1 | 1-24 | 0.199 | 118 | 109 | 118 | 95 | Inv. |
| 310B | IH-1 | I-28 | 0.192 | 117 | 107 | 122 | 95 | Inv. |

Comp.: Comparative, Inv.: Present Invention

As can clearly be seen from Table 4B, silver salt photothermographic dry imaging materials of the present invention resulted in lower fog than Comparative Samples, even though the sensitivity was higher than or equal to said Comparative Samples, and exhibited excellent storage stability prior to development as well as excellent image retention Properties after development. Further, it was found that the hue angle of the samples of the present invention, specified in accordance with CIE, was from 180 to 270 degrees, which resulted in the cold image tone, whereby suitable output images for medical diagnosis were obtained.

Example 4B

Samples 402B through 406B were prepared in the same manner as Sample 301 of Example 3, except that aromatic isocyanate in the light-sensitive layer coating composition was replaced with those described in Table 5B.

Incidentally, in all the samples, P-1 was employed as a binder resin in said light-sensitive layer coating composition. Further, the thermal transition temperature of said light-sensitive layer was adjusted to approximately 55° C.

Exposure, development, and various types of evaluation were carried out in the same manner as Example 1.

As can clearly be seen from Table 5B, silver salt photothermographic dry imaging materials of the present invention, comprising a multi-light-sensitive layer resulted in lower fog than Comparative Samples, even though the sensitivity was higher than or equal to said Comparative Samples, and exhibited excellent storage stability prior to development, as well as excellent image retention Properties after development. Further, it was found that the hue angle of the samples of the present invention, specified in accordance with CIE, was from 180 to 270 degrees, which resulted in the cold image tone, whereby suitable output images for medical diagnosis were obtained.

Based on the present invention, it is possible to provide a silver salt photothermographic dry imaging material which results in high sensitivity, minimizes fog, and exhibits excellent pre-exposure storage stability as well as excellent image retention properties together with an image recoding method of the same.

What is claimed is:

1. A photothermographic imaging material comprising a support having thereon a photosensitive layer comprising a photosensitive silver halide, a light-insensitive organic silver salt, a binder, and a reducing agent for silver ions, wherein the reducing agent is represented by the following Formula (S):

TABLE 5B

| Sample No. | Aromatic Isocyanate | Light-Sensitive Emulsion (upper layer/lower layer) | Silver Saving Agent in Subbing Layer | Silver Coverage (in g/m$^2$) | Fog | Relative Sensitivity | Maximum Density (relative value) | Image Retention Properties after Development: $D_{min}$ Variation Ratio (in %) | Image Retention Properties after Development: $D_{max}$ Variation Ratio (in %) |
|---|---|---|---|---|---|---|---|---|---|
| 301 | — | C/a | not incorporated | 1.0 | 0.200 | 100 | 100 | 148 | 88 |
| 402B | — | C/a | not incorporated | 2.0 | 0.240 | 100 | 135 | 178 | 67 |
| 403B | — | C/a | incorporated | 1.0 | 0.415 | 125 | 155 | 145 | 75 |
| 404B | IH-1 | C/a | incorporated | 1.0 | 0.208 | 142 | 152 | 119 | 95 |
| 405B | IH-2 | C/a | incorporated | 1.0 | 0.202 | 136 | 149 | 117 | 97 |
| 406B | IH-3 | C/a | incorporated | 1.0 | 0.199 | 131 | 150 | 111 | 96 |

Formula (S)

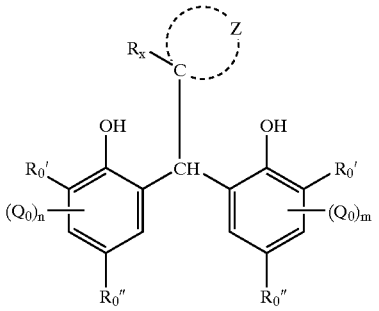

wherein Z is a group of atoms necessary to form a ring of 3 to 10 members, the ring being non-aromatic; Rx is a hydrogen or an alkyl group; each Ro' and Ro" is independently a hydrogen, an alkyl group, an aryl group, or a heterocyclic group; Qo is a substituent; and each n and m is independently an integer of 0 to 2; and plural Qos may be the same or different.

2. The photothermographic imaging material of claim 1, wherein the reducing agent is represented by the following Formula (T):

Formula (T)

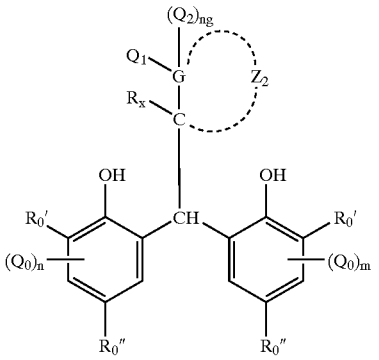

wherein Q1 is a halogen, an alkyl group, an aryl group or a heterocyclic group; Q2 is a hydrogen, a halogen, an alkyl group, an aryl group or a heterocyclic group; G is a nitrogen or a carbon; ng is 0 when G is a nitrogen and ng is 0 or 1 when G is a carbon; $Z_2$ is a group of atoms necessary to form a non aromatic ring of 3 to 10 members with G and a carbon atom; and each Ro', Ro", Rx, Qo, n and m is the same as used in Formula (S).

3. The photothermographic imaging material of claim 1, wherein the reducing agent has a 6 membered non aromatic ring.

4. The photothermographic imaging material of claim 1, wherein the photosensitive layer has a silver coverage of from 0.5 to 1.5 g/m$^2$.

5. The photothermographic imaging material of claim 1, wherein the photosensitive layer has a thermal transition temperature of from 46 to 200° C. measured after the photothermographic imaging material being processed at over 100° C.

6. The photothermographic imaging material of claim 1, wherein the binder has a glass transition temperature of from 70 to 105° C.

7. The photothermographic imaging material of claim 1, wherein the light-insensitive organic silver salt is produced in the presence of a compound selected from a crystallizing retarding agent and a dispersing agent.

8. The photothermographic imaging material of claim 7, wherein the compound is an organic compound having a hydroxyl group or a carboxyl group.

9. The photothermographic imaging material of claim 1, wherein the photosensitive layer further comprises a silver-saving compound.

10. The photothermographic imaging material of claim 9, wherein the silver-saving compound is represented by the following Formula (X):

Formula (X)

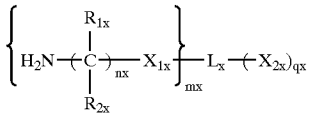

wherein each $R_{1X}$ and $R_{2X}$ is independently a hydrogen or a substituent; $X_{1X}$ is —S—, —O—, or —N($R_{3X}$)—, in which $R_{3X}$ being a hydrogen or a substituent; nx is an integer of 2 or 3; mx is an integer of 1 to 3; $X_{2X}$ is a ballast group, an adsorbing group to a silver halide or a silyl group; qx is an integer of 1 to 3; and $L_X$ is a linking group having 2 to 6 valences.

11. The photothermographic imaging material of claim 1, wherein the photosensitive image material further comprises a light insensitive layer, and a silver-saving compound is contained in the photosensitive layer or in the light insensitive layer.

12. The photothermographic imaging material of claim 1, wherein the photothermographic imaging material further comprises a second photosensitive layer on the support.

13. An image recording method, comprising the steps of:

(a) providing the photothermographic imaging material of claim 1 in a laser scanning exposure apparatus; and (b) exposing the photothermographic imaging material with a laser beam, wherein the laser beam is applied to the photothermographic imaging material using a longitudinal multiple scanning method.

14. An image forming method, comprising the steps of:

(a) providing the photothermographic imaging material of claim 1 in a laser scanning exposure apparatus;

(b) exposing the photothermographic imaging material with a laser beam; and, (c) developing the photothermographic imaging material by applying heat to the photothermographic imaging material after being exposed, wherein after the step (c) being carried out, the photothermographic imaging material exhibits a hue angle $h_{ab}$ which satisfies the following relationship:

$$180° < h_{ab} < 270°.$$

15. The photothermographic imaging material of claim 1, wherein the photosensitive layer further comprises a hardener selected from aromatic compounds having a plurality of isocyanate groups, and wherein the photosensitive layer has a silver coverage of from 0.5 to 1.5 g/m2.

16. The photothermographic imaging material of claim 15, wherein the photosensitive layer has a thermal transition temperature of from 46 to 200° C. measured after the photothermographic imaging material being processed at over 100° C.

17. The photothermographic imaging material of claim 15, wherein the binder has a glass transition temperature of from 70 to 105° C.

18. The photothermographic imaging material of claim 15, wherein the light-insensitive organic silver salt is produced in the presence of a compound selected from a crystallizing retarding agent and a dispersing agent.

19. The photothermographic imaging material of claim 18, wherein the compound is an organic compound having a hydroxyl group or a carboxyl group.

20. The photothermographic imaging material of claim 15, wherein the aromatic compounds are represented by the following Formula (IH):

$$X_2{=}C{=}N{-}J_1{-}(L)_n{-}(J_2{-}N{=}C{=}X_2)_V \qquad \text{Formula (IH)}$$

wherein each $J_1$ and $J_2$ is independently an arylene group or an alkylene group; L is a saturated or unsaturated aliphatic group, an aryl group or heterocyclic group, which may combine each other or with a divalent linking group, provided that L has a valence of (v+1); $X_2$ is an oxygen or a sulfur; v is an integer of more than 1; n is 0 or 1; and at least one of $J_1$, $J_2$ and L is a group derived from an aryl group.

21. The photothermographic imaging material of claim 15, wherein the photosensitive layer further comprises a silver-saving compound.

22. The photothermographic imaging material of claim 15, wherein the photosensitive image material further comprises a light insensitive layer, and a silver-saving compound is contained in the photosensitive layer or in the light insensitive layer.

23. The photothermographic imaging material of claim 15, wherein the photothermographic imaging material further comprises a second photosensitive layer on the support.

24. An image recording method, comprising the steps of:

(a) providing the photothermographic imaging material of claim 15 in a laser scanning exposure apparatus; and (b) exposing the photothermographic imaging material with a laser beam, wherein the laser beam is applied to the photothermographic imaging material using a longitudinal multiple scanning method.

25. An image forming method, comprising the steps of:

(a) providing the photothermographic imaging material of claim 15 in a laser scanning exposure apparatus;

(b) exposing the photothermographic imaging material with a laser beam; and, (c) developing the photothermographic imaging material by applying heat to the photothermographic imaging material after being exposed, wherein after the step (c) being carried out, the photothermographic imaging material exhibits a hue angle $h_{ab}$ which satisfies the following relationship:

$$180° < h_{ab} < 270°.$$

* * * * *